US008046965B2

(12) United States Patent
Rieber et al.

(10) Patent No.: US 8,046,965 B2
(45) Date of Patent: Nov. 1, 2011

(54) PARTITION SYSTEM AND METHOD OF ASSEMBLING SAME

(75) Inventors: Frederick Rieber, Hamburg, NY (US); Ronald Mccarthy, Toronto (CA)

(73) Assignee: Yardistry Limited (CA)

( * ) Notice: Subject to any disclaimer, the term of this patent is extended or adjusted under 35 U.S.C. 154(b) by 0 days.

(21) Appl. No.: 12/471,893

(22) Filed: May 26, 2009

(65) Prior Publication Data

US 2009/0282770 A1 Nov. 19, 2009

Related U.S. Application Data

(63) Continuation-in-part of application No. 11/734,306, filed on Apr. 12, 2007, now abandoned, which is a continuation-in-part of application No. 11/372,023, filed on Mar. 10, 2006, now abandoned, and a continuation-in-part of application No. 11/467,673, filed on Aug. 28, 2006, now abandoned.

(60) Provisional application No. 61/155,717, filed on Feb. 26, 2009, provisional application No. 61/155,722, filed on Feb. 26, 2009.

(51) Int. Cl.
*E04C 2/38* (2006.01)

(52) U.S. Cl. ..... 52/456; 52/475.1; 52/656.8; 52/773; 52/775; 52/780; 52/210

(58) Field of Classification Search ..... 52/204.1, 52/633, 240, 236.7, 236.9, 220.7, 481.2, 52/489.1, 243.1, 655.1, 654.1, 281, 769, 52/764, 482, 241, 582.1, 586.1, 202, 203, 52/204.59, 204.69, 311.3, 384, 455, 456–457, 52/475.1, 656.4, 656.8, 657, 664, 760, 773, 52/775, 780, 210–213; 160/130, 135
See application file for complete search history.

(56) References Cited

U.S. PATENT DOCUMENTS 1,712,107 A 5/1929 Gervais (Continued)

FOREIGN PATENT DOCUMENTS

DE 4306302 9/1993

(Continued)

OTHER PUBLICATIONS

Selby's famous "keyhole fittings" [online]. Selby Furniture Hardware Co. Inc. 1953 [retrieved on Jun. 14, 2010]. Retrieved from the Internet: <URL: http://www.selbyhardware.com/k5.htm>.

(Continued)

*Primary Examiner* — Jeanette Chapman
(74) *Attorney, Agent, or Firm* — Rader, Fishman & Grauer PLLC

(57) ABSTRACT

A partition to be supported by one or more support elements. The partition includes two or more panel modules, each panel module having two or more panel elements. The panel elements in each panel module are positioned relative to each other in a predetermined abutting arrangement selected from the group consisting of a vertical arrangement and a horizontal arrangement. The panel elements in each panel module define a joint intersection therebetween. Each panel module includes one or more fastening elements attached to the panel elements on both sides of the joint intersection to maintain the panel elements in the predetermined abutting arrangement. The fastening element is selected from the group consisting of a fastening element with a stud portion and a fastening element with a keyhole slot, the stud portion and said keyhole slot being adapted to cooperate to secure the panel modules together.

9 Claims, 62 Drawing Sheets

U.S. PATENT DOCUMENTS

| | | | | | |
|---|---|---|---|---|---|
| 1,800,800 | A | | 4/1931 | Kerby | |
| 2,116,584 | A | * | 5/1938 | Shelby | 403/381 |
| 2,408,281 | A | | 9/1946 | Wilkin | |
| 2,638,191 | A | | 5/1953 | Menosky | |
| 2,807,339 | A | | 9/1957 | Wagner | |
| 2,825,099 | A | * | 3/1958 | Simmons | 52/455 |
| 3,014,561 | A | | 12/1961 | Ratner et al. | |
| 3,099,865 | A | | 8/1963 | Burnett | |
| 3,440,786 | A | | 4/1969 | Weaver | |
| 3,456,409 | A | | 7/1969 | Piget | |
| 3,760,548 | A | | 9/1973 | Sauer et al. | |
| 3,817,396 | A | * | 6/1974 | Markson | 211/198 |
| 4,103,465 | A | * | 8/1978 | McDonald, Jr. | 52/127.12 |
| 4,147,001 | A | | 4/1979 | Oliver | |
| 4,353,193 | A | | 10/1982 | Sanderson | |
| 4,360,553 | A | | 11/1982 | Landheer | |
| 4,367,614 | A | * | 1/1983 | Warwick | 52/455 |
| 4,437,278 | A | | 3/1984 | Thomas, Jr. | |
| 4,739,594 | A | | 4/1988 | Langford et al. | |
| 4,765,110 | A | | 8/1988 | MacLeod | |
| 5,054,255 | A | | 10/1991 | Maninfior | |
| 5,117,599 | A | | 6/1992 | Voss | |
| 5,123,211 | A | | 6/1992 | Schlicht | |
| 5,179,810 | A | * | 1/1993 | Gename et al. | 52/240 |
| 5,477,647 | A | | 12/1995 | Yates, Jr. | |
| 5,590,500 | A | | 1/1997 | McCue | |
| 5,592,787 | A | | 1/1997 | Ophardt | |
| 5,642,593 | A | * | 7/1997 | Shieh | 52/239 |
| 5,660,376 | A | | 8/1997 | West | |
| 5,894,701 | A | | 4/1999 | Delorme | |
| 5,945,180 | A | | 8/1999 | Phillips | |
| 6,141,938 | A | | 11/2000 | Schiedegger | |
| 6,449,917 | B1 | | 9/2002 | Sullivan, III | |
| 6,694,683 | B2 | | 2/2004 | Anderson et al. | |
| 6,889,477 | B1 | | 5/2005 | Kottman | |
| 2004/0244317 | A1 | * | 12/2004 | Tan | 52/204.1 |
| 2007/0224885 | A1 | | 9/2007 | McCarthy | |

FOREIGN PATENT DOCUMENTS

| | | | |
|---|---|---|---|
| FR | 2760480 | | 9/1998 |
| GB | 265089 | A | 2/1927 |
| GB | 645491 | A | 11/1950 |
| GB | 2386137 | | 9/2003 |
| GB | 2400866 | | 10/2004 |

OTHER PUBLICATIONS

International Search Report for PCT/CA2010/000272, dated Jun. 16, 2010.

* cited by examiner 348
350
354
356
350L
387
382
389
384

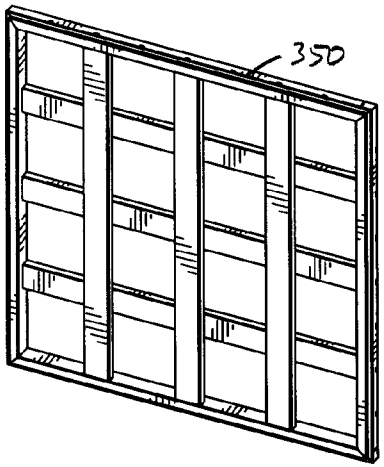
FIG. 31A
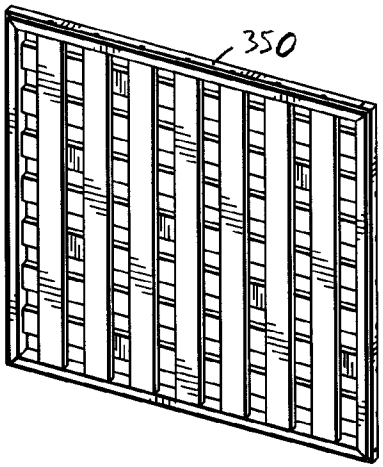
FIG. 31B
FIG. 31C
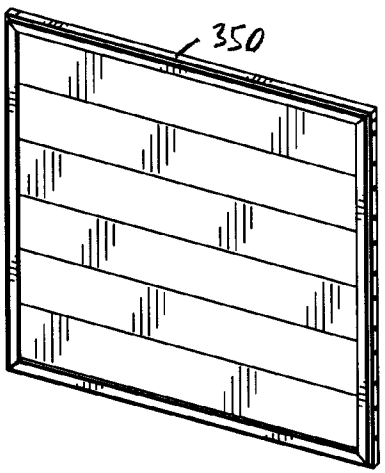
FIG. 31D
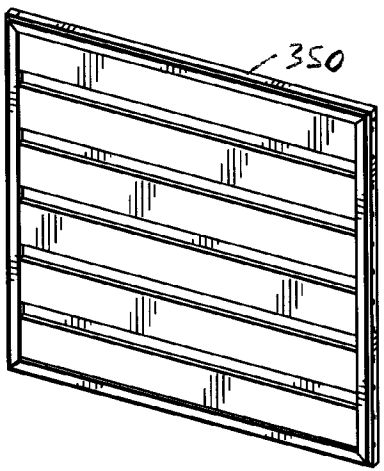
FIG. 31E

PARTITION SYSTEM AND METHOD OF ASSEMBLING SAME

This application is a continuation-in-part application of U.S. patent application Ser. No. 11/734,306, filed on Apr. 12, 2007, which is a continuation-in-part of U.S. patent application Ser. No. 11/372,023, filed Mar. 10, 2006 and U.S. patent application Ser. No. 11/467,673, filed Aug. 28, 2006, and this application also claims the benefit of U.S. Provisional Application No. 61/155,717, filed on Feb. 26, 2009, and U.S. Provisional Application No. 61/155,722, filed on Feb. 26, 2009, the entire contents of all of which prior applications are hereby incorporated herein by reference.

FIELD OF THE INVENTION

The present invention relates to a partition system and a method of assembling same.

BACKGROUND OF THE INVENTION

Fences or other partitions (e.g., garden screens, gazebos, and pergolas) may be constructed of various materials. The partition typically includes a support structure, as is well known in the art. Also, the support structure typically is itself supported by posts embedded in the ground, or in concrete which is placed in the ground. Alternatively, the support structure may be supported by other structures, e.g., a building.

The partition typically includes a barrier portion which is supported by the support structure. For example, in one known type of fence, the barrier portion includes boards which are attached to the support structure with the sides of the boards abutting, for privacy. In other known fences (e.g., picket fences), boards which are attached to the support structure are spaced apart from each other.

Construction of the support structure and the barrier portion according to known methods is somewhat time-consuming and laborious. Also, construction of the support structure and making and attaching the barrier portion generally requires some carpentry skills.

However, skilled tradesmen are generally in high demand, and the costs of their services are relatively high accordingly. Some homeowners have some of the necessary skills, but in general, such skills are gradually becoming less common, resulting in generally rising labor costs.

SUMMARY OF THE INVENTION

For the foregoing reasons, there is a need for a partition system which is relatively easily assembled from standardized components in a variety of predetermined configurations.

In its broad aspect, the invention provides a partition to be supported by one or more support elements. The partition includes two or more panel modules. Each panel module includes two or more panel elements positioned relative to each other in a predetermined abutting arrangement selected from the group consisting of a vertical arrangement, in which the panel elements are positioned operably vertically relative to each other, and a horizontal arrangement, in which the panel elements are positioned operably horizontally relative to each other. The two panel elements define a joint intersection therebetween. The partition also includes one or more fastening elements attached to the two panel elements on both sides of the joint intersection to maintain the two panel elements in the predetermined arrangement. The fastening element is selected from the group consisting of a fastening element with a stud portion and the keyhole slot, the stud portion and the keyhole slot being adapted to cooperate to secure the two panel modules together.

In another aspect, a first one of the two panel modules includes the fastening element with the stud portion and a second one of the two panel modules includes the fastening element with the keyhole slot.

In another of its aspects, the stud portion includes a head supported by a neck, and the keyhole slot includes a slot portion and an opening in communication with the slot portion, the opening being wider than the slot portion. The head is receivable in the opening, and the neck is receivable in the slot portion upon relative movement of the first and second panel modules after the head is received in the opening.

In yet another of its aspects, the slot portion is at least partially defined by side walls extending between the opening and a slot portion end wall, and the side walls are formed so that, as the neck is positioned in the slot portion closer to the slot portion end wall, the neck is subjected to increasing tension.

In another aspect, the second panel module includes a panel element end wall of the panel elements on which the fastening element comprising the slot portion is mounted, and the slot portion is at least partially defined by side walls extending beyond the opening and a slot portion end wall. Also, the opening is at least partially defined by an edge which is connected to the side walls. The side walls are formed so that the edge is located further away from the panel element end wall on which the fastening element with the slot portion is mounted than the slot portion end wall, so that the neck is subjected to tension when the neck and the head are positioned proximal to the slot portion end wall, to secure the panel modules together.

In another of its aspects, the invention provides a partition in which the slot portion is at least partially defined by side walls positioned to subject the stud portion to tension as the head is repositioned from the opening to the secured position, and after the head is received in the opening and after relative movement of the fastening elements on the panel modules to position the neck in the slot portion, the head and the neck are positionable in a secured position, in which the head is proximal to the end wall of the slot portion and the neck is in the slot portion to secure the panel modules together.

In yet another aspect, each of the panel modules additionally includes two or more edge fastening elements adapted for cooperation with each other to secure the panel modules together.

In another aspect, the invention provides a panel module for attachment to another panel module. The panel module includes two or more panel elements positioned relative to each other in a predetermined abutting arrangement to define a joint intersection therebetween. The panel module also includes one or more fastening elements attached to the panel elements on both sides of the joint intersection to maintain the panel elements in the predetermined abutting arrangement. Each fastening element is adapted to cooperate with one or more mating elements on the other panel module for securing the panel module and the other panel module together.

In yet another aspect, the panel module additionally includes one or more edge fastening elements attached to the panel module proximal to an end of the panel module, each edge fastening element being adapted to cooperate with one or more corresponding edge fastening elements on the other panel module for securing the panel module and the other panel module together.

In another aspect, the invention provides a partition system including a partition body, one or more support elements for supporting the partition body, and one or more couplers for coupling one or more ends of the partition body to the support element(s).

The partition body includes a number of panel modules, each panel module including two or more panel elements positioned relative to each other in a predetermined abutting arrangement to define a joint intersection therebetween. The partition body also includes one or more fastening elements attached to the panel elements on both sides of the joint intersection to maintain the panel elements in the predetermined abutting arrangement. Each fastening element is selected from the group consisting of a fastening element with a stud portion and a fastening element with a keyhole slot adapted to cooperate to secure the panel modules positioned adjacent to each other together to form the partition body extending between ends thereof.

In another aspect, the panel modules are provided in pairs, each pair including a first and a second selected panel module respectively. The first panel module includes the fastening element with the stud portion and the second panel module includes the fastening element with the keyhole slot, the first and second selected panel modules being positioned adjacent to each other. The stud portion includes a head supported by a neck.

The keyhole slot includes a slot portion and an opening in communication with the slot portion, the opening being substantially wider than the slot portion, and the head being receivable in the opening.

The neck is receivable in the slot portion upon relative movement of the first and second selected panel modules after the head is received in the opening.

In yet another of its aspects, the slot is at least partially defined by side walls positioned to subject the stud portion to tension as the head is repositioned from the opening to the secured position.

Also, after the head is received in the opening and after relative movement of the fastening elements on the first and second panel modules to position the neck in the slot, the head and the neck are positionable in a secured position, in which the head is proximal to the end wall of the slot portion and the neck is in the slot, to secure the adjacent panel modules to each other.

In another of its aspects, the invention provides a kit of parts for a partition system. The kit includes a number of panel modules. Each panel module includes two or more panel elements positioned relative to each other in a predetermined abutting arrangement to define a joint intersection therebetween, and one or more fastening elements attached to the panel elements on both sides of the joint intersection, to maintain the panel elements in the predetermined arrangement. The fastening element is selected from the group consisting of a stud portion and a slot portion adapted to cooperate with each other to secure the panel modules positioned adjacent to each other together to form the partition body extending between ends thereof. The kit also includes one or more support elements for supporting the partition body, and one or more couplers for coupling one or more of the ends of the partition body to the support element(s).

BRIEF DESCRIPTION OF THE DRAWINGS

The invention will be better understood with reference to the attached drawings, in which:

FIGS. 31A-31E are isometric views of different embodiments of panel elements of the invention, drawn at a smaller scale.

DETAILED DESCRIPTION

Figure 1A:
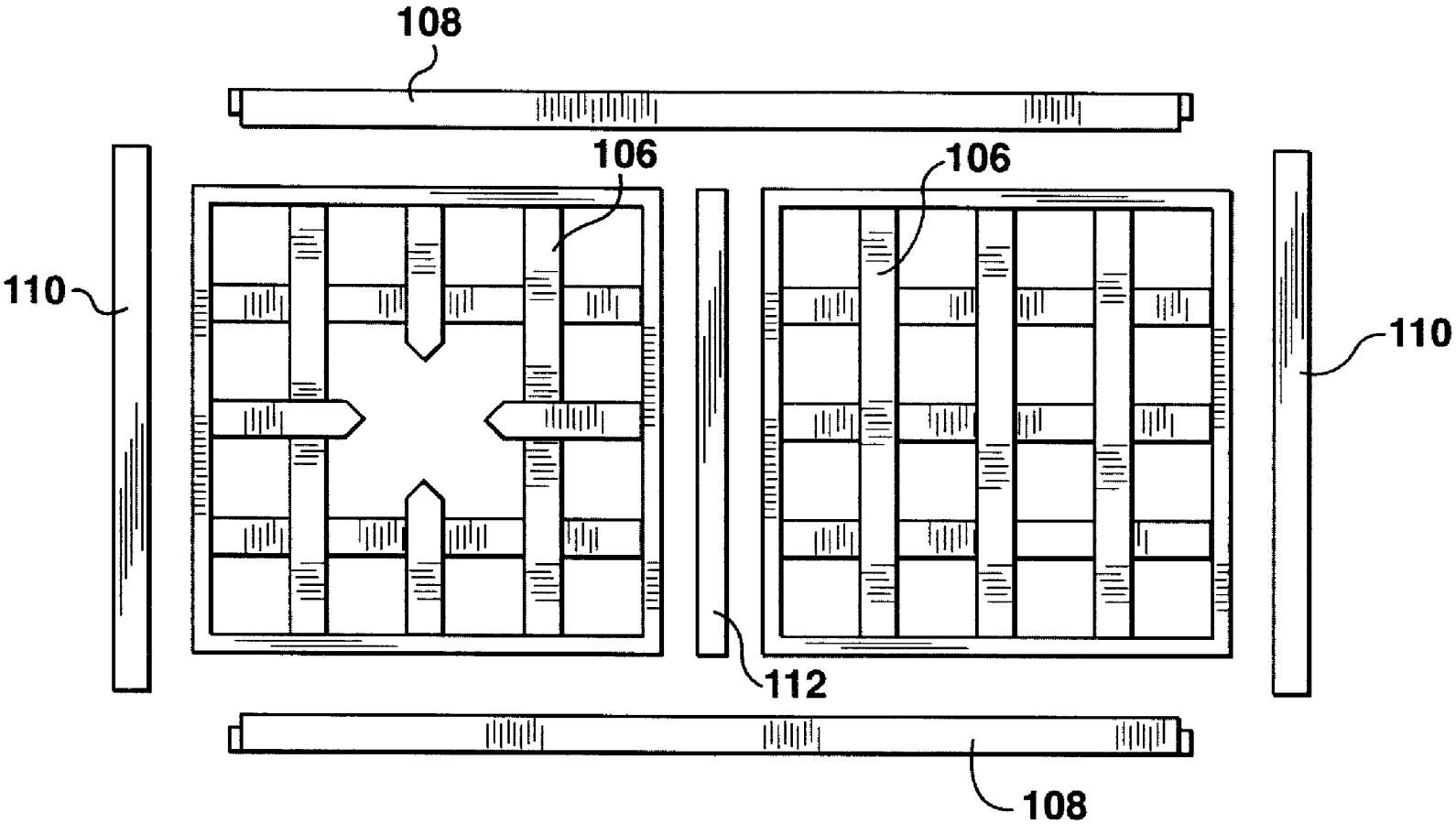
FIG. 1A illustrates, in a front view, a panel assembly in accordance with an embodiment of the present invention.
Figure 1B:
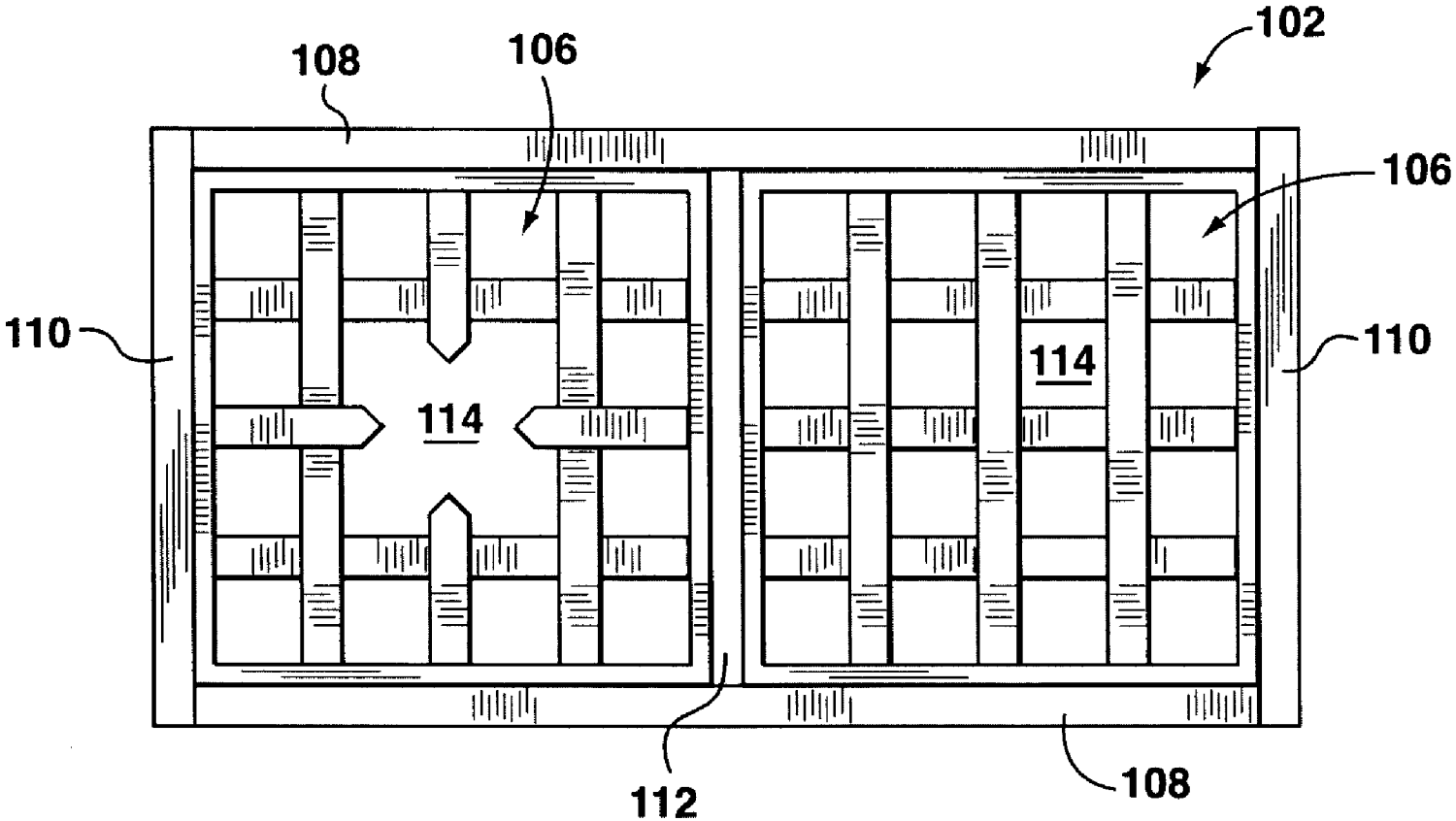
FIG. 1B, in a front view, illustrates a panel assembled from the modular panel assembly of FIG. 1A.

Referring to FIG. 1A, there is illustrated in a front view, some of the different components of a modular panel assembly 100 in accordance with an embodiment of the invention. Referring to FIG. 1B, there is illustrated in a front view, a panel 102 that has been assembled from the modular panel assembly 100 of FIG. 1A. As shown in FIG. 1A, the modular panel assembly 100 comprises two different types of components: structural members and design inserts 106. Structural members comprise rails 108, stiles 110 and at least one mullion 112. These structural members are assembled to provide two insert-receiving spaces 114 shown in FIG. 1B. The two design inserts are attached to the structural members and are located inside the two insert-receiving spaces 114. Each structural member has the same kind of structural coupler for mating with insert couplers of the design inserts 106. Examples of suitable structural couplers and insert couplers are described below with reference to FIGS. 10 to 13.

The panel 102 illustrated in FIG. 1B is merely one example of many different panels that may be constructed using modular panel assemblies in accordance with different aspects of different embodiments of the invention. Similarly, the modular panel assembly 100 shown in FIG. 1A would typically include many additional components that could be used to assemble panels. For example, modular panel assemblies in accordance with different aspects the invention may include structural members of many different dimensions to define insert-receiving spaces 114 of different dimensions that can accommodate design inserts 106 of different dimensions. Many different types of design inserts included in modular panel assemblies in accordance with aspects of embodiments of the invention are illustrated in FIGS. 3A to 3N, 4A to 4D, 5A and 5B. All of these structural members, however, use a common structural coupler, and all of the design inserts 106 also use a common insert coupler, such that different panels of widely varying appearance may readily be constructed using the modular panel assembly 100.

Figure 2C:
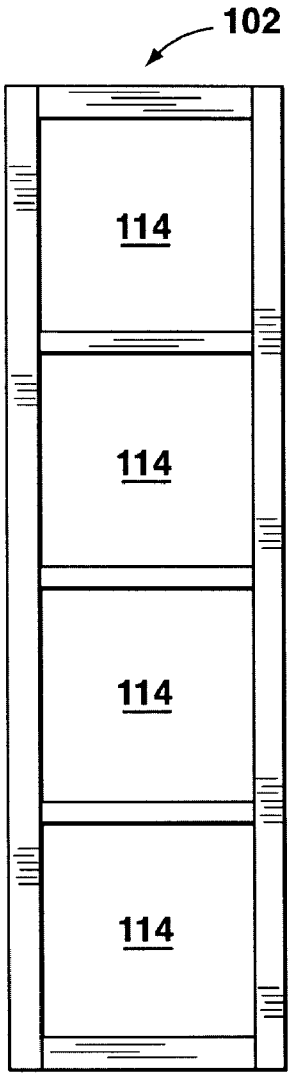
FIGS. 2A, 2B, 2C, 2D, 2E, 2F, 2G, 2H and 2I are front views of different panels (design inserts not shown) assembled from a modular panel assembly in accordance with an embodiment of the invention.
Figure 2B:
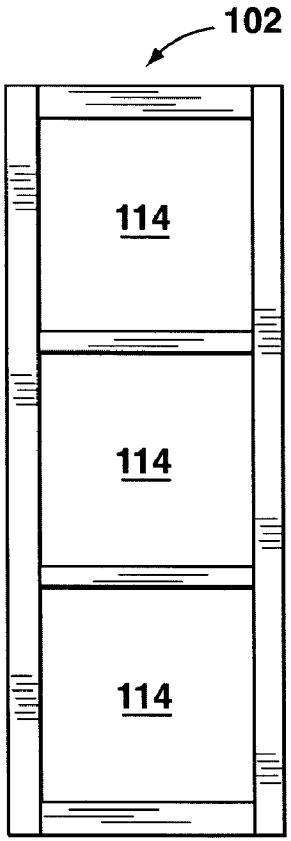
Figure 2A:
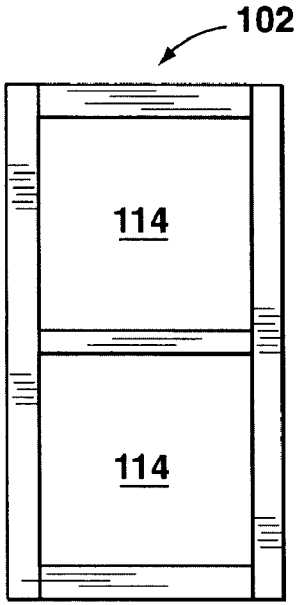

Referring to FIGS. 2A to 2I, different examples of panels 102 that can be assembled from modular panel assembly 100 are illustrated in front views. Design inserts 106 are not shown inserted into the insert-receiving spaces 114 of these panels. The shape and size of each panel 102 is based on the number of insert-receiving spaces 114, as well as the shape and size of each of these insert-receiving spaces 114. Put another way, the shape and size of each panel 102 is based on the number of design inserts 106 that such panel can receive. For example, FIG. 2A shows a panel 102 that can receive two different design inserts (not shown) in insert-receiving spaces 114. The panel 102 of FIG. 2A can be described as having a one-by-two configuration in that the panel is able to receive one design insert in one direction and two design inserts in the other direction.

Figure 2E:
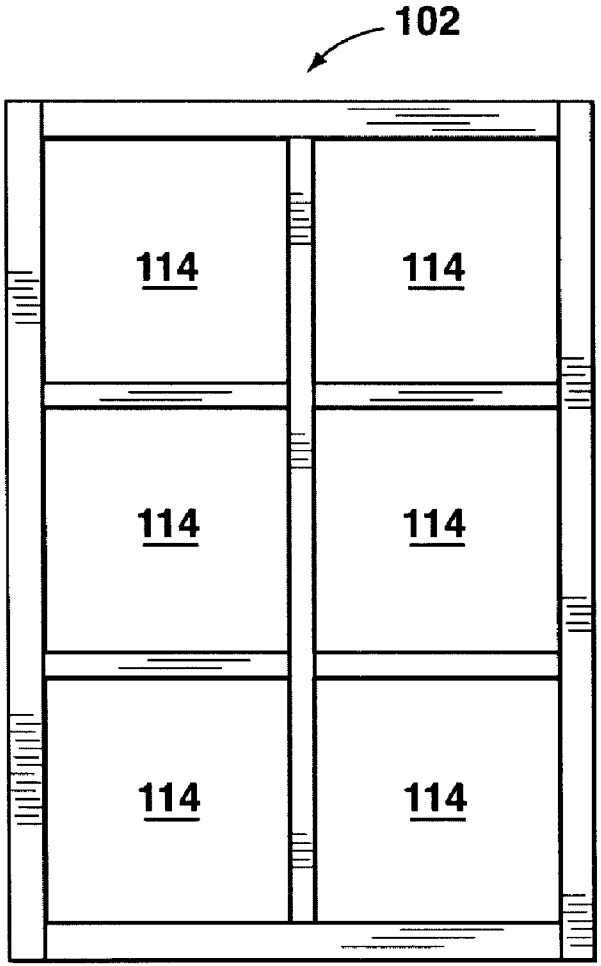
Figure 2D:
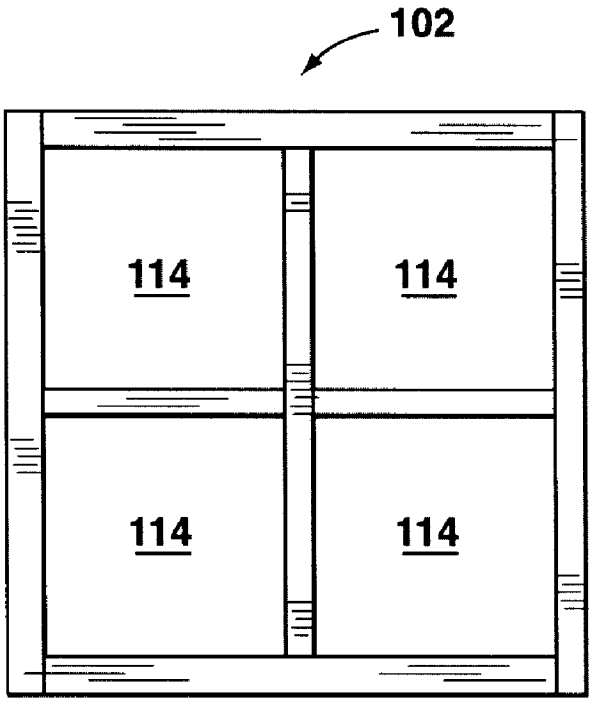
Figure 2G:
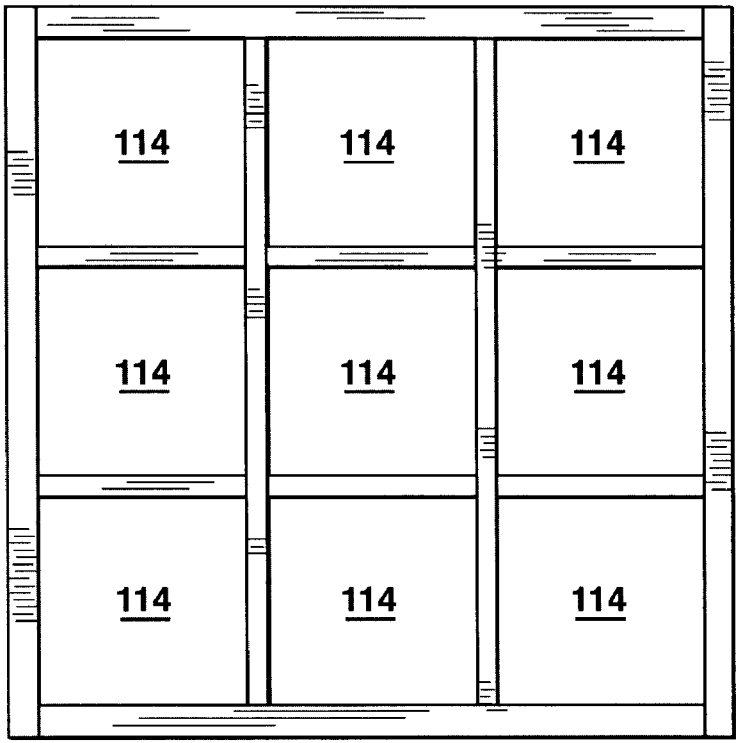
Figure 2F:
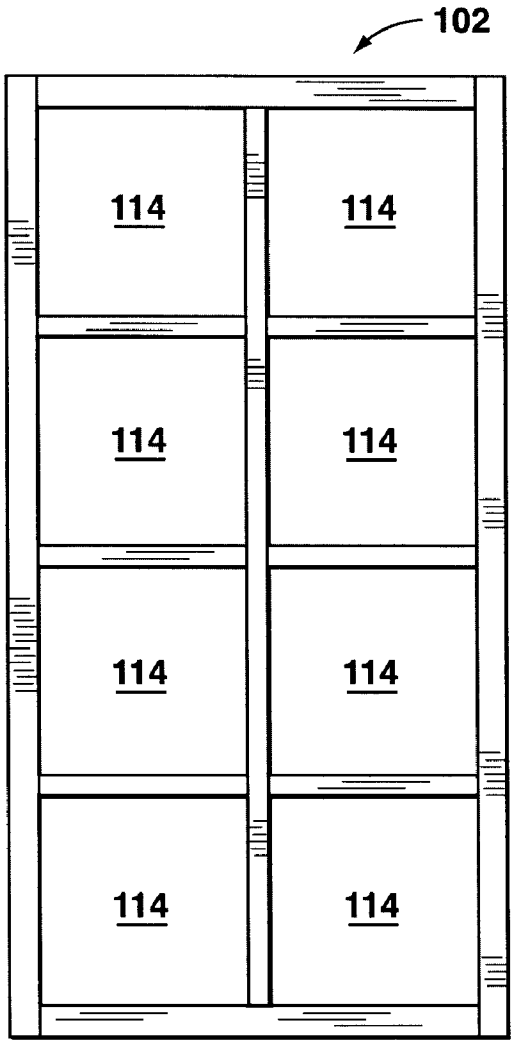
Figure 2H:
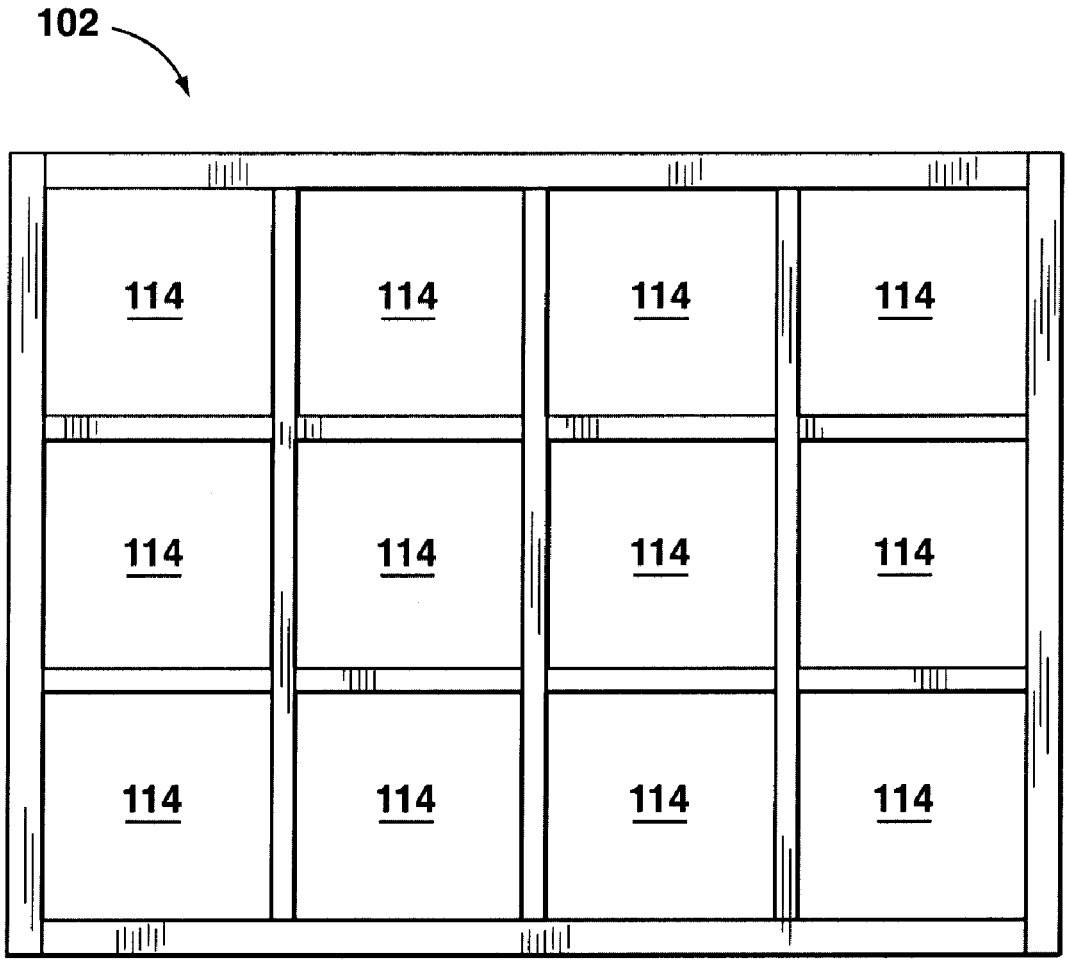
Figure 2I:
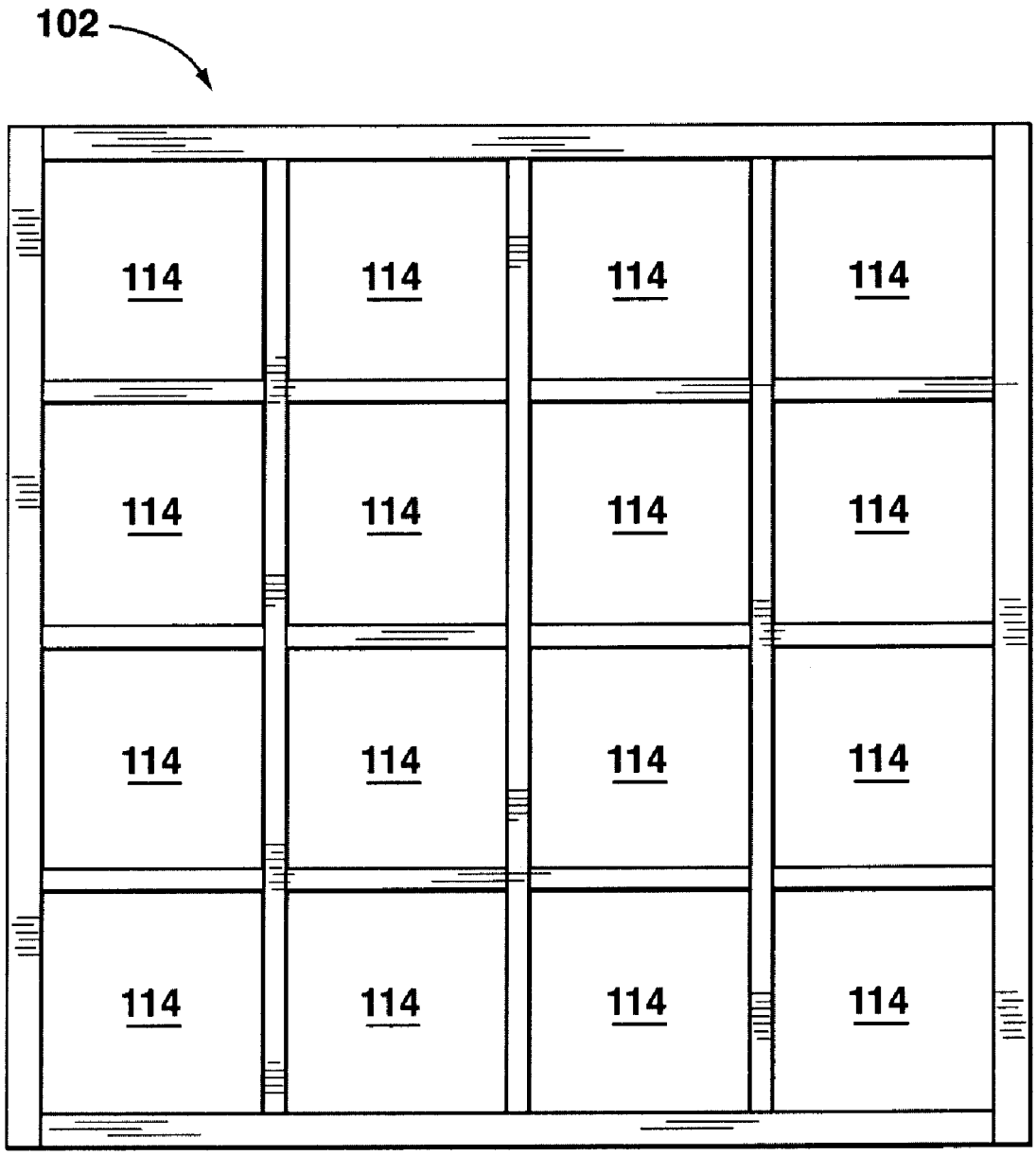

FIG. 2B shows a panel 102 that can receive three different design inserts (not shown) in insert-receiving spaces 114. FIG. 2C shows a panel 102 that can receive four different design inserts (not shown) in insert-receiving spaces 114, which have a one-by-four configuration. FIG. 2D shows a panel 102 that can receive four different design inserts (not shown) in insert receiving spaces 114. In this example, the panel can be described to be in a two-by-two configuration. FIG. 2E shows a panel 102 that can receive six different design inserts (not shown) in insert receiving spaces 114, which have a two-by-three configuration. FIG. 2F shows a panel 102 that can receive eight different design inserts (not shown) in insert receiving spaces 114, which have a two-by-four configuration. FIG. 2G shows a panel 102 that can receive nine different design inserts (not shown) in insert receiving spaces 114. In this example, the panel 102 is in a three-by-three configuration. FIG. 2H shows a panel 102 that can receive twelve different design inserts (not shown) in insert receiving spaces 114, which have a four-by-three configuration. FIG. 2I shows a panel 102 that can receive sixteen different design inserts (not shown) in insert receiving spaces 114. In this example, the panel is in a four-by-four configuration.

As described above, the structural members may be of different lengths. For example, the length of the stiles 110 are longer in FIG. 2B than in FIG. 2A. In addition, it will be appreciated by those of skill in the art, that the panel 102 may be of many different shapes and configurations. Further variations of the shape and configuration of panel 102 are discussed with reference to FIGS. 5A and 5B.

Referring to FIGS. 3A to 4D, different kinds of design inserts 106 included in assembly 100 are shown. Each different kind of design insert 106 has a distinct appearance due to a distinct configuration of its design members. The design members can include an external frame 116 that surrounds an internal design area 118. In most kinds of design inserts 106, the internal design area 118 will also include additional design members.

Figure 3A:
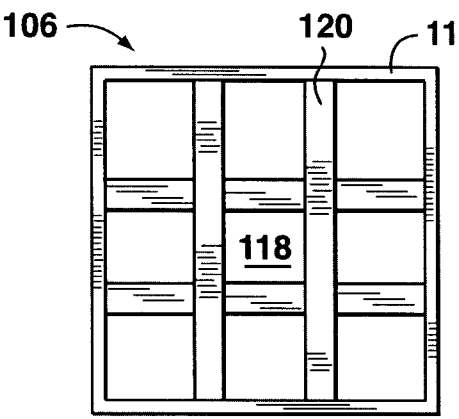
FIGS. 3A, 3B, 3C, 3D, 3E and 3F are front views of lattice-type design inserts with external frames.
Figure 3B:
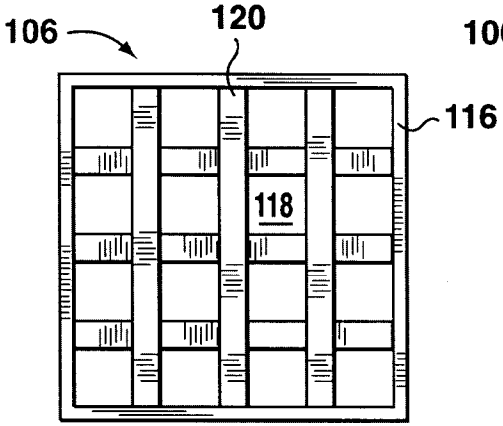
Figure 3C:
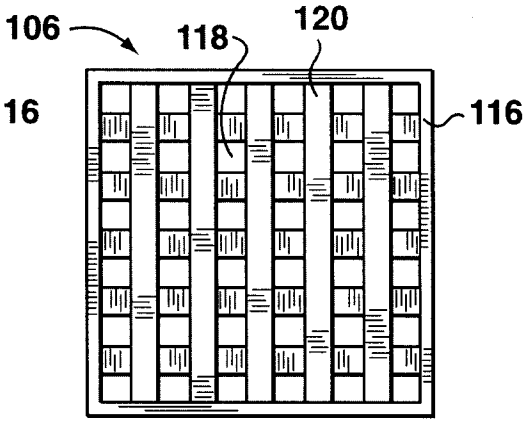
Figure 3D:
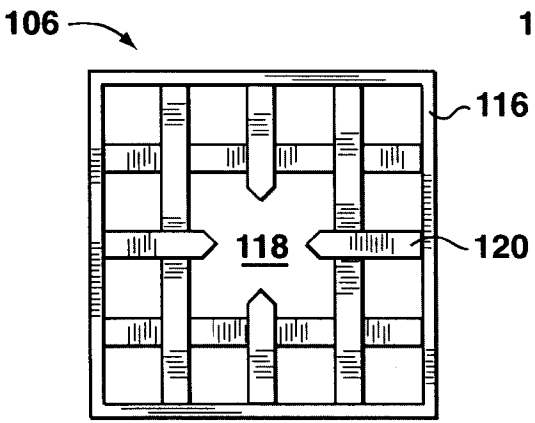
Figure 3E:
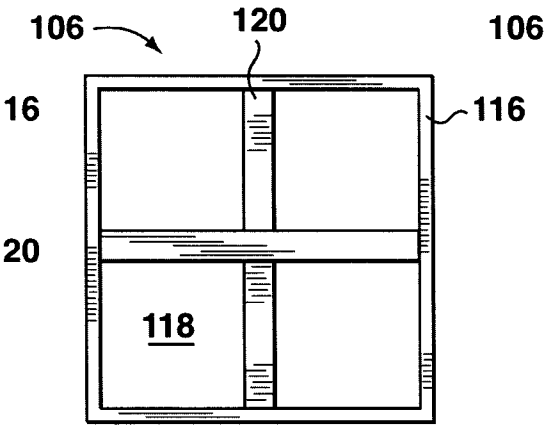
Figure 3F:
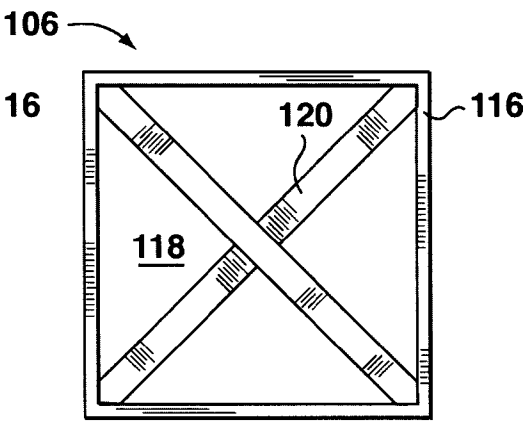

Referring specifically to FIGS. 3A to 3F, six different kinds of design inserts 106 are shown. All of these design inserts 106 include variants of a lattice-type internal member 120 that extends into the internal design area 118 from the external frame 116. In FIGS. 3E and 3F different variants of the lattice-type internal member 120 divide the internal design area 118 into at least four openings. In the design inserts 106 of FIGS. 3A to 3D the different variants of the lattice-type internal member 120 divide the internal design area into more than four openings.

Figure 3H:
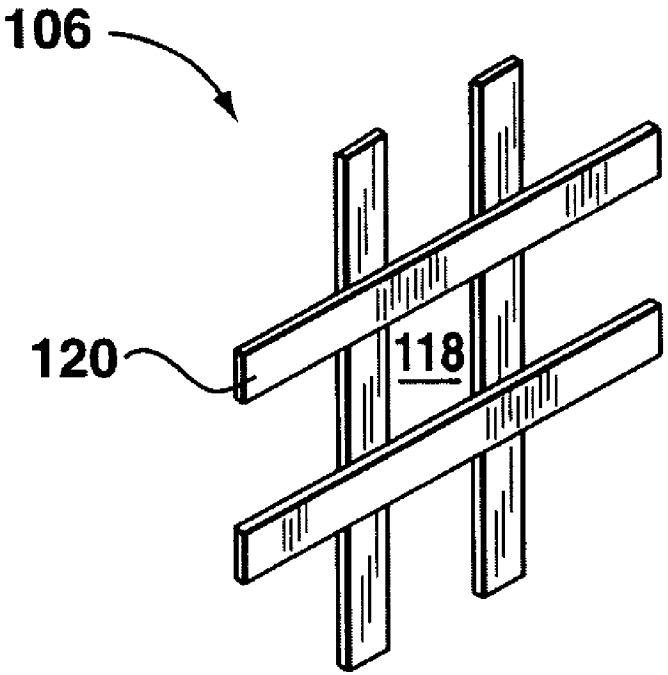
FIGS. 3G and 3H, in perspective views, illustrate representative design inserts with, and without an external frame respectively.
Figure 3G:
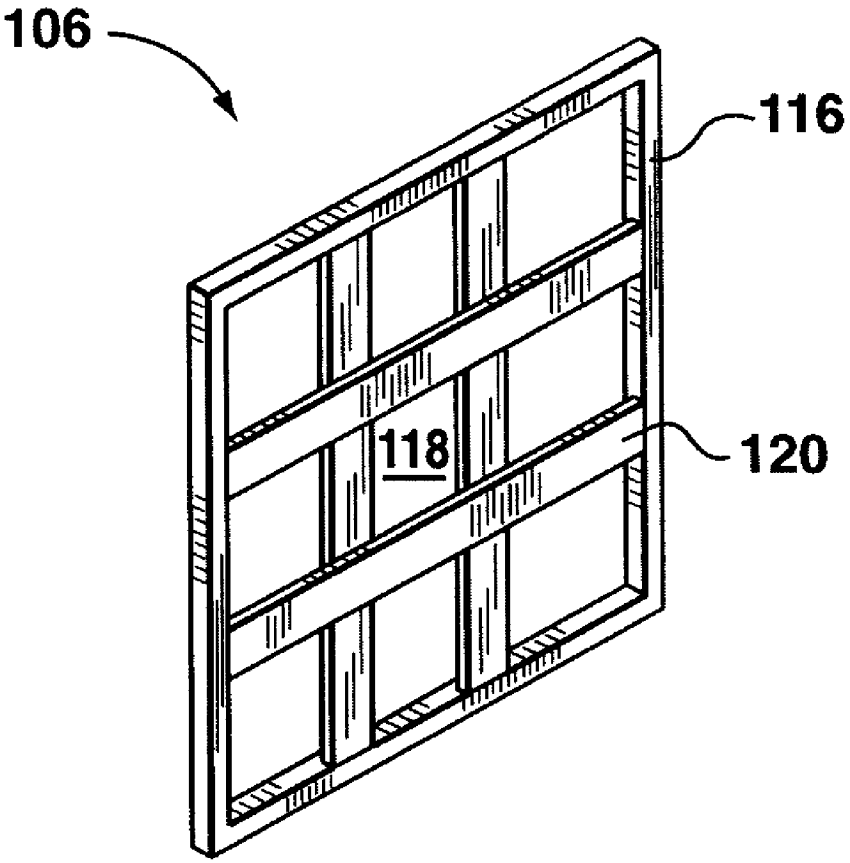
Figure 3K:
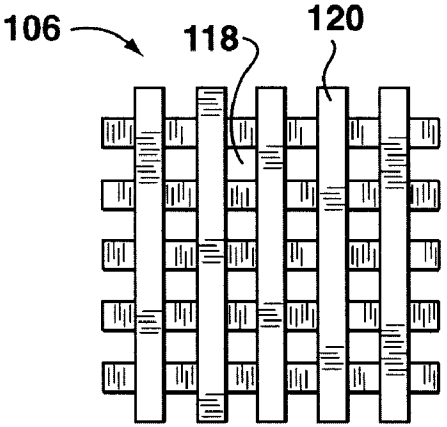
FIGS. 3I, 3J, 3K, 3L, 3M and 3N are front views of lattice-type design inserts without external frames.
Figure 3J:
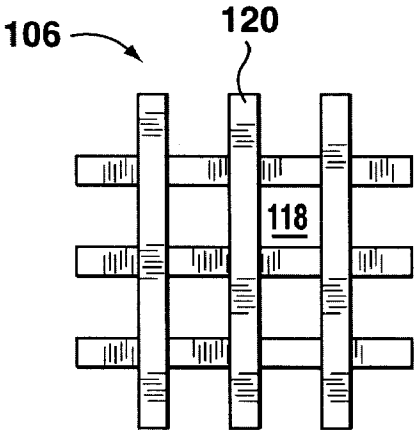
Figure 8:
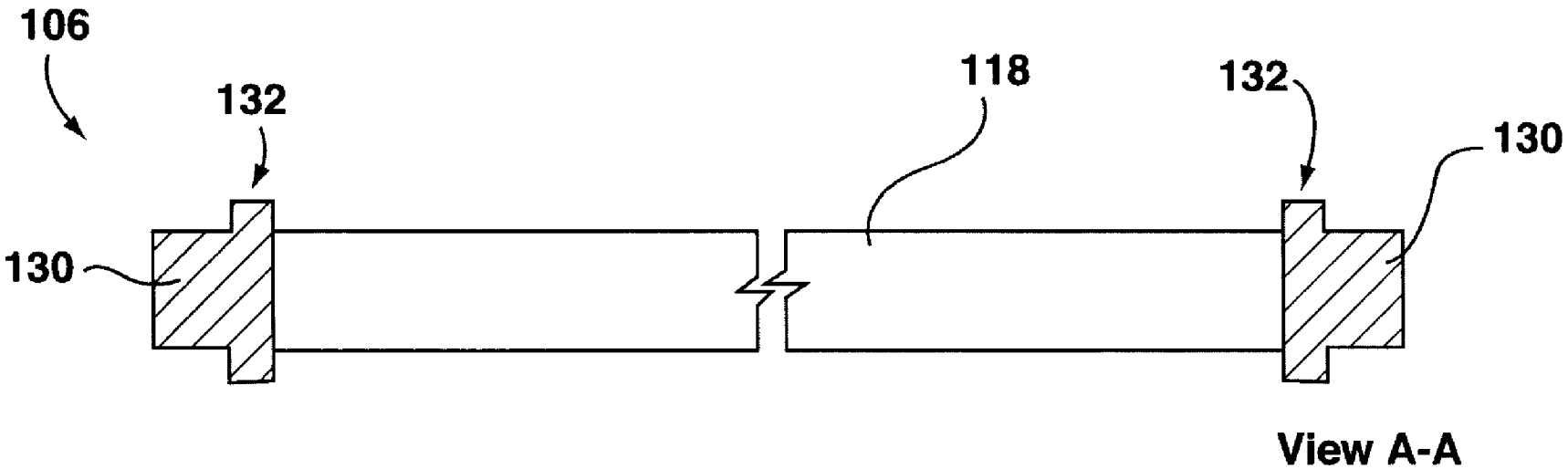
FIG. 8 is a cross-sectional view of the design insert of FIG. 7 at line A-A of FIG. 7.
Figure 9:
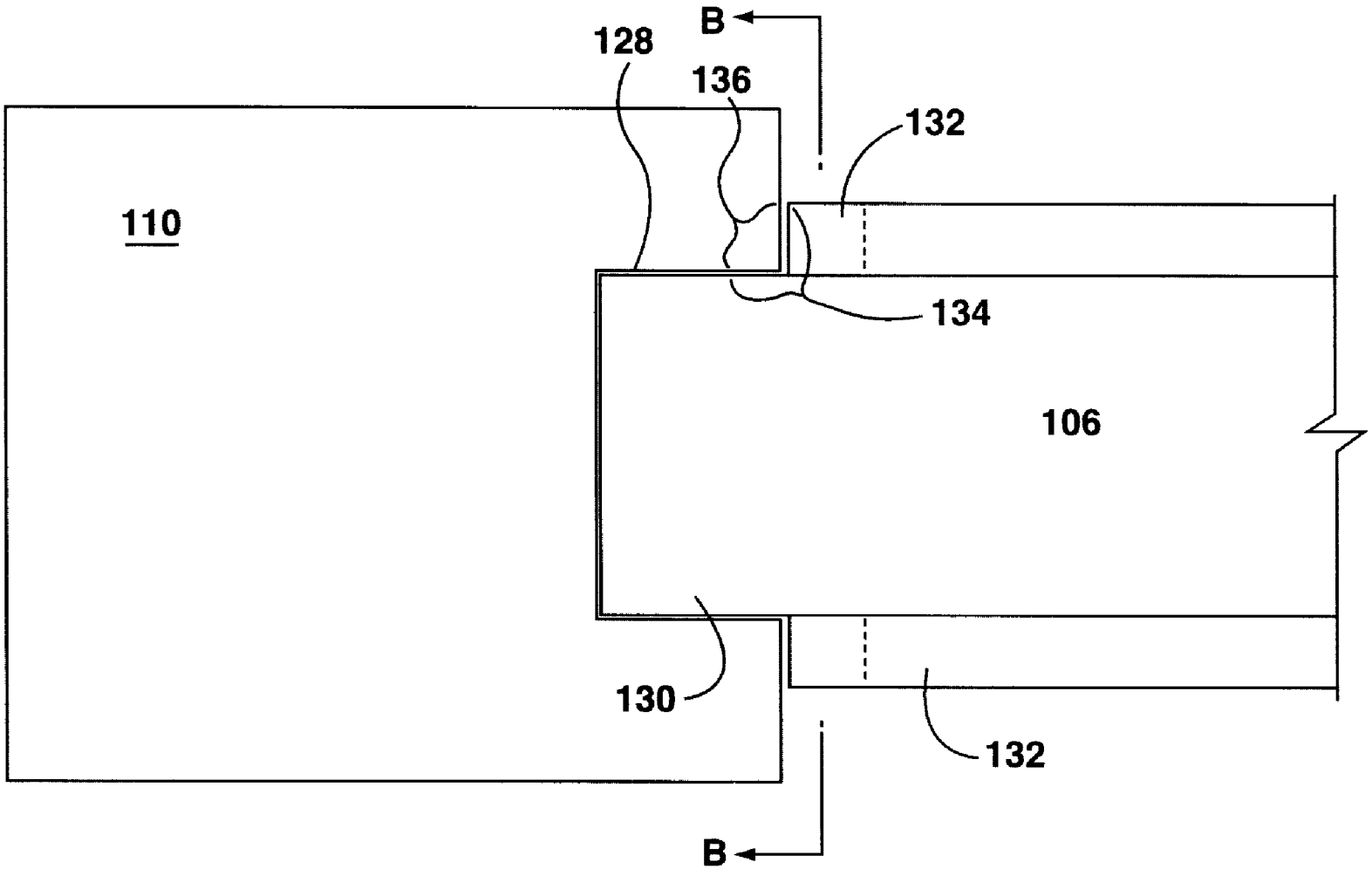
FIG. 9 is a top view of a stile mating with the design insert of FIG. 7.

FIG. 3G shows the design insert 106 of FIG. 3A in a perspective view. As described above, the design insert 106 consists of external frame 116, internal design area 118, and lattice-type internal members 120. In this configuration, the internal couplings (as shown in FIGS. 8 and 9) are part of the external frame 116. In contrast, FIG. 3H shows a perspective view of an alternate embodiment of the design insert 106. In this embodiment the design insert 106 only consists of internal design area 118 and lattice-type internal members 120. The lattice-type internal members 120 are attached to each other with an appropriate fastening means (not shown) such that they can retain their relative position, orientation, and structural integrity without the need for an external frame 116. In this configuration, the internal couplings (as shown in FIGS. 8 and 9) are provided by the ends of the lattice-type internal members 120, such that a design insert 106 without external frame 116 can be compatible with the common structural couplings of the structural members (shown in FIG. 1).

Figure 3I:
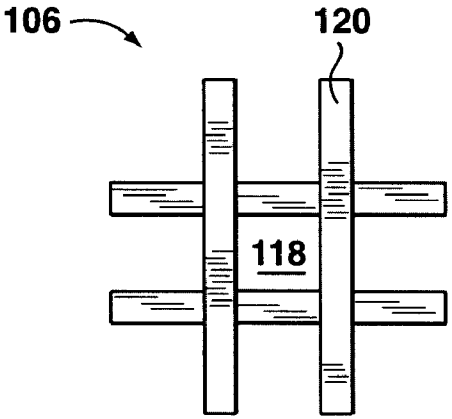
Figure 3N:
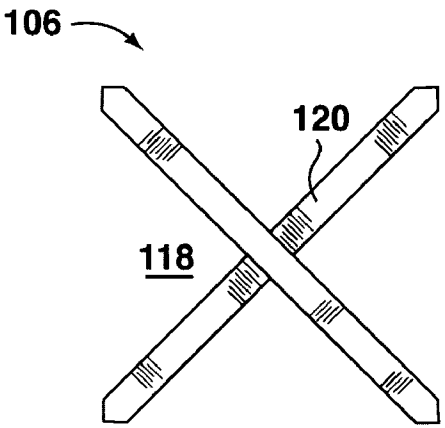
Figure 3M:
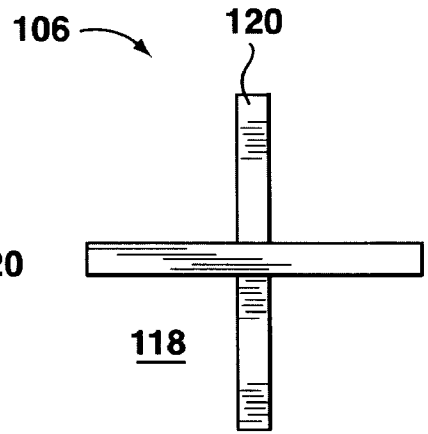
Figure 3L:
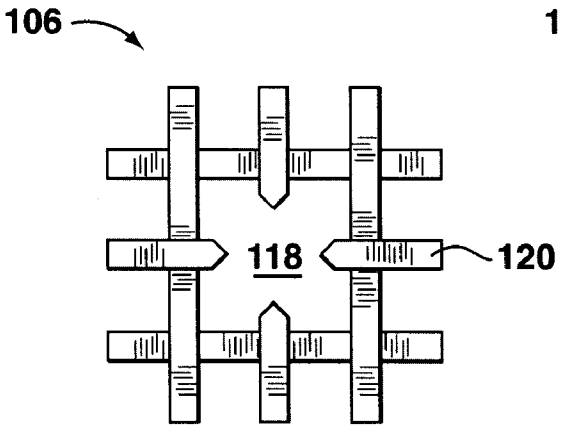

Referring specifically to FIGS. 3I to 3N, six different kinds of frameless design inserts 106 are shown. All of these design inserts 106 include variants of lattice-type internal member 120 that extends into the internal design area 118 without the support of external frame 116. In FIGS. 3I and 3N different variants of the lattice-type internal member 120 divide the internal design area 118 into at least four openings.

Figure 4A:
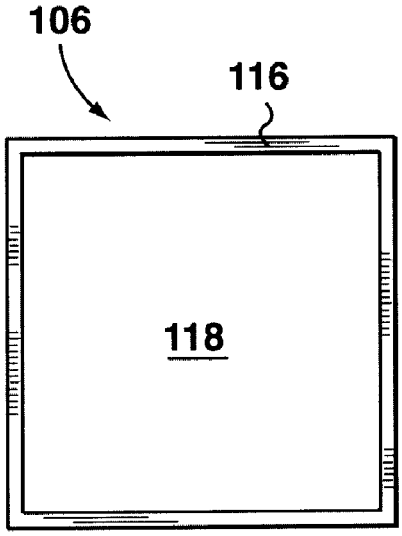
FIGS. 4A, 4B, 4C, and 4D are front views of design inserts of the open, arch, crossbeam, and full panel type.
Figure 4B:
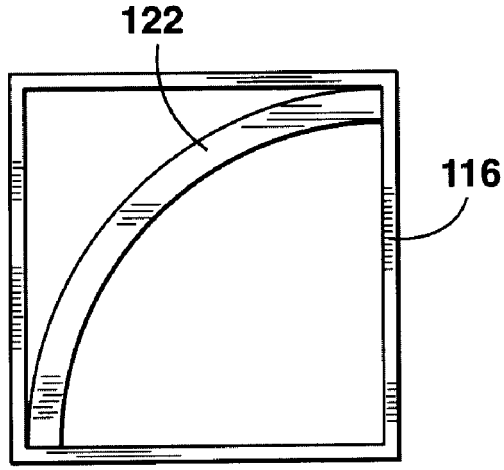
Figure 4C:
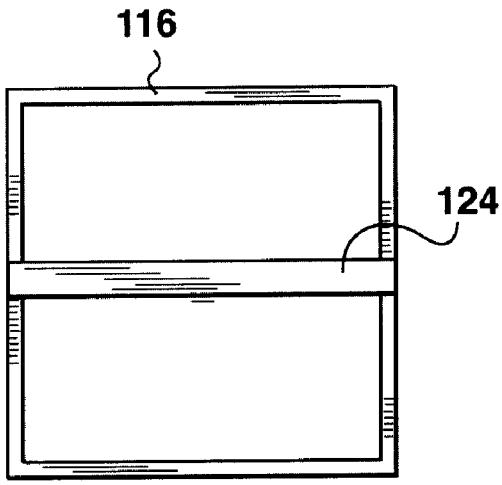
Figure 4D:
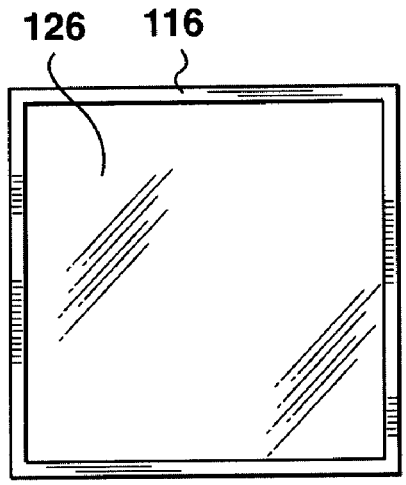

FIG. 4A shows a design insert 106 that consists only of an external frame 116, without an internal member, leaving the entire internal design area 118 open. FIG. 4B shows a design insert 106 in which the internal member is a curved member 122 for dividing the internal design area 118 into two openings of unequal area. FIG. 4C shows a design insert 106 in which the internal member is a straight member 124 for dividing the internal design area 118 into two openings. FIG. 4D shows a design insert 106 in which the internal member is an extended member 126 that completely covers the internal design area 118. Of course, it will be appreciated by those of skill in the art, that the design inserts 106 may have many different configurations in addition to those described above.

Figure 5A:
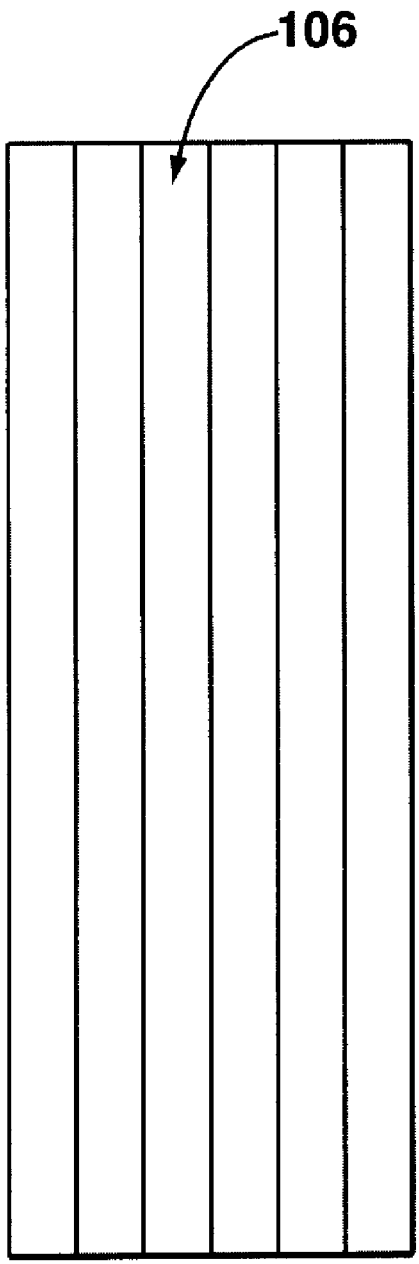
FIGS. 5A and 5B are front views of design inserts of differing dimensions.
Figure 5B:
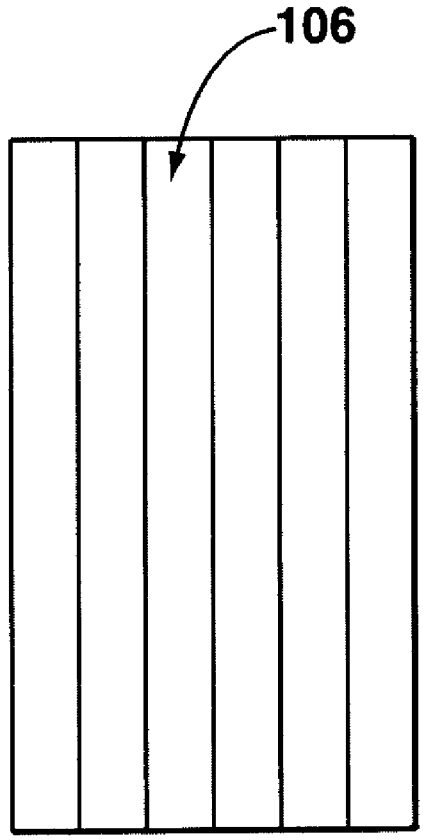

The design inserts 106 may also be of different sizes. FIGS. 5A and 5B illustrate two examples of design inserts 106 of the type shown in FIG. 4D, that have different sizes. The dimensions of the two design inserts shown in FIGS. 5A and 5B also differ from the dimensions of the design inserts of FIGS. 3A to 4D, which are approximately one-third the size of the design insert of FIG. 5A and approximately one half the size of the design insert of FIG. 5B. As described above, the structural members are of different dimensions and can thus be assembled to form insert-receiving spaces 114 that are capable of accommodating design inserts of many different sizes.

Figure 6:
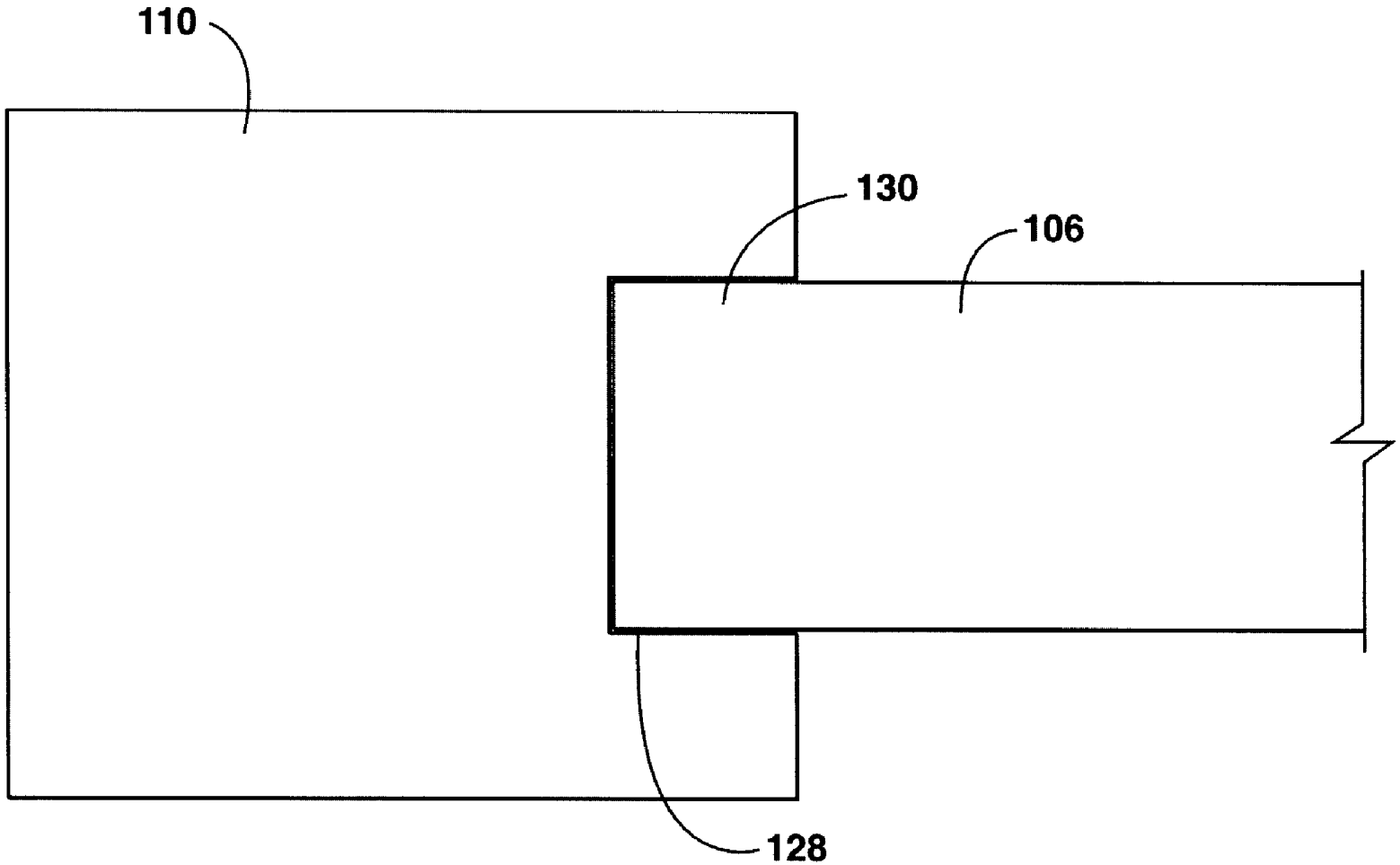
FIG. 6 is a top view of a stile mating with a design insert in accordance with an aspect of an embodiment of the invention.

Reference is now made to FIG. 6, which illustrates the top view of a structural member mating with a design insert 106 in accordance with an embodiment of the invention. The structural member shown is the stile 110. However, the configuration of the structural coupler is the same for all structural members of the panel assembly 100. In other words, the structural coupler of the stile 110 shown in FIG. 6 is representative of all structural members of this embodiment. Further, the insert coupler, and the manner in which it mates with the structural coupler, as shown in FIG. 6, is representative of all design inserts 106 of this embodiment. In the embodiment shown, each structural coupler comprises a groove 128 and each insert coupler comprises an edge 130 of the external frame 116. The dimension of groove 128 is selected to engage with the edge 130. The selected dimension of the groove 128 and edge 130 can be any suitable dimension. As described below in connection with FIG. 8, the external frame 116, of framed design inserts 106 may also include a lip 132. However, in the embodiment of FIG. 6, the design insert 106 does not include a lip.

In general, the structural couplers of all of the structural members are capable of mating, and are dimensioned to engage, with any of the insert couplers of the design inserts 106. It should be noted that many different coupling mechanisms can be used as long as they can be universally applied to all structural and insert members as described above. In some embodiments, the structural and insert couplers are symmetrically located on the structural members and design inserts, respectively. This allows certain structural members and insert members to be used in more than one manner, making them more versatile and easier to assemble, which is especially helpful to reduce inventory costs. For example, the same stile and the same rail could be used on either side of the panel 102. Furthermore, in other embodiments, the groove can be provided on the design inserts, while the edge is provided on the structural members.

Figure 7:
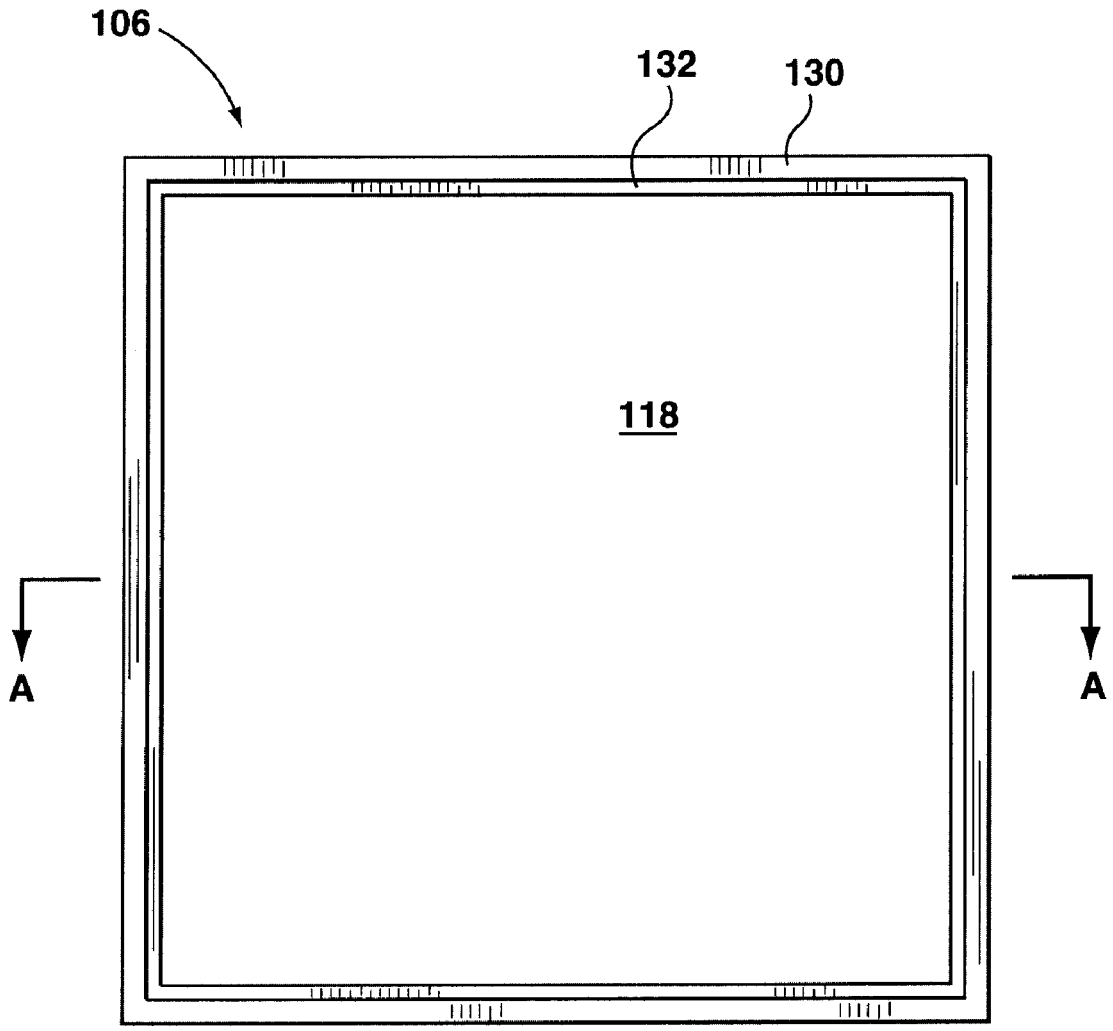
FIG. 7 is a front view of a design insert with a lip of a modular panel assembly in accordance with an aspect of an embodiment of the present invention.

Reference is now made to FIG. 7, which illustrates a front view of an embodiment of a design insert 106 (internal design area 118 is not shown). In this embodiment, the design insert 106 comprises lip 132 on each side of the edge 130 of the external frame 116. FIG. 8 further illustrates the design insert 106 of FIG. 7 along a cross-sectional view at line A-A of FIG. 7. According to one method of manufacturing this embodiment of the invention, the design insert 106 is initially provided with an unformed edge. That is, the edge does not include a lip. Then, the finished edge is formed from the unformed edge by cutting away a portion of the unformed edge to provide the lip such that the formed edge is dimensioned to engage with the groove 128. In some cases, portions of the lattice-type internal members 120 may also be cut away such that the edges are flush with the lip. For example, in the case of the lattice member shown in FIG. 3F, the width of these X members will, in one embodiment, be the same as the width of the structural members. As shown in FIG. 3F, each end of the X member fits into a corner of the design insert 106. According to one method of assembly, the X members are fit into the design insert 106 before the edge is formed. Thus, when the edge is being formed on the design insert 106, portions of the ends of the X members will also be cut away such that they align with the lip. Of course, other lattice-type internal members may have a width that is no greater than the width of the formed edge.

FIG. 9 illustrates a top view of stile 110 mating with a design insert 106 of FIGS. 7 and 8. The lip 132 and edge 130 of the design insert 106 define a non-planar sealing surface 134 for abutting a corresponding sealing surface 136 along the groove 128 of the stile 110. In general, the non-planar sealing surface 134 of the design insert 106 abuts the corresponding sealing surface 136 along the structural members to which the design insert 106 is attached. The lip 132 can serve to provide a more finished look by hiding the groove 128 and edge 130 from view. In addition, the lip 132 can help impede moisture from leaking between the groove 128 and edge 130.

Figure 10:
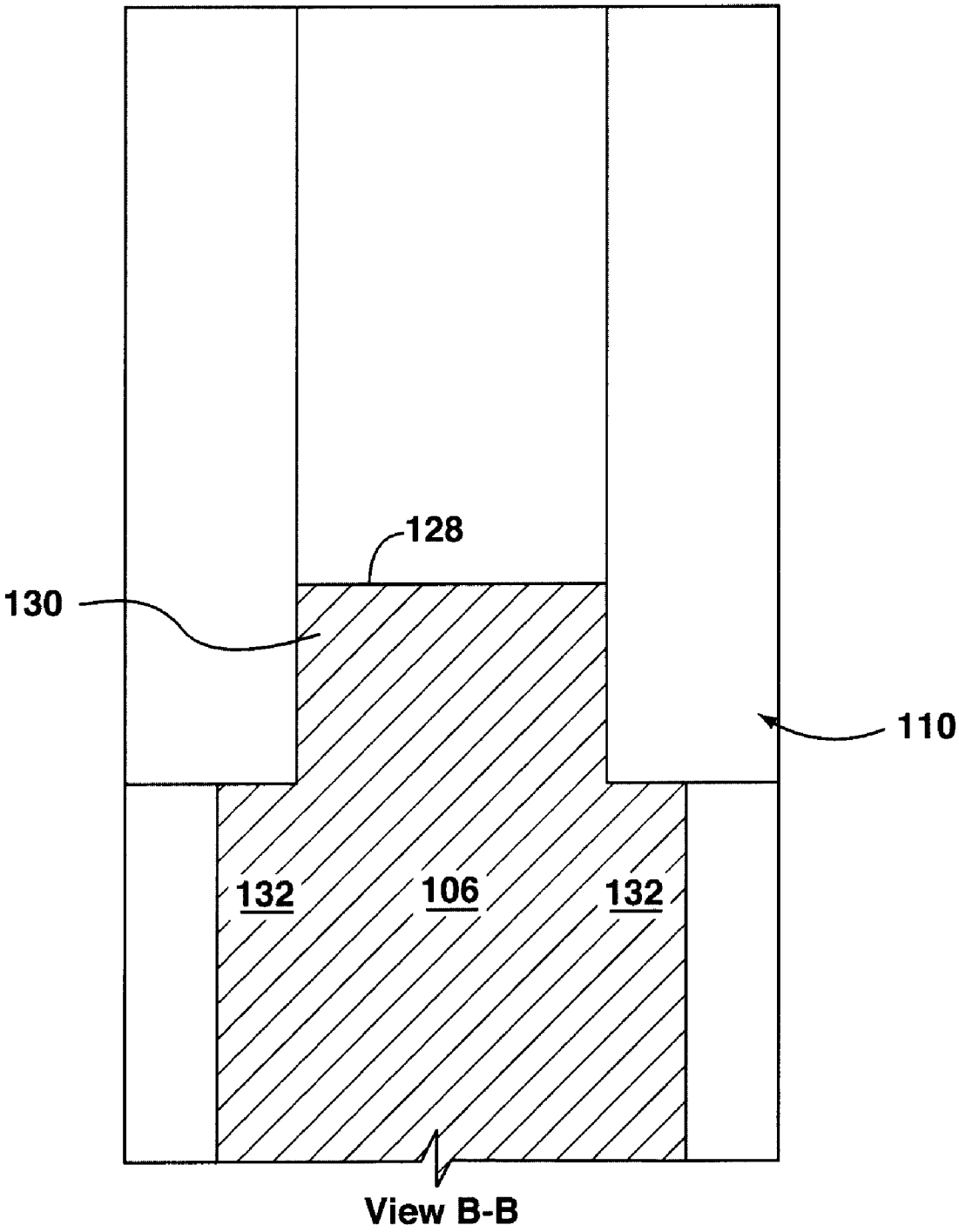
FIG. 10 is cross-sectional view at line B-B of FIG. 9.
Figure 11:
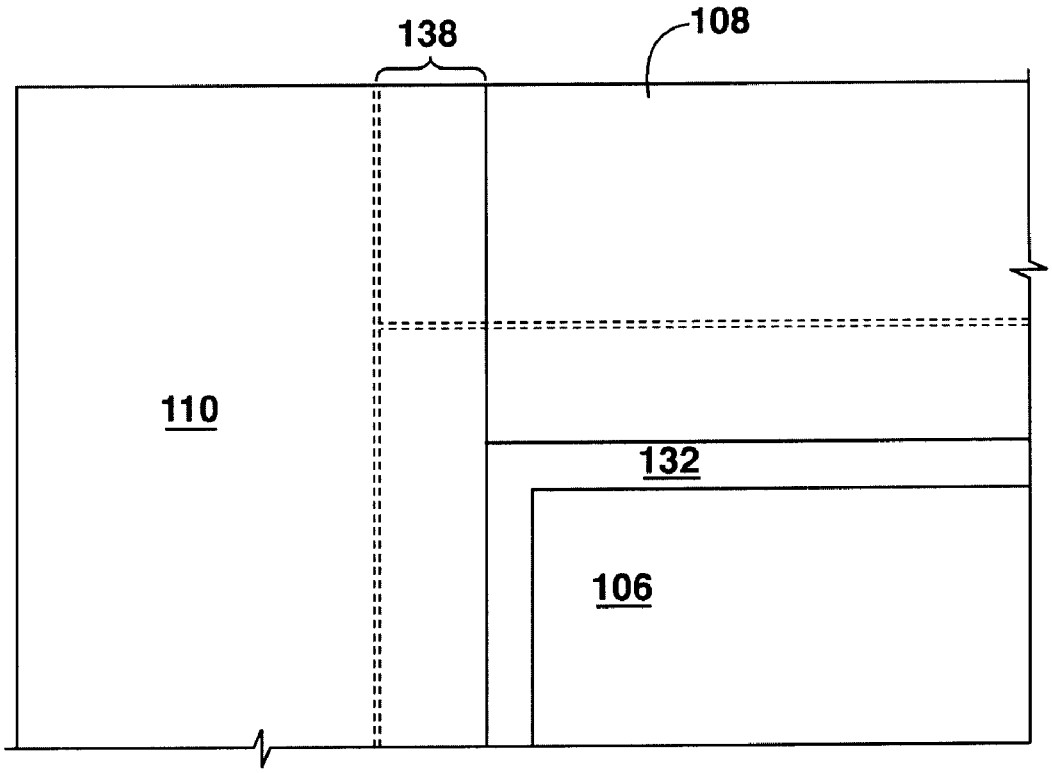
FIG. 11 is a front view of a corner of an assembled modular panel in accordance with an embodiment of the invention.
Figure 12:
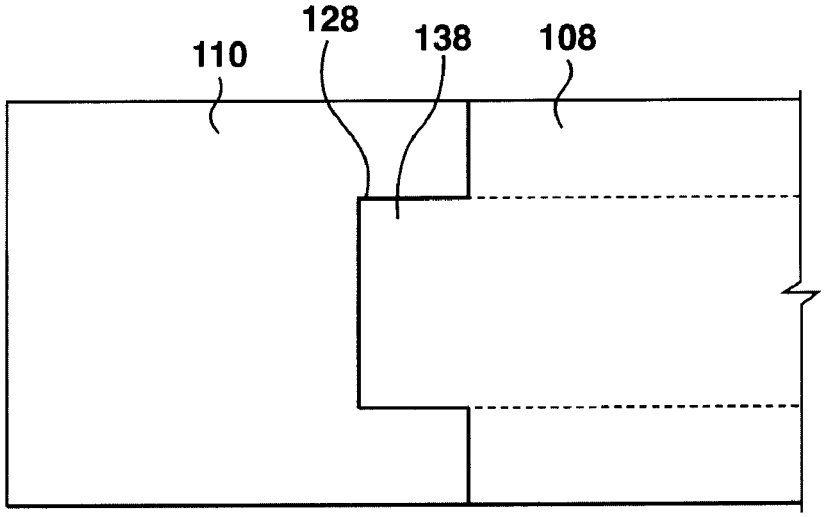
FIG. 12 is a top view of the corner of the assembled modular panel of FIG. 11.

Reference is now made to FIG. 10, which shows a side view of stile 110 mating with design insert 106 at line B-B of FIG. 9. The edge 130 of design insert 106 mates with the groove 128 of stile 110. Reference is also made to FIG. 11, which shows a front view of FIGS. 9 and 10, with the addition of rail 108. As shown, rail 108 mates with design insert 106 in the same manner that stile 110 mates with design insert 106. In addition, rail 108 mates with stile 110. More specifically, rail 108 comprises an end protrusion 138 on both ends of the rail and each protrusion mates with the end parts of the groove 128 of each stile 110. FIG. 12 shows a top view of the connection of end protrusion 138 of the rail 108 and groove 128 of stile 110. It should be noted that the opposite rail 108 connects to the stiles 110 in the same manner as the above-described rail 108.

Generally, the structural members consist of both external and internal members. However, it is possible that the structural members of an actual panel 102 may consist only of external members. The external members, which comprise rails 108 and stiles 110, are assembled to provide a structural frame having an internal perimeter. In some embodiments, the structural couplers of the external members are grooves 128. Therefore, when the structural members are assembled to make an insert receiving space 114, a groove 128 runs along the internal perimeter of the structural frame.

Figure 13A:
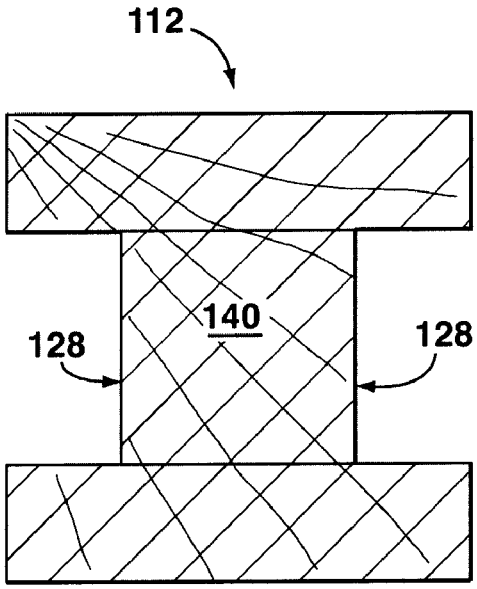
FIGS. 13A and 13B show a top view and side view of a mullion of a modular panel assembly in accordance with an aspect of an embodiment of the present invention.
Figure 13B:
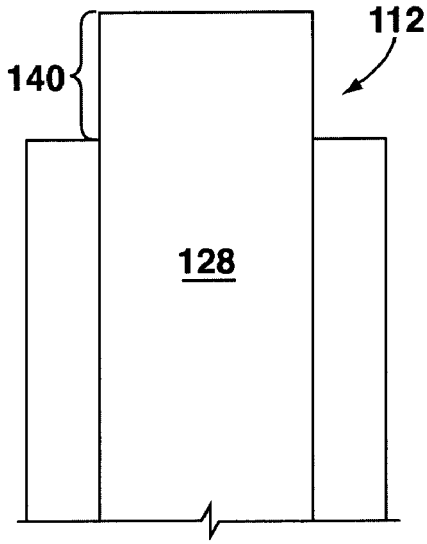

In some embodiments, mullion 112 is an internal member for extending across the internal perimeter of the external frame. FIGS. 13A and 13B illustrate a top and side view, respectively, of a mullion 112. At each end of the mullion 112, there is an end protrusion 140 dimensioned to mate with the groove 128 along the internal perimeter of structural frame. As a structural member, mullion 112 also comprises two structural couplers that mate with the insert couplers of at least two design inserts 106 (not shown), one on each side. This structural coupler consists of two grooves 128 that are of a selected dimension that allows them to mate with edge 130 (See FIG. 6) of a design insert 106. Grooves 128 runs along each side of the mullion 112.

Figure 14A:
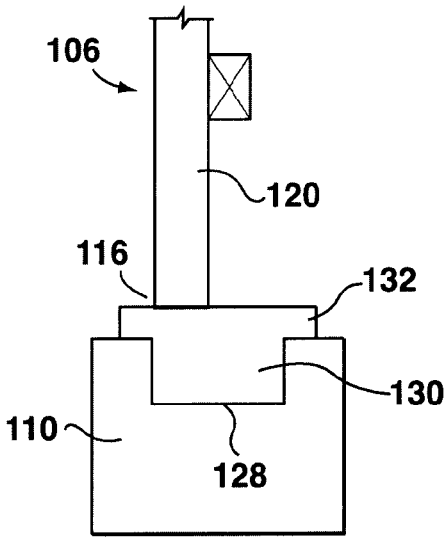
FIGS. 14A and 14B show top views of a connection between a structural member and a design insert.
Figure 14B:
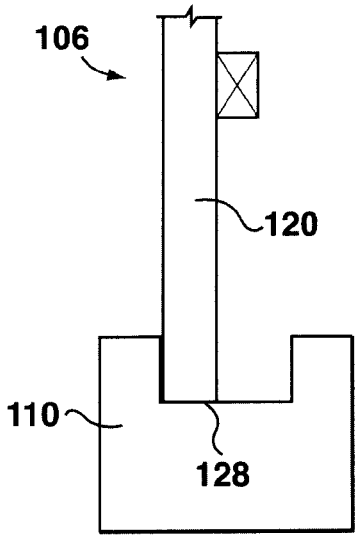

Reference is now made to FIG. 14A, which illustrates a top view of a stile 110 mating with a design insert of FIGS. 7 and 8. A design insert 106 that includes a frame, as shown in FIGS. 3A-3G, can be mated with the internal groove 128 of an insert-receiving space using a lip 132 and edge 130 as described above. The lattice-type internal member 120 is appropriately fastened to the external frame 116 of the design insert 106. FIG. 14B illustrates a top view of the mating between a frameless design insert 106 (as shown in FIGS. 3H-3N) and a structural frame (as shown in FIG. 2). In the absence of an external frame 116, mating between the design insert 106 and the structural frame may be accomplished by inserting the ends of the lattice-type internal members 120 into the groove 128 of the stile 110. The mating between a design insert 106 and a stile 110 has been described as a representative example, and it would be understood by anyone skilled in the art that a similar mating arrangement could exist between a design insert 106 and a rail 108 or mullion 112 (as shown in FIG. 1A).

Figure 15:
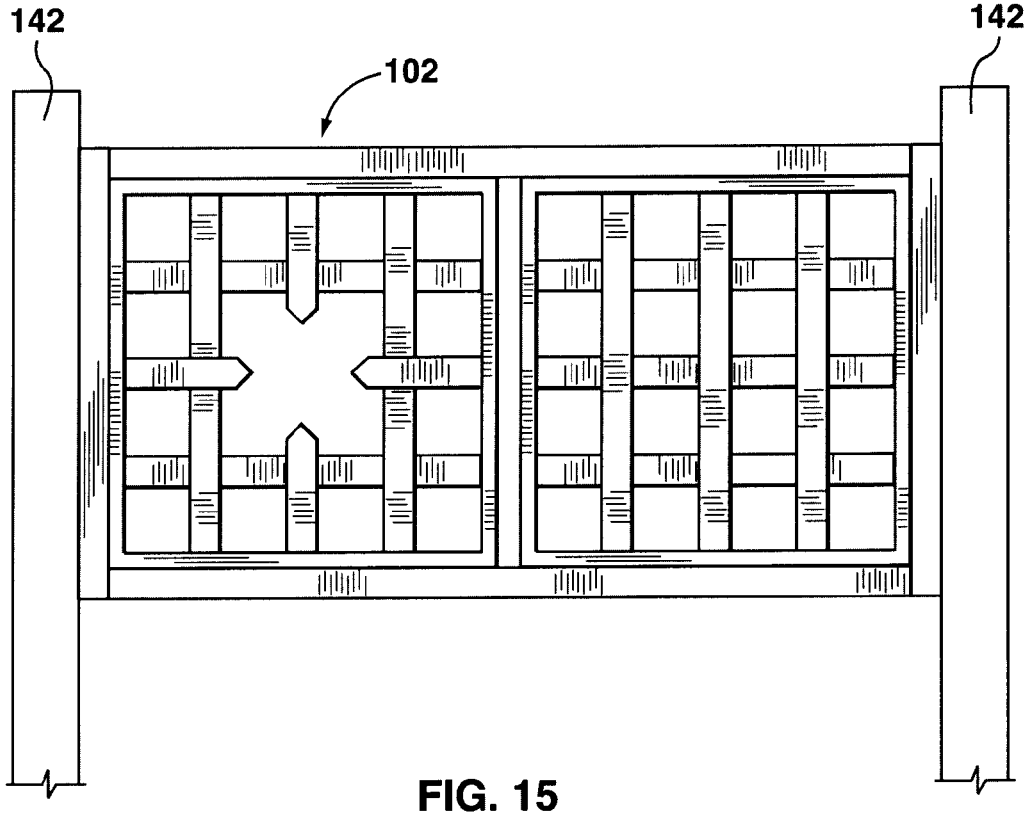
FIG. 15 is a front view of the panel in FIG. 1 as part of a garden architectural system.

Reference is now made to FIG. 15, which illustrates a panel 102 in one embodiment as part of a simple garden architectural system. The panel 102 may also be part of other architectural systems, such as a deck, patio or any other outdoor space. The panel 102, as shown, is attached to posts 142. Of course, it will be appreciated by those of skill in the art that the panel 102 may be part of more complex architectural systems and that other methods of support may be used. For example, panel 102 may be supported by building at one or both ends.

To assemble a panel in accordance with an embodiment of the invention, the desired appearance of the panel is first to be determined based on the option available given the modular panel assembly 100, and in particular the different design inserts 106 available in this modular panel assembly. Then, the particular structural members and design inserts required to construct such panel would be selected. The structural members and select design inserts 106 could then be assembled to provide the panel.

During assembly, additional means may be employed to strengthen the connections of the structural members with one another. For example, dowel could be used in both end protrusion 140 of any millions used to secure this end protrusion in the groove 128 with which it meets. That is, the dowel would fit into molding holes in both in protrusion 140 and groove 128. Similarly, dowel may be provided in end protrusion 138 of rail 108 that secures rail 108 in a groove 128 of stile 110. This dowel projecting from end protrusion 138, would then mate with a corresponding hole in the base of groove 128 of stile 110. Of course, other suitable securing means may be used, or, alternatively, the structural members may be simply glued together.

In the embodiments described above, the structural couplers of the structural members such as the rails 108 or stiles 110 are female couplers that provide groove 128 when the structural members are assembled, while the insert couplers of the design inserts 106 are male couplers. In the case of embodiments of the design inserts including an external frame 116, the male coupler can be the edge 130. In the case of embodiments of the design inserts lacking the external frame 116, the male couplers can be provided by the ends of the internal members of the design insert 106, such as, for example, the lattice-type internal members 120 of FIG. 3H. However, it will be appreciated by those of skill in the art that the couplers used may not be male/female type couplers. It would be further understood that if male/female couplers are used, the structural couplers could be male couplers, in which case the design insert couplers would be female couplers. This is the case in the embodiment described below.

Figure 16:
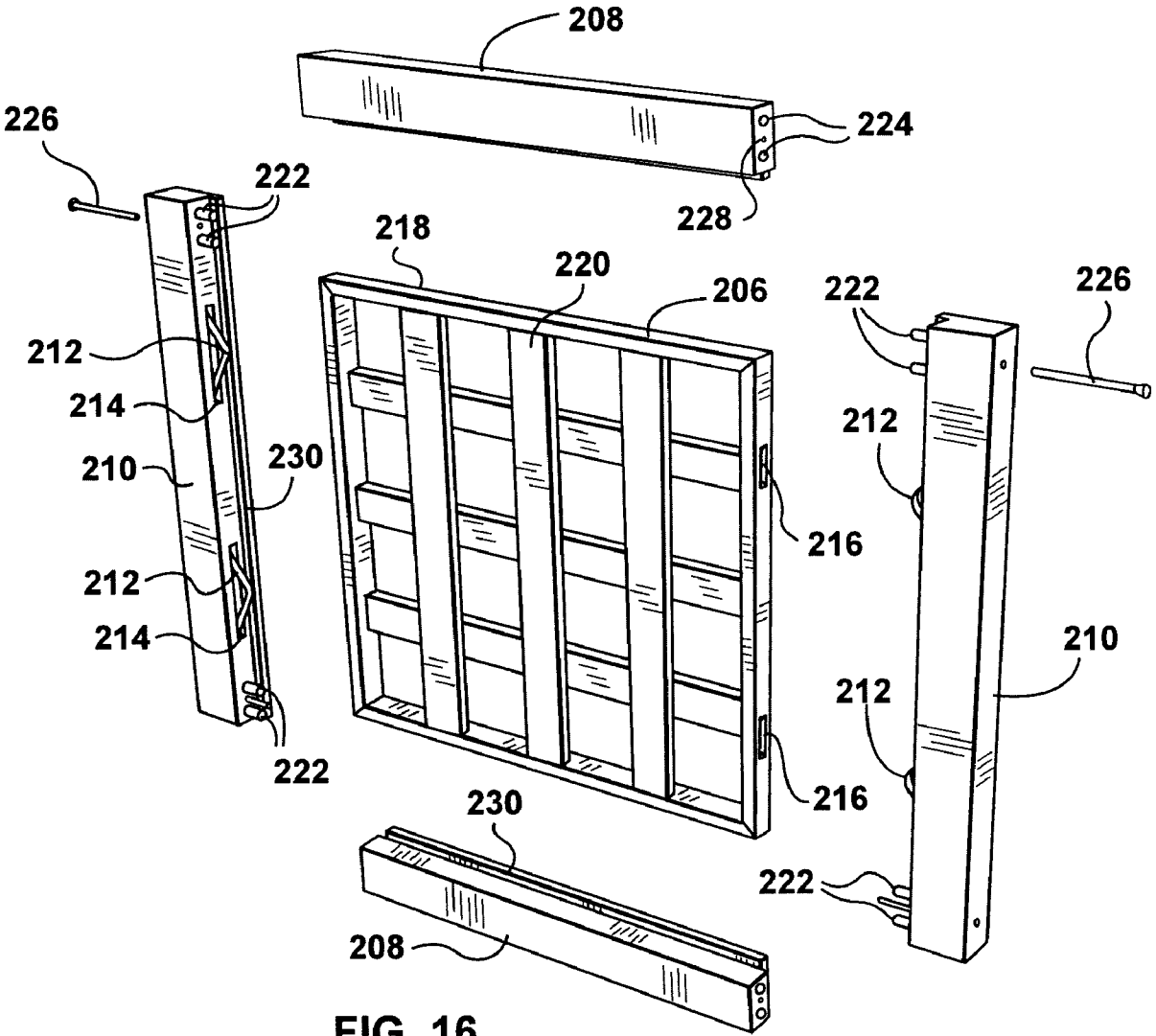
FIG. 16, in an exploded perspective view, illustrates a modular panel assembly in accordance with a further embodiment of the invention.

Referring to FIG. 16, there is illustrated in a perspective view, a panel assembly in accordance with a further embodiment of the present invention. The modular panel assembly 200 of FIG. 16 comprises two different types of components—the structural members on the one hand, and a design insert 206 on the other hand. In the embodiment shown, the structural members comprise rails 208 and stiles 210. These structural members can be assembled to provide an insert-receiving space for receiving the design insert 206. Variants of the embodiment shown in FIG. 16 may be provided using internal structural members such as millions to define multiple insert-receiving spaces. For example, the stile 210 on the right hand side of FIG. 16 could optionally be replaced with a mullion, and the rails 208 extended toward the right side of this Figure, while a further mullion or stile could be provided further to the right to define a second insert-receiving space to the right of the first insert-receiving space, Then a pair of design inserts 206 could be inserted into these insert-receiving spaces.

As shown in FIG. 16, the male couplers of the structural members are resilient members 212 mounted in slots 214. The resilient members comprise crests that, in the absence of a compressive force compressing the resilient members 12 into slots 214, project beyond slots 214. In the embodiment shown, the resilient members 212 and slots 214 are provided only in the stiles 210 and not in the rails 208. However, optionally, these structural couplers might be provided in the rails 208 and not in the stiles 210, or, alternatively, might be provided in both the rails 208 and the stiles 210. However, as will be described in more detail below, coupling only two of the four sides of the design insert 206 to the surrounding structural members is desirable as it facilitates removal of the design insert during disassembly, while the design insert 206 is held more securely if the two sides secured are opposite to one another.

Design insert 206 comprises grooves dimensioned to receive the crests of the resilient members 212 of the stiles 210. To assemble the assembly 200 shown in FIG. 16, the structural members can first be assembled. Referring to FIG. 17A, the modular panel assembly 200 of FIG. 16 is illustrated in a schematic view. As shown in both FIGS. 16 and 17A, stiles 210 comprise dowels 222 that can be inserted into tapered holes 224 in rail 208. As shown most clearly in FIG. 17A, tapered holes 224 are tapered inwardly to grip dowels 222 more securely as dowels 222 are inserted further into holes 224. Once the stiles 210 and rails 208 have been assembled by mating the dowels 222 with the dowel-receiving holes 224, screws 226 can be threaded through stiles 210 and into screw-receiving hole 228 in rail 208 to secure the structural members together.

As best shown in FIG. 16, the structural members comprise a raised ridge 230, which will border the design insert 206 on one side only after assembly, such that the other side of the insert-receiving space is open for insertion or removal of the design insert 206. This facilitates insertion of the design insert 206 into the insert-receiving space defined by the structural members, as well as disassembly by removing the design insert 206 from this insert-receiving space. Specifically, in one mode of assembly the design insert 206 can be inserted into the insert-receiving space from the left such that the resilient members 212 of the right hand stile 210 fits into grooves 216 on the right hand side of the external frame 218.

Then, the resilient members 212 of stile 210 on the left hand side of FIG. 16 can be pressed down into their respective slots to fit the left hand side of the design insert 206 into the insert-receiving space such that the slots 216 (shown in FIG. 17A) on the left hand side of the design insert 206 align with resilient members 212 of the stile 210 on the left side of FIG. 16. When the force pressing the resilient members 212 down is removed, the resilient members 212 extend into grooves 216 to secure the design insert 206 in place. While the resilient members 212 are compressible into slots 214, they are relatively rigid and resist bending to either side of insert-receiving space into which they project, such that the resilient members form a barrier to the sides of grooves 216 to stop the design insert from falling out of the open side of the insert-receiving space.

By this means, design insert 206 can be held resiliently between two opposing pairs of resilient members 212, thereby securing the design insert 206 from inadvertently falling out, while at the same time, as will be described in more detail below, enabling the design insert 206 to be removed.

To remove the design insert 206, a pair of thin, rigid elements (wedge elements) can be used to advantage (these wedge elements may also be used to press down the resilient members during assembly as described above). In one mode of operation, the two wedge elements can be inserted on the open side of the juncture between the design insert 206 and the adjoining stile 210. As described above, the open side is the side lacking the ridge 230. Each wedge would be typically inserted either above or below the resilient member 212. Then, the wedge would be moved over the resilient member 212 to compress the resilient member 212 to move it out of groove 216, such that the right hand side of the design insert 206 is now free to be moved out of the insert-receiving space via the open side of the structural members. Once this is done, and the right hand side of the design insert is moved past the stile via the open side, the design insert 206 can simply be pulled away from the stile 210 on the left hand side of FIG. 16 to disengage the resilient members 212 of this stile 210 from the grooves 216 (shown in FIG. 17A).

The design insert 206 found in FIG. 16 is merely one example of the design insert 206 that could be used. That is, this design insert could be replaced with other design inserts having an external frame 218 and different internal members extending between this external frame 218. Alternatively, design insert 206 might be replaced with another design insert that does not have an external frame 218 at all. In that case, grooves could be formed in the internal members themselves to engage the resilient members 212.

Figure 17B:
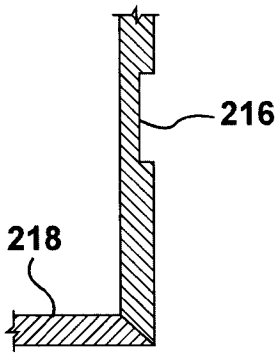
FIGS. 17B and 17C illustrate expanded views of portions of the modular panel assembly of FIG. 17A.

Referring to FIG. 17B, there is illustrated in an expanded view, a corner of the external frame 218 of the design insert 206. The portion shown also includes the groove 216 that receives the resilient member 212 (shown in FIG. 17A).

Figure 17C:
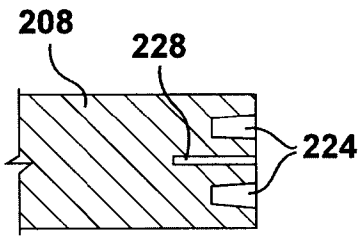
Figure 17A:
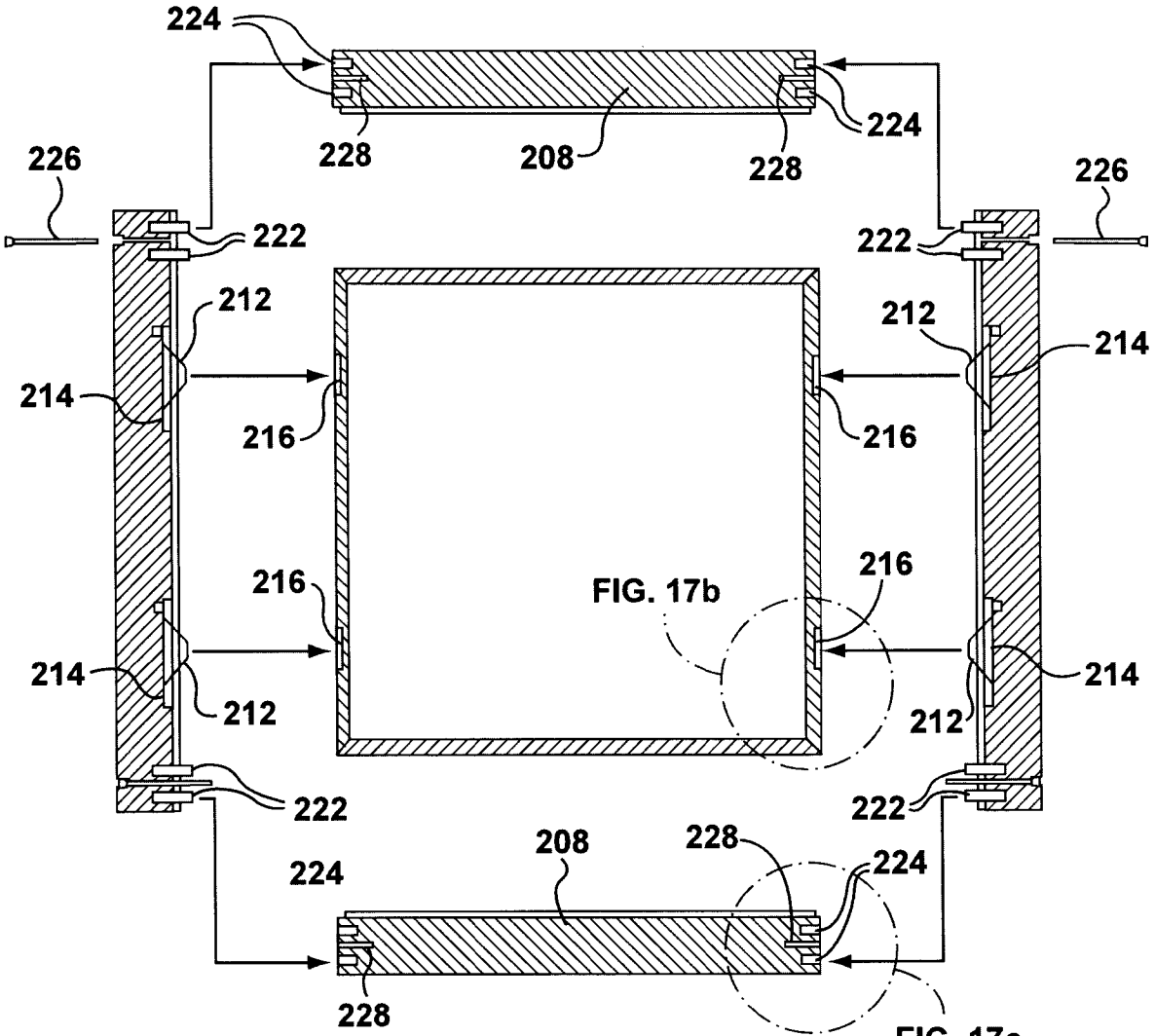
FIG. 17A, in a schematic view, illustrates the modular panel assembly of FIG. 16.
Figure 18A:
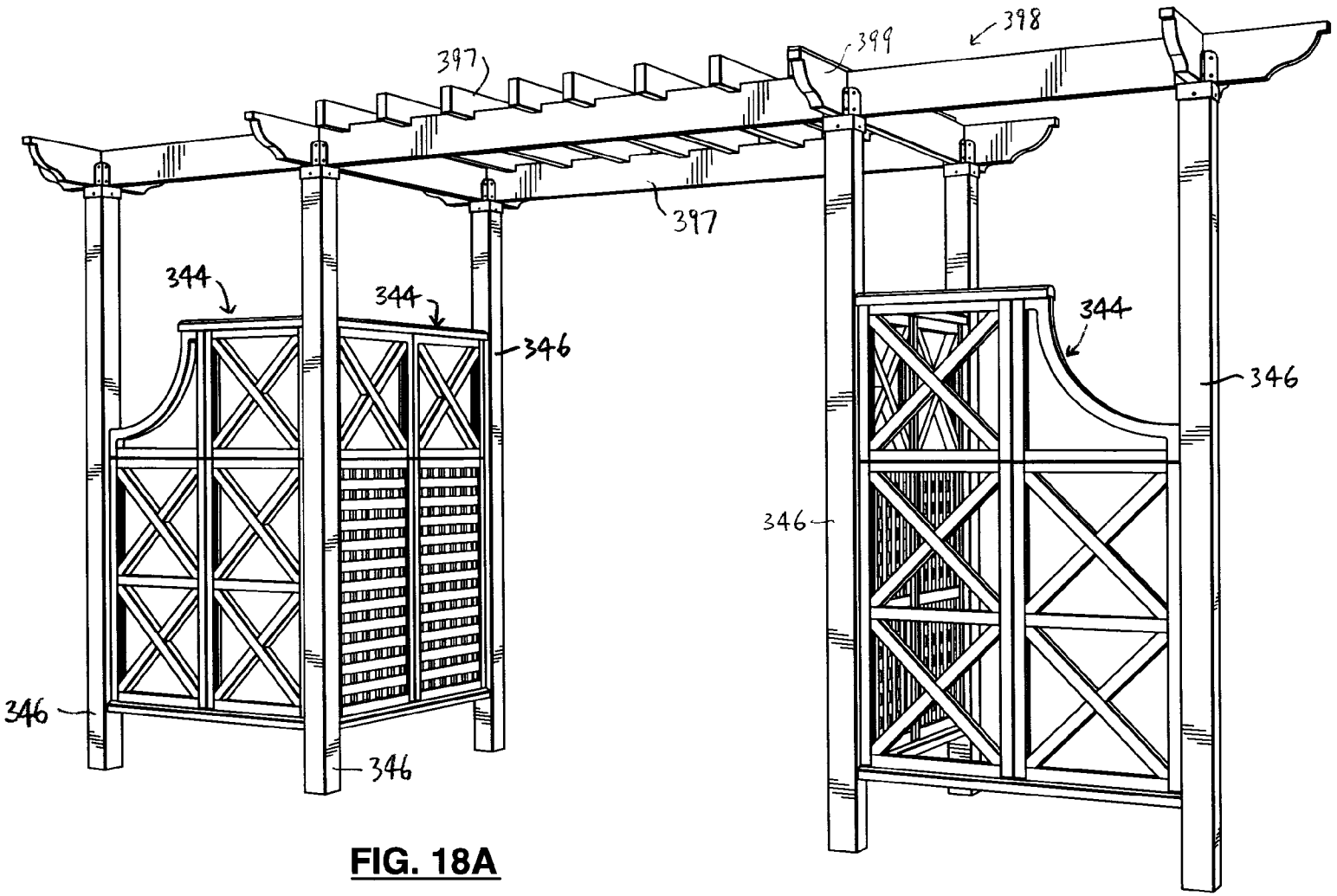
FIG. 18A is an isometric view of an embodiment of a partition system of the invention supported by a number of posts, drawn at a smaller scale.
Figure 18B:
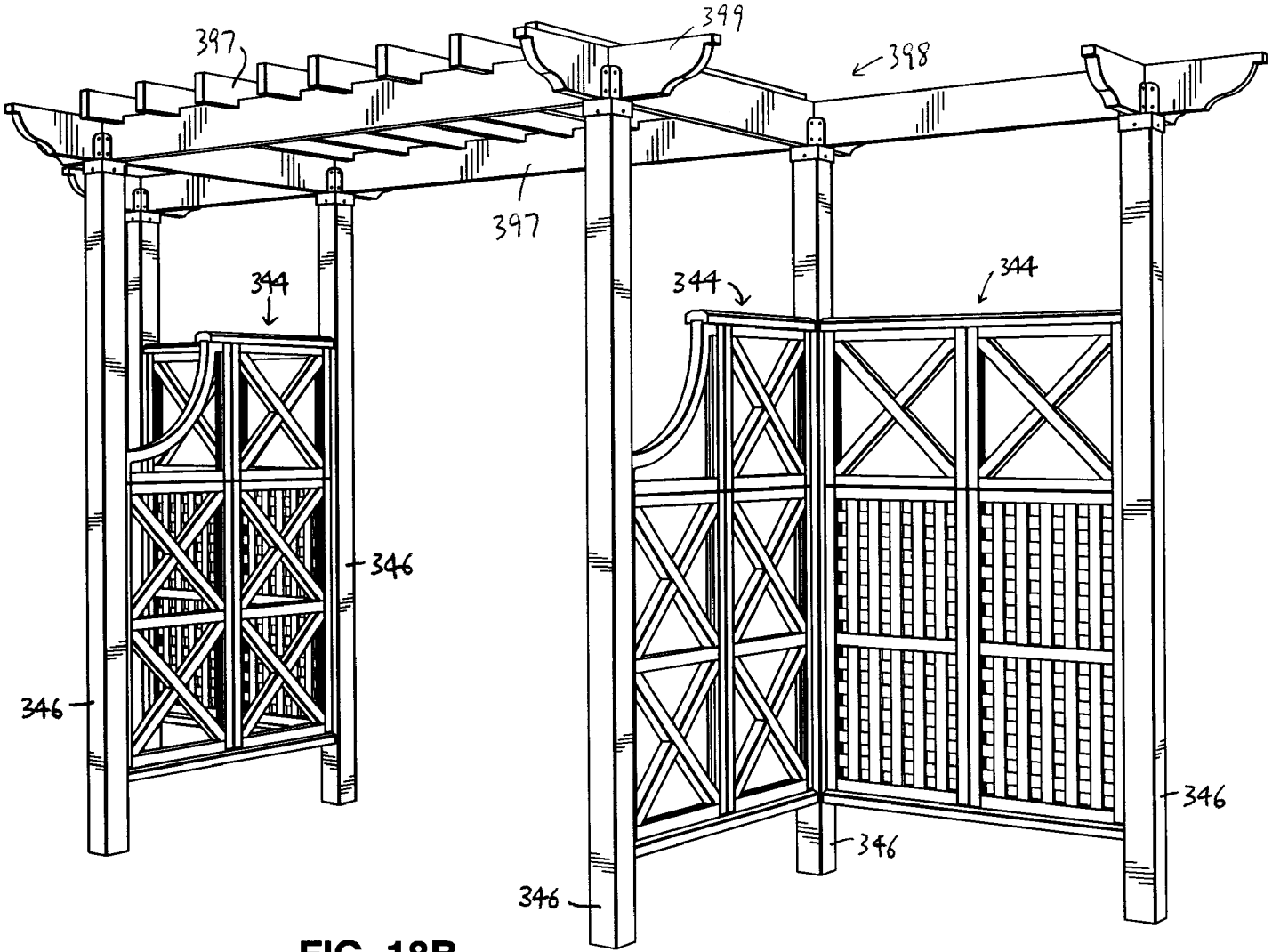
FIG. 18B is an isometric view of an alternative embodiment of the partition system of the invention.
Figure 18C:
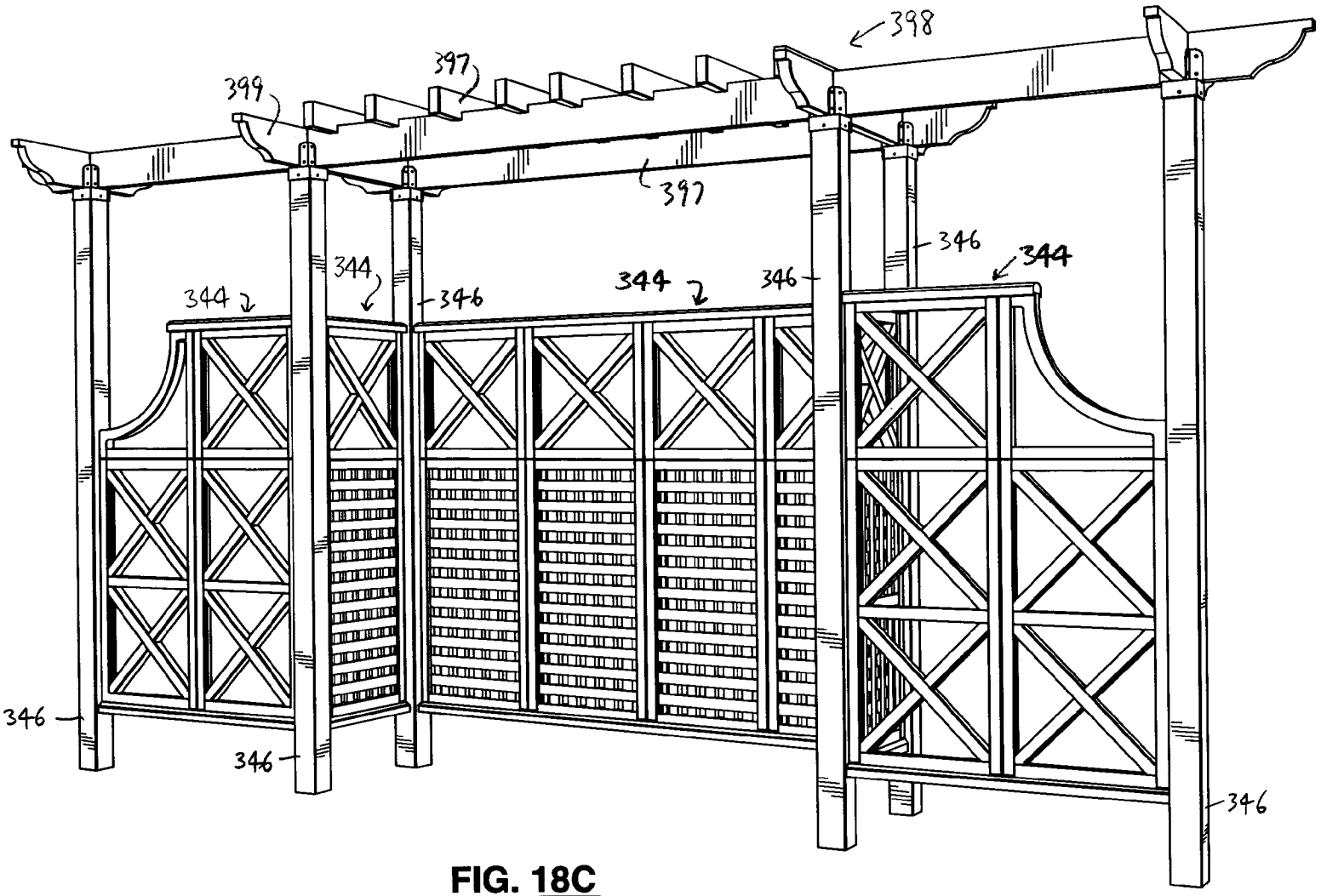
FIG. 18C is an isometric view of another embodiment of the partition system of the invention.
Figure 18D:
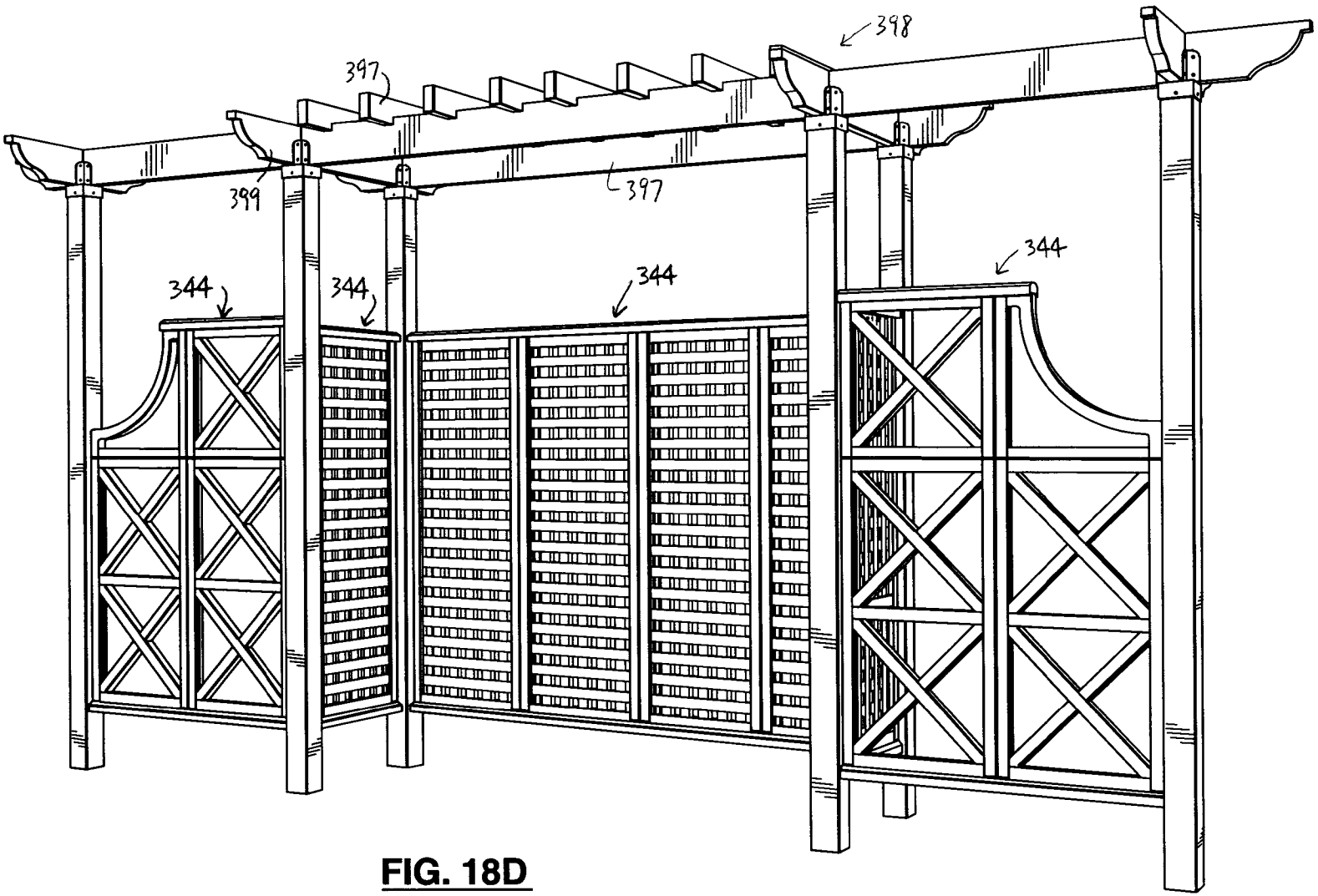
FIG. 18D is an isometric view of another embodiment of the partition system of the invention.
Figure 18E:
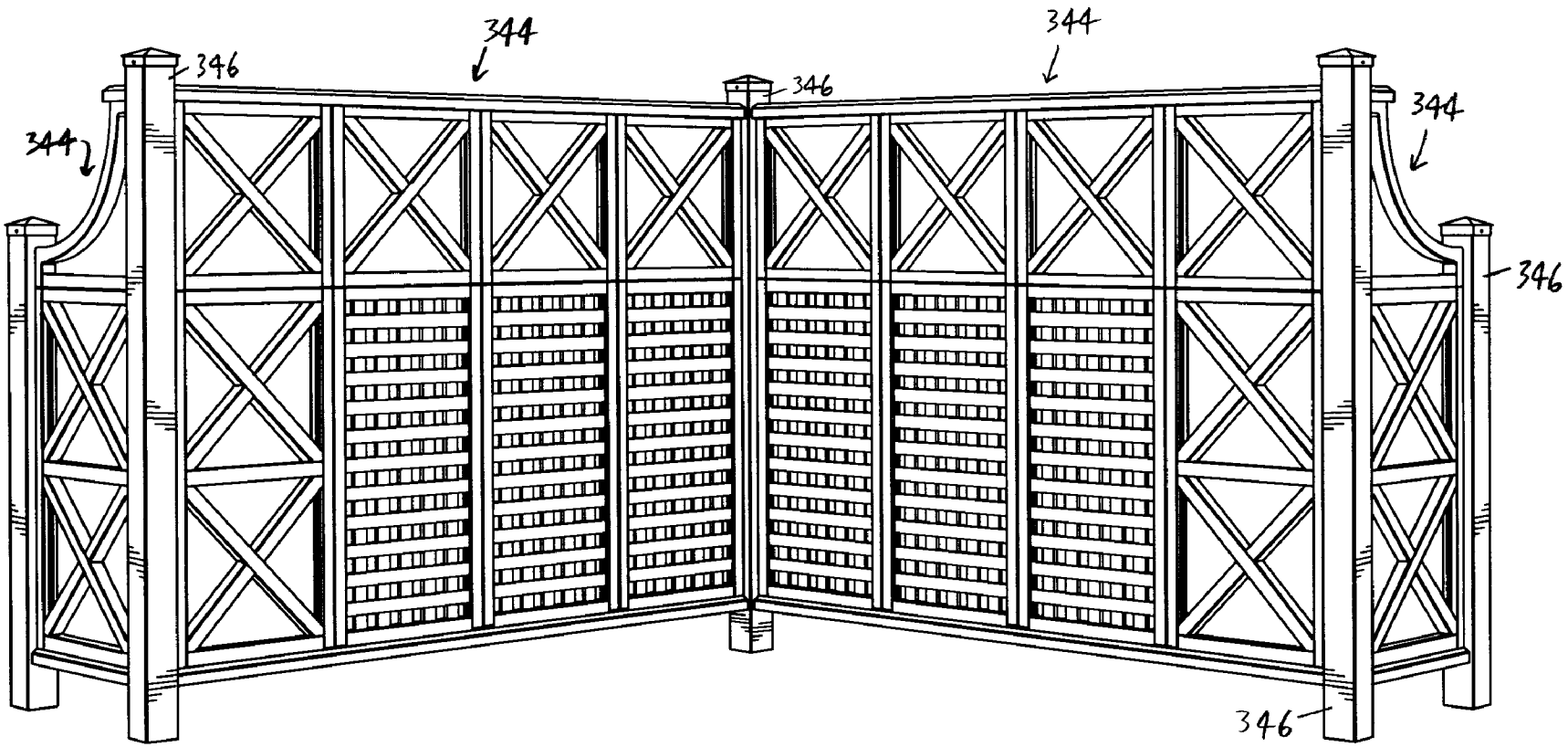
FIG. 18E is an isometric view of another embodiment of the partition system of the invention.
Figure 18F:
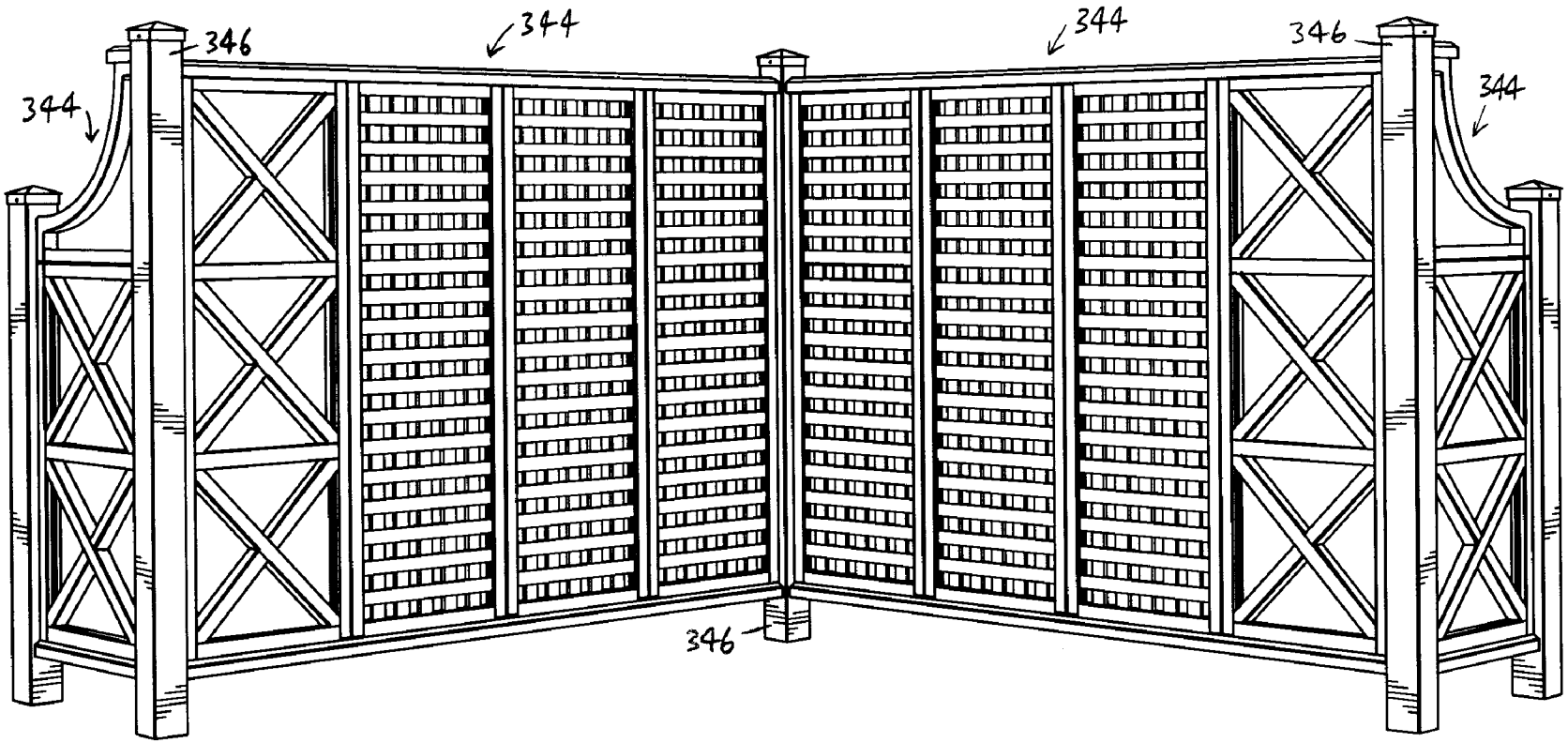
FIG. 18F is an isometric view of another embodiment of the partition system of the invention.

Referring to FIG. 17C, an end of the rail 208 is illustrated in an expanded view. As shown, this end of rail 208 comprises the dowel-receiving tapered holes 224, as well as the screw-receiving hole 228. As shown, the dowel-receiving holes 224 are tapered.

Additional embodiments of the invention are shown in FIGS. 18A-41B. In FIGS. 18A-41B, elements are numbered so as to correspond to like elements shown in FIGS. 1A to 17C.

Figure 19A:
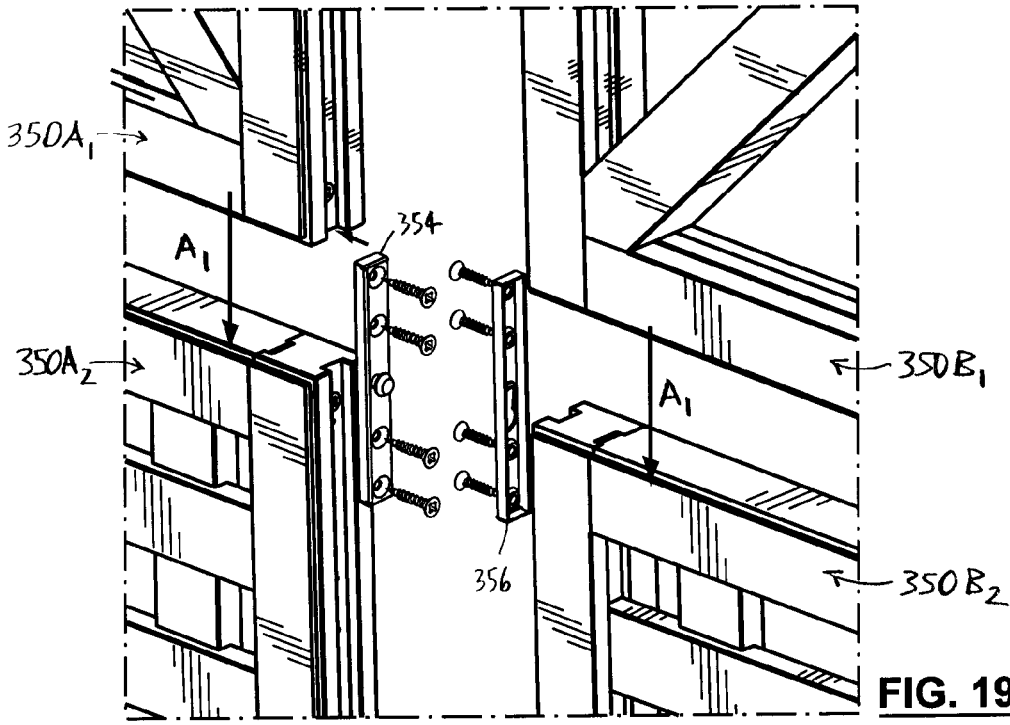
FIG. 19A is an exploded isometric view of embodiments of adjacent panel modules of the invention.
Figure 19B:
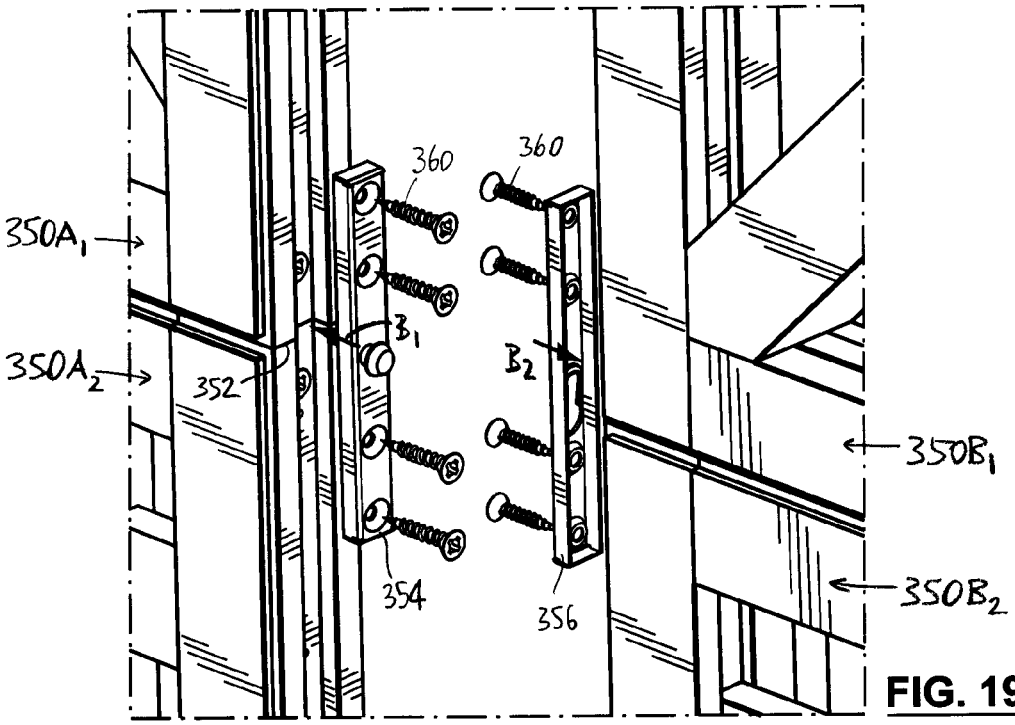
FIG. 19B is an exploded isometric view of the panel modules of FIG. 19A in which the panel modules are abutting each other to define joint intersections therebetween, drawn at a larger scale.

Reference is made to FIGS. 18A-31E to describe an embodiment of a partition 344 of the invention. The partition 344 is to be supported by one or more support elements 346. In one embodiment, the partition 344 includes one or more panel modules 348, each panel module 348 including two or more panel elements 350 positioned relative to each other in a predetermined abutting arrangement to define a joint intersection 352 therebetween (FIGS. 19B, 21A). As will be described, the predetermined abutting arrangement preferably is selected from the group consisting of a vertical arrangement, in which the two or more panel elements 350 are positioned operably vertically relative to each other, and a horizontal arrangement, in which the two or more panel elements are positioned operably horizontally relative to each other. Each panel module 348 preferably includes one or more fastening elements 354, 356 (FIGS. 19B and 29A-29C). As will also be described, each fastening element 354, 356 is attached to panel elements on both sides of the joint intersection 352 to maintain the panel elements 350 in the predetermined arrangement.

Figure 29A:
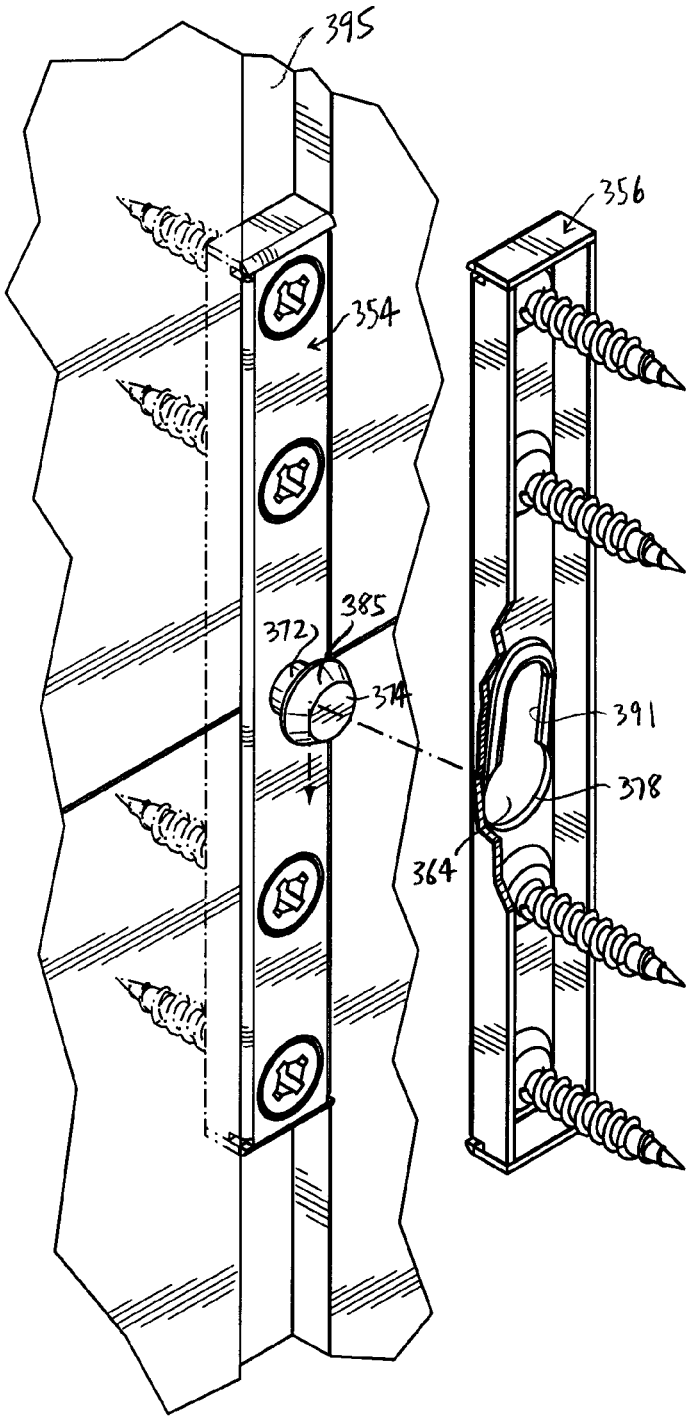
FIG. 29A is an isometric view of first and second fastening elements of the invention, drawn at a larger scale.
Figure 29C:
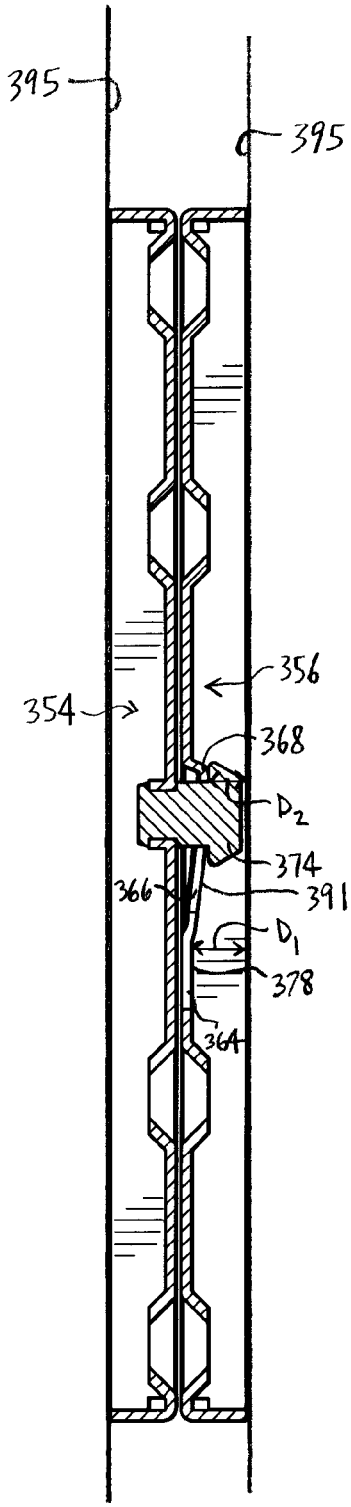
FIG. 29C is a cross-section of the first and second fastening devices of FIG. 29A showing a head portion of the first fastening element located in a slot in the second fastening element to secure together the panel modules on which the first and second fastening elements are mounted, drawn at a smaller scale.
Figure 29B:
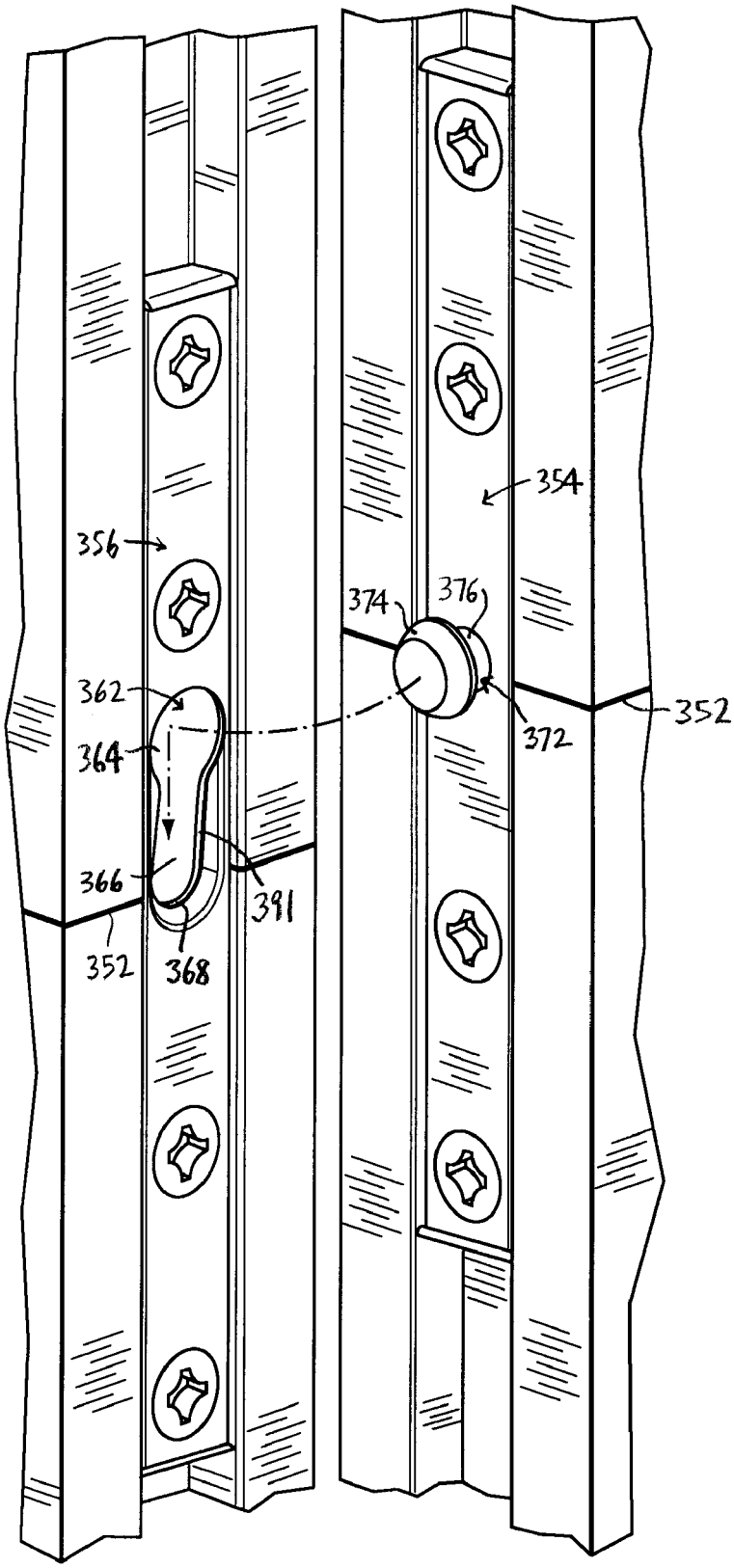
FIG. 29B is another isometric view of the first and second fastening elements of FIG. 29A, drawn at a larger scale.
Figure 30B:
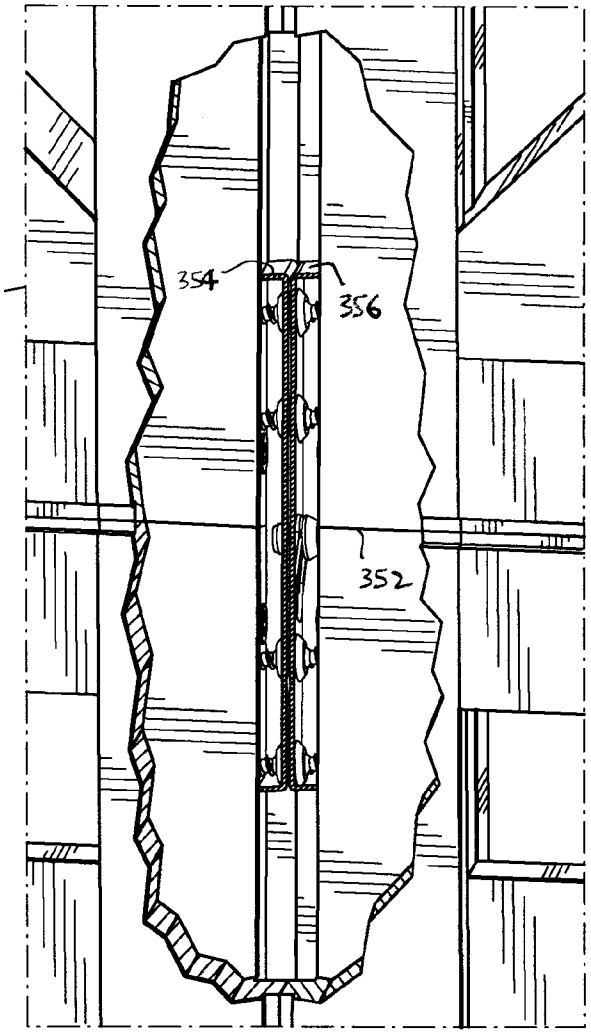
FIG. 30B is a partial cross-section showing the first and second fastening elements of FIG. 30A engaged with each other, drawn at a larger scale.
Figure 30A:
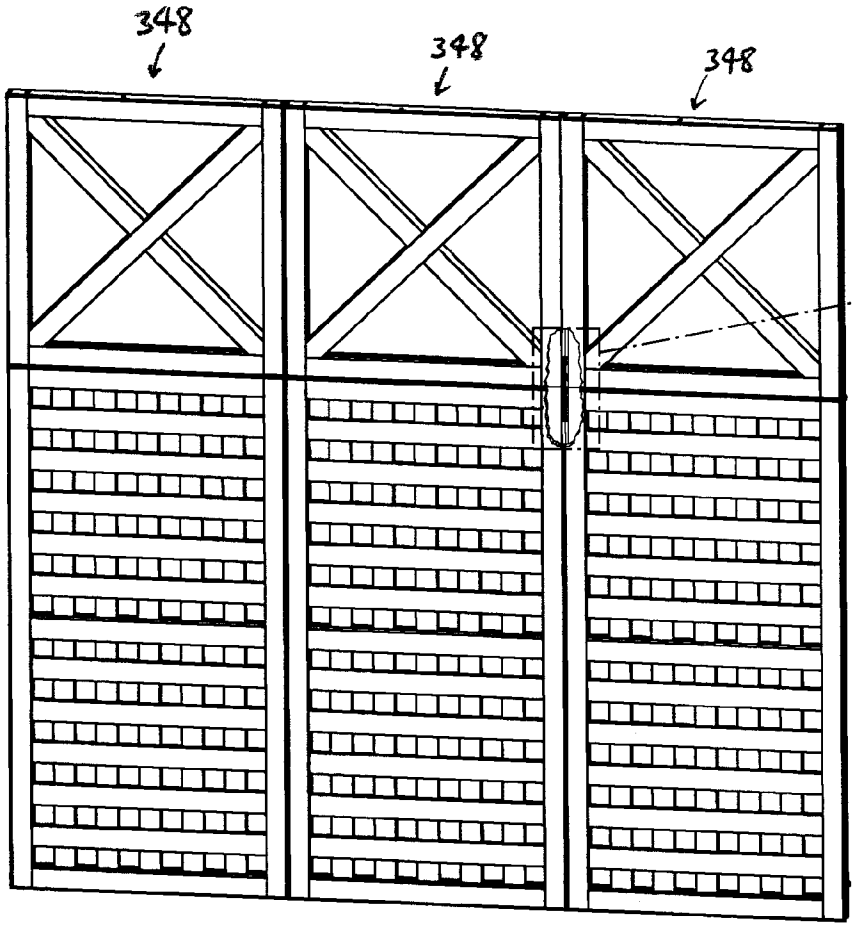
FIG. 30A is an isometric view of an embodiment of a partition of the invention in an assembled condition, with a part thereof cut away to show the first and second fastening elements engaged with each other, drawn at a smaller scale.

As can be seen, for example, in FIGS. 29A-29C, a first fastening element 354 included in a panel module 348 preferably is adapted to cooperate with a second fastening element 356 included in a selected panel module 348, for securing the panel module 348 and the selected panel module 348 to each other. In addition, and as shown in FIGS. 21A-21E and 22A-22C, when the panel module is to be positioned between other panel modules, the first and second fastening elements 354, 356 are positioned on opposite sides of the panel module respectively.

Figure 28A:
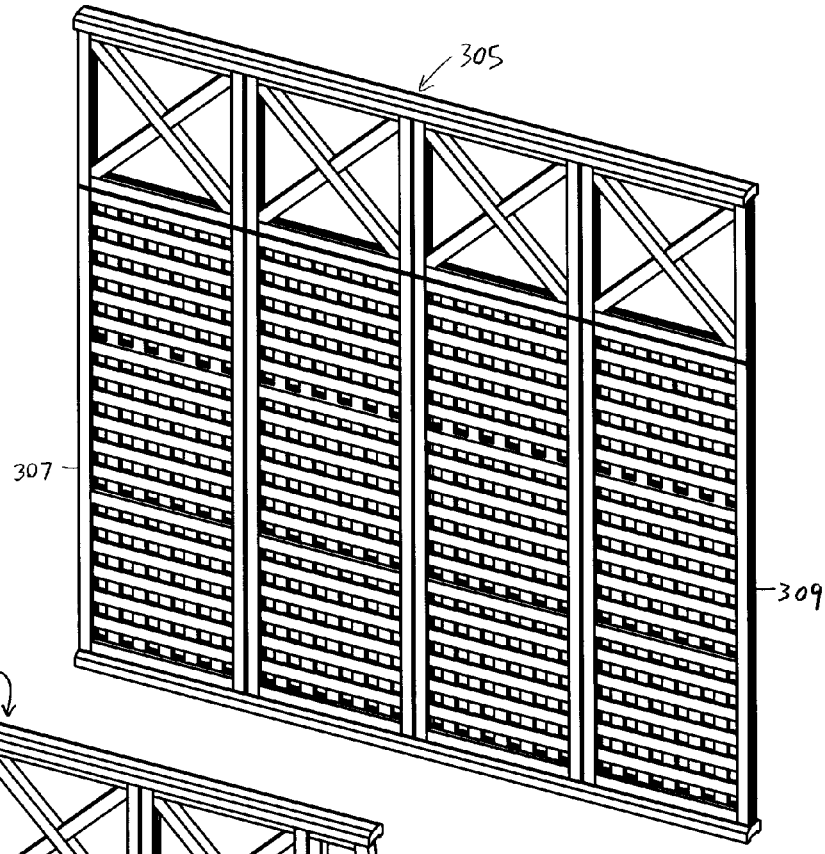
FIG. 28A is an isometric view of an embodiment of a partition of the invention in an assembled condition, drawn at a smaller scale.
Figure 28B:
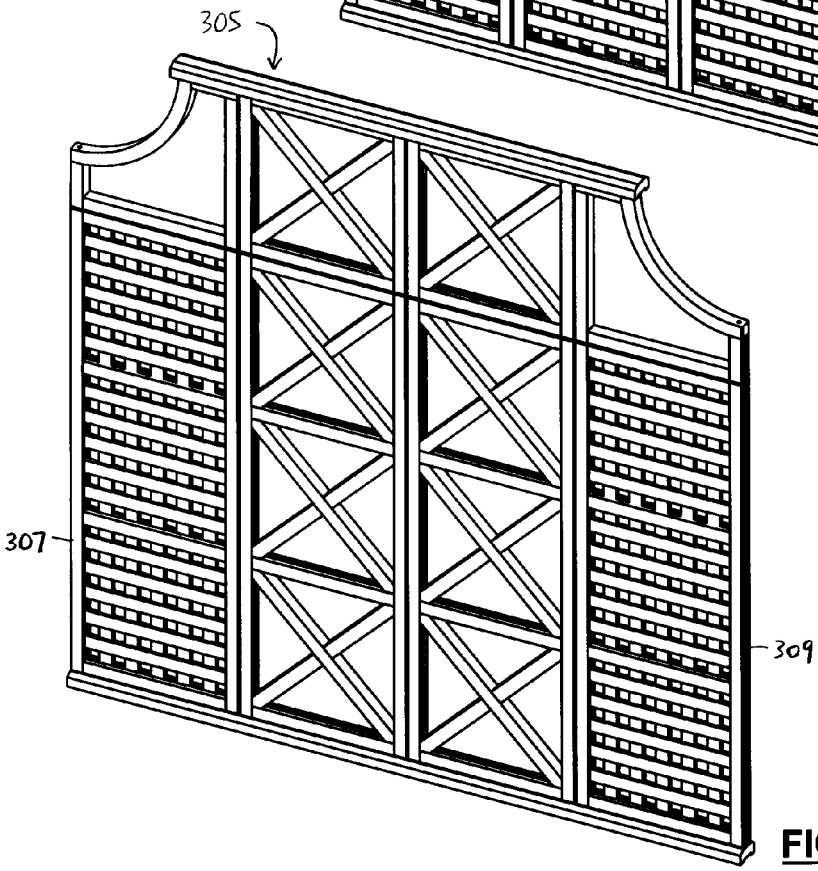
FIG. 28B is an isometric view of another embodiment of the partition of the invention in an assembled condition.
Figure 28C:
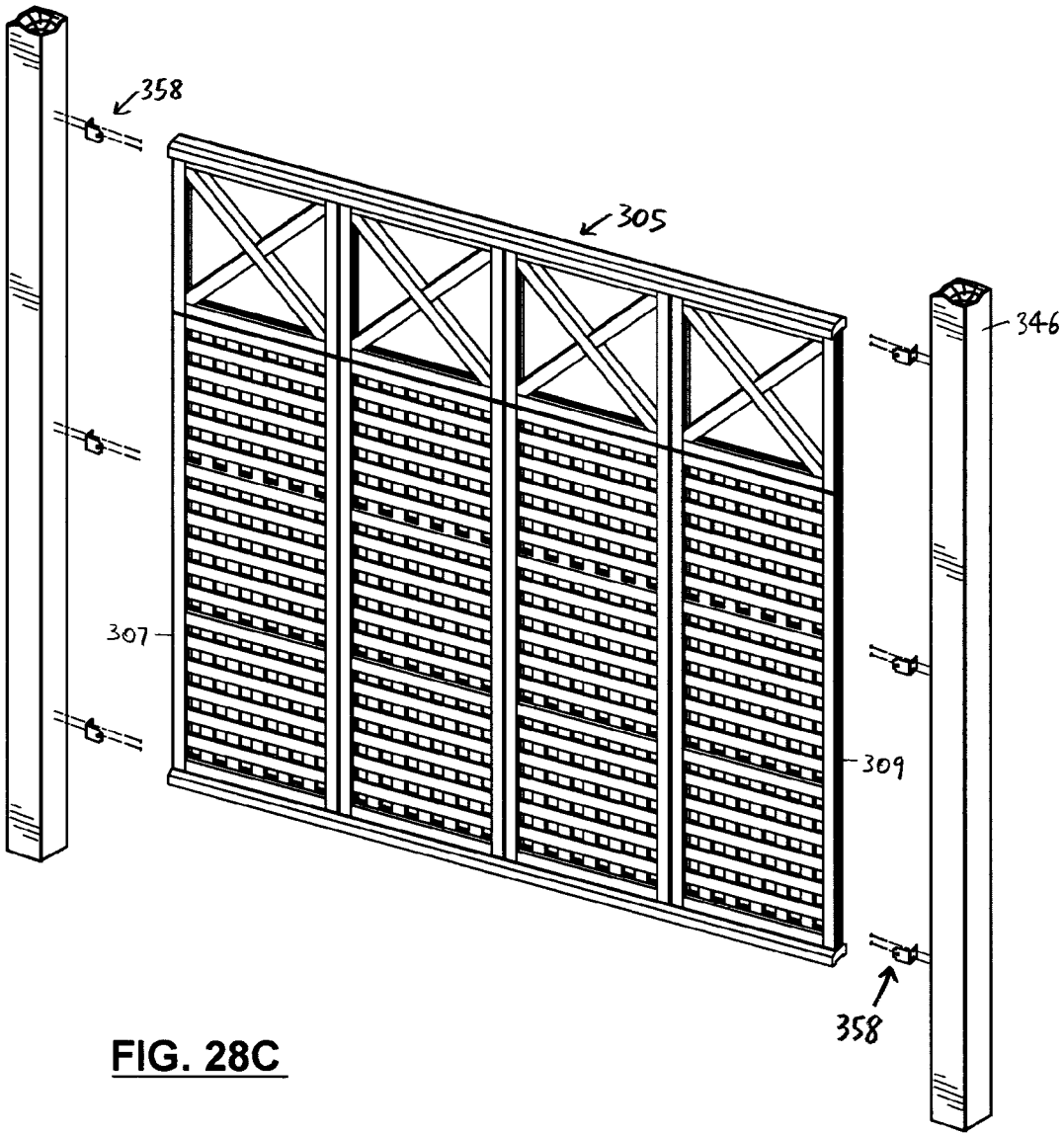
FIG. 28C is an exploded view of an embodiment of a partition system of the invention including the partition of FIG. 28A, with support posts, and couplers for attaching the partition to the support posts.

In one embodiment, a number of panel modules 348 preferably are included in a partition body 305. Selected fastening elements 354, 356 are attached to selected panel elements 350 in the panel modules 348. The selected fastening elements are selected for cooperation with the other fastening elements to secure the panel modules 348 to each other serially (i.e., respectively) to form the partition body 305 extending between ends 307, 309 thereof (FIGS. 28A-28C).

As will be described, the positioning of the fastening elements on the panel module is somewhat different if the panel module is to be positioned at one of the ends 307, 309 of the partition body 305.

The panel elements 350 preferably are provided in a number of patterns, so that the panel elements may be selected by a user (not shown) according to the user's preferences and/or objectives to provide a desired appearance (FIGS. 31A-31E). As can be appreciated, e.g., from FIGS. 18A-18F, when selecting panel elements, the user also selects panel modules (i.e., the arrangements of the panel elements in the panel modules), and also selects the overall design of the partition body 305 when selecting the panel elements. The user may also select panel elements to be included in panel modules based on functional considerations. For example, if the user wishes the partition 344 to provide a measure of privacy, then the user would select the panel elements with patterns which generally are more closed (e.g., the panel elements shown in FIGS. 31D and 31E). The square panel elements may be, for example, approximately 19½" by 19½". From the description herein, however, it will be understood that the panel elements may be any shape or shapes and any size or sizes which are compatible.

It will be understood that the panel elements shown in FIGS. 31A-31E are exemplary only. The panel elements 350 preferably are provided in a variety of shapes and sizes. As shown, for example, in FIG. 21A, the panel elements are not necessarily square. To facilitate combinations of panel elements in modules compatible with other panel modules, it is convenient to provide some of the panel elements 350 in a vertically extending configuration in which the height of the panel element 350 is a whole number multiple (or an approximate whole number multiple, as the case may be) of the height of the basic (square) form of panel element 350. The elongate configuration of panel element 350 expedites assembly of the partition 344. Also, the elongate configuration of panel element (designated as 350L in FIG. 21A for clarity) provides an additional option for giving an esthetically pleasing appearance to the partition 344.

An embodiment of a method of forming the panel modules 348 will now be described. In one embodiment, and as shown in FIG. 19A, once the panel elements have been selected, the panel elements (identified as 350$A_1$ and 350$A_2$, 350$B_1$ and 350$B_2$ in FIG. 19A for convenience) are positioned relative to each other according to the arrangement selected. For example, in FIG. 19A, the panel elements 350$A_1$ and 350$A_2$ are positioned in the vertical arrangement, i.e., the panel elements 350$A_1$ and 350$A_2$ are positioned operably vertical relative to each other. Once the panel module (referred to as 348A for clarity) is in position (i.e., vertical, or at least substantially vertical), the panel element 350$A_1$ is positioned above the panel element 350$A_2$ (FIG. 19E), i.e., the panel elements are positioned operably vertical relative to each other.

Similarly, the panel elements designated 350$B_1$ and 350$B_2$ for convenience in FIG. 19A are positioned operably vertical relative to each other.

In FIG. 19A, for convenience, the panel elements shown on the left are designated 350$A_1$ and 350$A_2$, and the corresponding panel elements shown on the right are designated 350$B_1$ and 350$B_2$. To assemble the panel module 348A (FIG. 19E), the operably lower edge of panel element 350$A_1$ is positioned to abut the operably upper edge of the lower panel element 350$A_2$. Preferably this is accomplished, for example, by moving the panel element 350$A_1$ in the direction indicated by arrow "$A_1$" in FIG. 19A. Similarly, the panel element 350$B_1$ is moved in the direction indicated by arrow "$A_2$" to engage the panel element 350$B_2$.

As shown in FIG. 19B, once the panel elements 350$A_1$, 350$B_1$ engage the panel elements 350$A_2$, 350$B_2$ respectively, joint intersections 352A, 352B are defined therebetween respectively. As can be seen in FIG. 19B, the joint intersection is the interface between the panel elements 350$A_1$ and 350$A_2$, on one hand, and panel elements 350$B_1$ and 350$B_2$, on the other hand. The first and second fastening elements 354, 356 are attached to bridge the joint intersections 352A, 352B respectively. To attach them, the fastening elements 354, 356 are positioned as indicated by arrows "$B_1$" and "$B_2$" respectively. The fastening elements 354, 356 are attached to the panel elements (panel elements 350$A_1$ and 350$A_2$ respectively, and panel elements 350$B_1$ and 350$B_2$ respectively) by any suitable means. Preferably, however, fasteners 360 (preferably, screws) are used to attach the fastening elements to the panel elements respectively.

The first fastening element 354 is attached to each of the panel elements 350$A_1$, 350$A_2$, and the second fastening element 356 is attached to each of the panel elements 350$B_1$, 350$B_2$. Preferably, the panel modules 348A and 348B are formed upon attachment of the fastening elements.

As can be seen in FIG. 29B, the second fastening element 356 preferably includes a keyhole slot 362 having an opening 364 in communication with a slot portion 366 thereof. Preferably, the opening 364 is larger in a transverse direction than the slot portion 366 (i.e., the opening 364 is wider than the slot portion 366), so that the keyhole slot 362 has the keyhole shape generally. As can also be seen in FIG. 29B, the slot portion 366 extends between the opening 364 and a slot portion end wall 368. The slot portion 366 is also partially defined by side walls 391, as will be described.

The first fastening element 354 preferably includes a body 370 and a stud portion 372 protruding from the body 370 when the first fastening element 354 is attached to the panel elements (FIG. 29B). The stud portion 372 preferably includes a head 374 supported by a thinner neck 376. As will be described, it is preferred that the neck 376 is relatively thin relative to the head 374, so that the head 374 is retainable in the second fastening element 356 when the neck 376 is positioned in the slot portion 366.

As can be seen in FIGS. 29A and 29B, the head 374 is inserted in the opening 364 to position the neck 376 proximal to an edge 378 defining the opening 364 (FIG. 29A). The edge 378 is connected to the side walls 391, i.e., the slot portion 366 is partially defined by the side walls 391, which extend between the edge 378 and the slot portion end wall 368. After the neck 376 is so located, relative movement of the first and second fastening elements 354, 356 preferably is effected to locate the neck 376 in the slot portion 366 so that the head 374 is held by the side walls 391 of the slot portion 366, to attach the first and second fastening elements 354, 356 together. Relative movement of the first and second fastening elements so that the end wall 368 is moved toward the head 374 preferably continues until the neck 376 is brought into contact with (and/or proximal to) the end wall 368, to complete the process of securing the two fastening elements 354, 356 together.

As will be described, it is preferred that the relative movement is achieved by moving the second fastening element 356 relative to the first fastening element 354, i.e., after the head 374 is pushed through the opening 364, the end wall 368 is moved toward the stud portion 372. This positions the neck 376 in the slot portion 366, i.e., the head 374 is held in the second fastening element 356 by the side walls 391. The end wall 368 preferably is moved further toward the stud portion 372 until the end wall 368 is positioned proximal to or abutting the stud 372.

However, it will be understood that, if arranged appropriately, the panel module with the first fastening element mounted on it may be moved while the other panel module (i.e., with the second fastening element on it) is held substantially stationary. For example, if the second fastening element 356 is positioned with the opening 364 oriented upwardly (i.e., positioned on the panel elements with the slot portion 366 below the opening 364, when the panel module is positioned for use), then it is preferred that the panel module with the second fastening element 356 thereon be maintained in a substantially static position while the panel module with the first fastening element 354 thereon is moved relative to the second fastening element 356.

As can be seen in FIG. 29C, the distance ("$D_1$") between the edge 378 and a wall 380 of the panel element on which the second fastening element 356 is mounted and the distance ("$D_2$") between the end wall 368 and the wall 380 differ significantly. The slot portion 366, as can be seen in FIG. 29C, is generally positioned at an angle because it extends between the edge 378 and the end wall 368, so that, as the position of the neck portion 376 in the slot portion 366 is changed from the neck from being at the entrance to the slot portion to the neck to being at the end of the slot portion 366 (at which the neck is engaged, or at least proximal to, with the end wall), the neck is subjected to tension, thereby securing the first and second fastening elements together, and thus also securing the adjacent panel modules together.

Accordingly, after the head 374 is received in the opening 364 and after relative movement of the fastening element 354 and the mating element 356 to position the neck 376 in the slot portion 366, the neck 376 and the head 374 are positionable in a secured position (FIG. 29C), in which the head 374 is proximal to the end wall 368 and the neck 376 is in the slot portion 366. Also, as described above, the slot portion 366 is at least partially defined by side walls 391 which are positioned for subjecting the neck 376 to tension as the head 374 and neck 376 are repositioned from the opening 364 to the secured position, i.e., proximal to the end wall 368. As can be seen, for example, in FIGS. 29B and 29C, in one embodiment, each panel module includes a panel element end wall 395 of the panel elements thereof, on which each fastening element 354, 356 is mounted respectively. As shown, the panel element end wall 395 preferably is in a slot 397 formed on the edges of the panel elements.

Preferably, the part of the side walls 391 disposed proximal to the slot portion end wall 368 is positioned closer to the panel element end wall 395 on which the second fastening element 356 is mounted than the part of the side walls 391 disposed at the opening 364, i.e., the part of the side walls 391 which is attached to the edge 378. Put another way, the part of the side walls 391 which is adjacent to the opening 364 is closer to the panel element end wall 395 on which the first fastening element 354 is mounted than the part of the end walls 391 which is adjacent to the slot portion end wall 368 when the head and the neck are in the secured position (FIG. 29C).

Preferably, and as shown in FIGS. 29A and 29C, the head 374 includes a chamfered surface 385 (FIGS. 29A, 29C). The chamfered surface 385 is positioned to facilitate movement of the head 374 through the opening 364 in the second fastening element. In use, because the user cannot easily observe the head 374 directly as it enters the opening 364, the head 374 may be misaligned with the opening 364. As a result, in use, the head 374 frequently is misaligned with the opening 364, i.e., the head 374 engages the edge 378 of the second fastening element 356, instead of being inserted directly into the opening 364. When the chamfered surface 385 engages the edge 378, the chamfered surface 385 guides the head 374 into the opening 364.

Figure 19C:
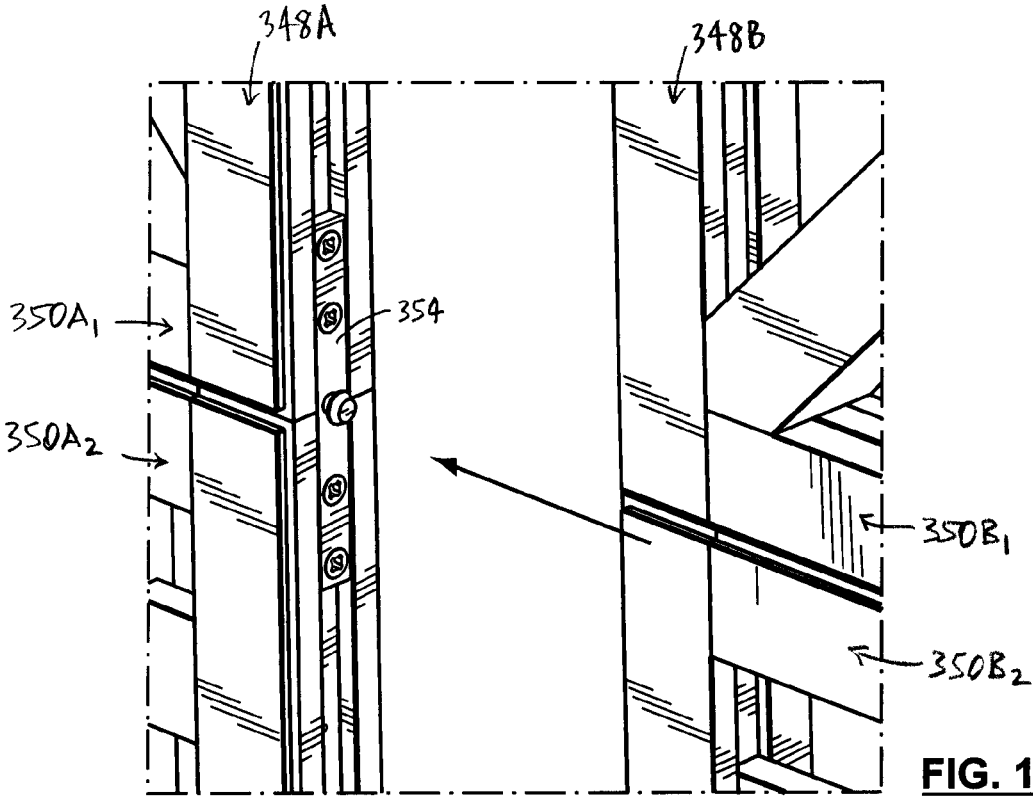
FIG. 19C is an isometric view of the panel modules of FIG. 19B showing a first fastener element positioned over the joint intersection of a first panel module.
Figure 19D:
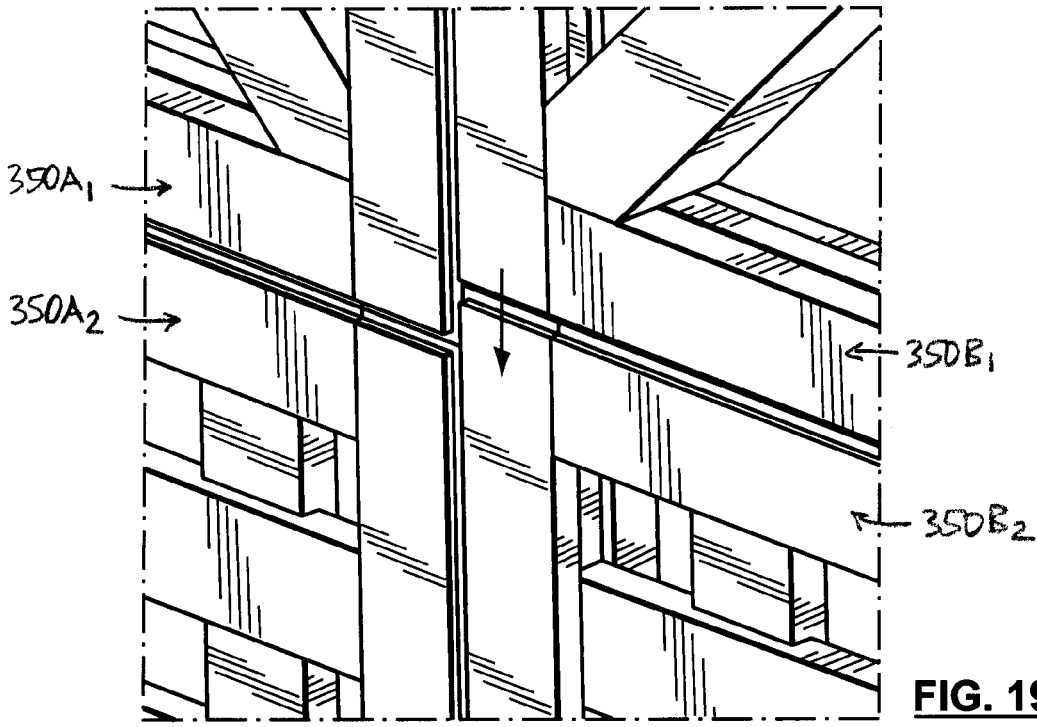
FIG. 19D is an isometric view of the panel modules of FIG. 19C in which a head portion of the first fastening element is positioned in a second fastening element (not shown in FIG. 19D)
Figure 19E:
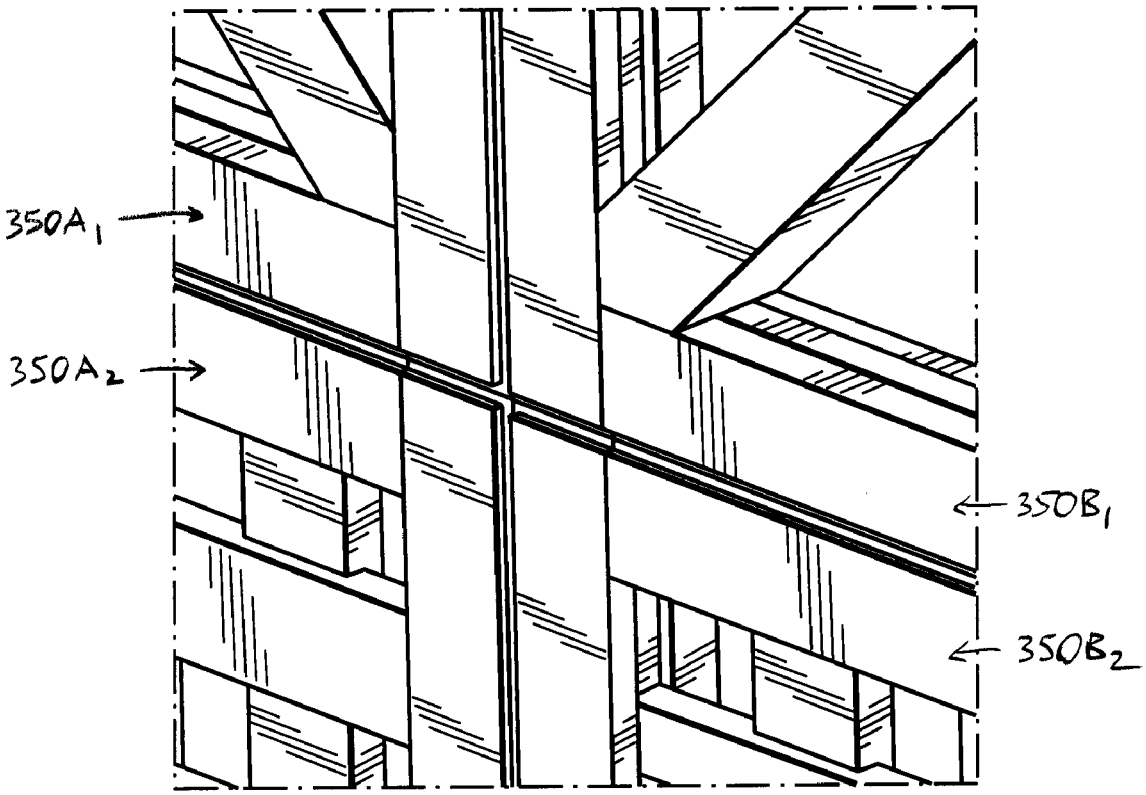
FIG. 19E is an isometric view of the first and second panel modules of FIG. 19D in which the first and second panel modules are secured to each other.

From the foregoing, it can be seen that, in one embodiment, the fastening element 354 of the invention is adapted to cooperate with the mating element 356 to secure the panel module to an adjacent panel module to which the mating element 356 is attached. For example, as shown in FIGS. 19B-19D, the first fastening element 354 and the mating element 356 (i.e., the second fastening element) are included in the panel module 348A and the abutting panel module 348B respectively.

It will be understood that the designation herein of the fastening element 354 which includes the stud portion as the "first" fastening element is arbitrary, i.e., it is for the purpose of clearly identifying the two different fastening elements. In one embodiment, the fastening element 354, 356 is selected from the group consisting of a fastening element with a stud portion 374 and a fastening element with a slot portion 366. The mating element is the nonselected one of the fastening element with the stud portion 374 and the fastening element with the slot portion 366. The stud portion 374 and the slot portion 366 are adapted to cooperate, to secure the panel module and the adjacent panel module together.

As can be seen in FIGS. 21A, 21D, 21E, 22A, and 22C, each panel module 348 preferably also includes edge fastening elements 382, 384. The edge fastening elements 382, 384 are intended to strengthen the partition by securing the panel modules at at least one end thereof to the panel modules adjacent thereto, i.e., in addition to the first and second fastening elements 354, 356. As shown in FIG. 21A, it is preferred that the edge fastening elements 382, 384 are attached to the sides 387 of the panel module at a predetermined location which is relatively close to the bottom edge 389 of the panel module. As can be seen in FIGS. 21D and 21E, the fastening elements include stud portions and keyhole slots respectively, so that the fastening elements 382, 384 may cooperate with corresponding fastening elements on adjacent panel modules (not shown) similar to the manner in which the first and second fastening elements cooperate with each other to secure the panel modules together. Although not shown in FIG. 21A, it will be understood that the edge fastening elements 382, 384 may be positioned at any suitable locations along the side edges of the panel module. It will also be understood that multiple fastening elements may be used, if desired, along a particular side (or sides) of panel modules. However, it is preferred that panel modules are secured together along abutting sides of two panel modules using the first and second fastening elements and also using the fastening elements 382, 384 spaced apart from the first and second fastening elements 354, 356. In particular, it is preferred that each edge fastening element 382, 384 is positioned proximal to the edge 389 of the panel module 348. Each edge fastening element is adapted to cooperate with the corresponding edge fastening element on the other (abutting) panel module for securing the panel module and the other (abutting) panel module together.

Figure 23:
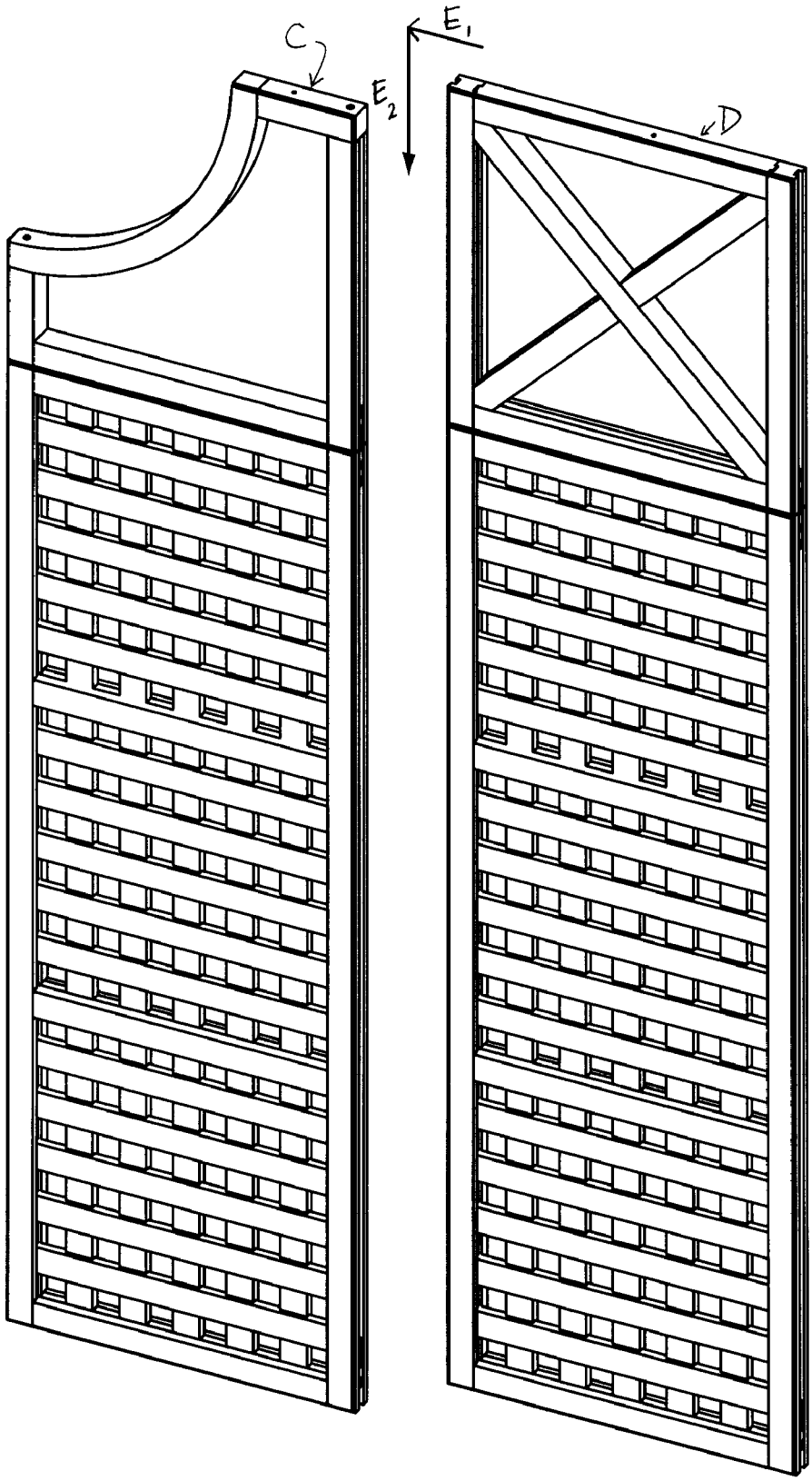
FIG. 23 is an isometric view of embodiments of two panel modules of the invention positioned to be secured to each other, drawn at a smaller scale.
Figure 24:
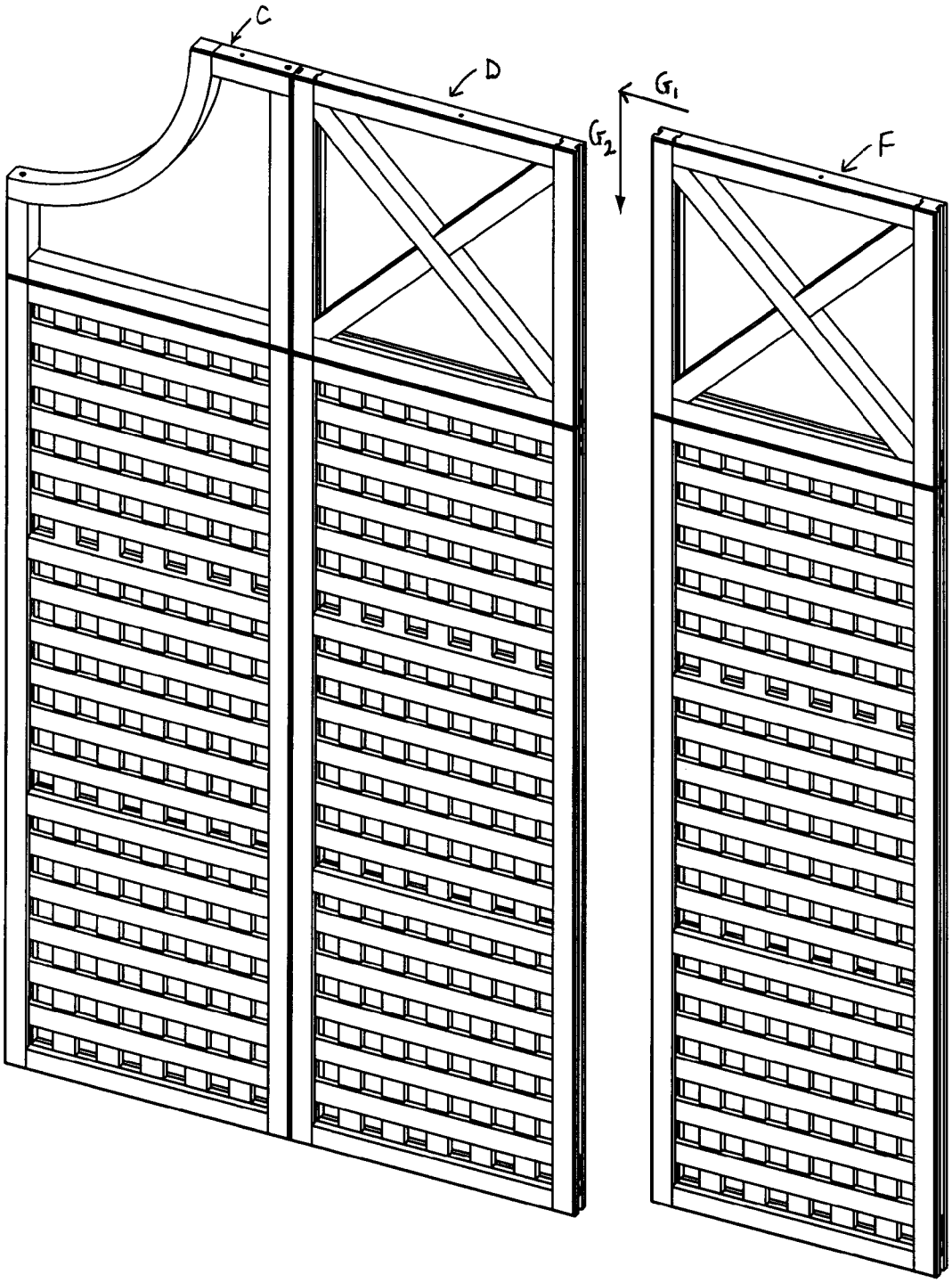
FIG. 24 is an isometric view of another panel module of the invention positioned to be secured to the panel modules of FIG. 23, drawn at a smaller scale.
Figure 25:
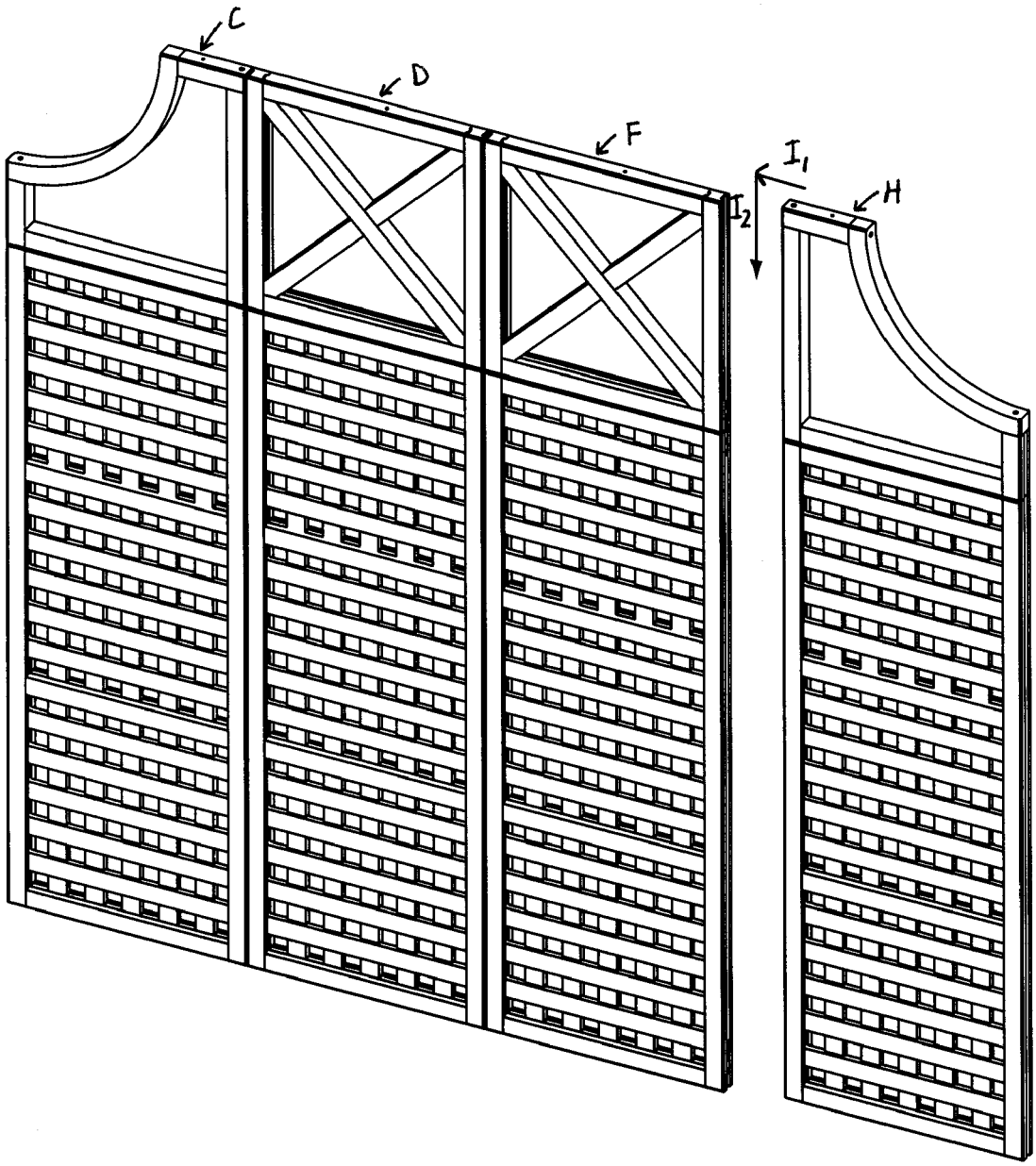
FIG. 25 is an isometric view of another panel module of the invention positioned to be secured to the panel modules of FIG. 24, drawn at a smaller scale.
Figures 26A, 26B, 26C:
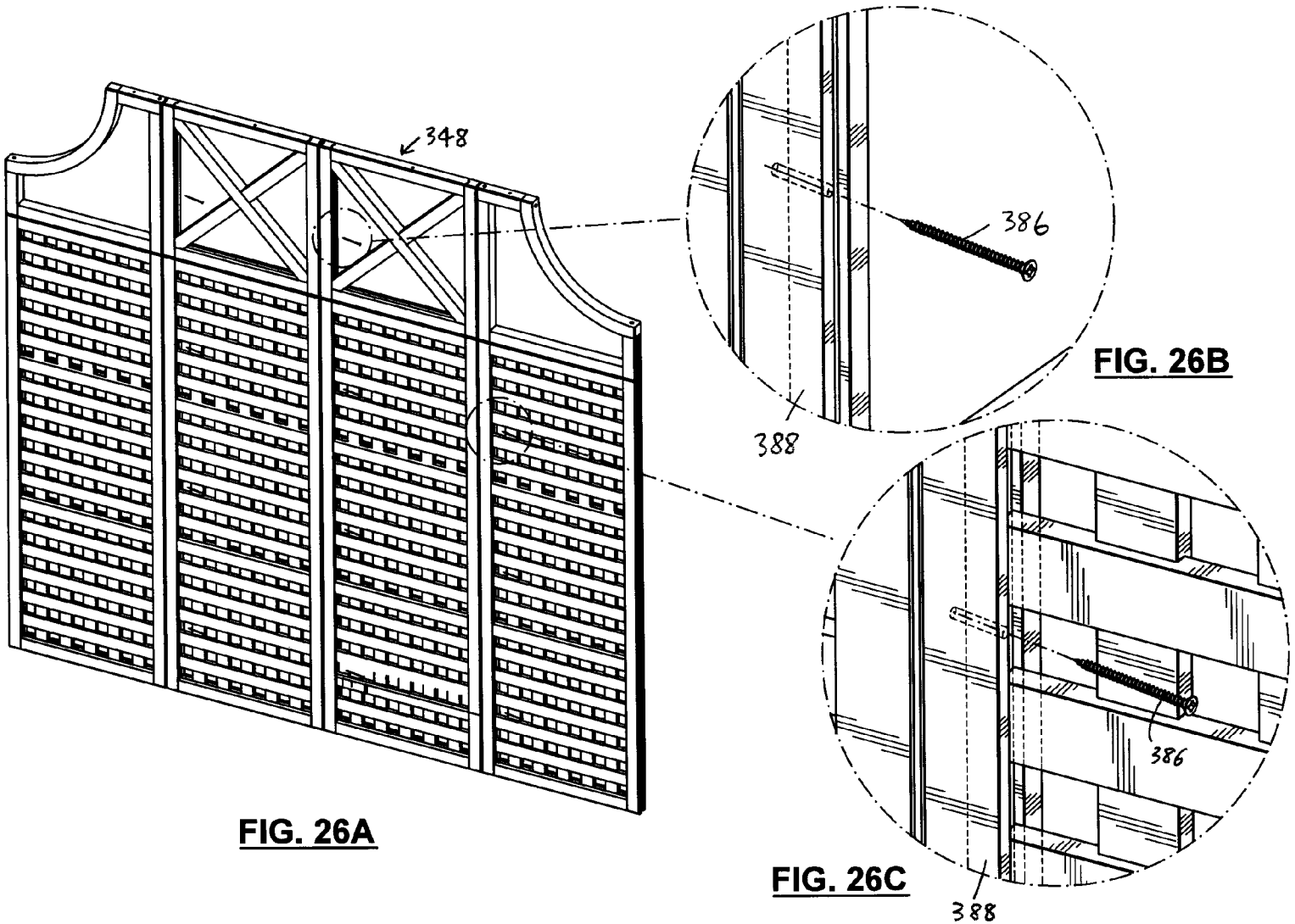
FIG. 26A is an exploded isometric view of the panel modules of FIG. 25 secured together to form a partition in a partially assembled condition, drawn at a smaller scale.
FIG. 26B is an exploded isometric view of a portion of the partition of FIG. 26A, drawn at a larger scale.
FIG. 26C is an exploded isometric view of another portion of the partition of FIG. 26A.

The assembly of an embodiment of the partition body 305 of the invention is illustrated in FIGS. 23-25. After the panel modules are assembled, two panel modules are secured to each other. As can be seen in FIG. 23, in order to secure two panel modules together, relative movement thereof (i.e., movement relative to the other) is required, due to the nature of the fastening elements which are to cooperate with each other in order to secure the two panel modules together. For example, as shown in FIG. 23, the panel module on the left as shown (identified for convenience as "C") is preferably held stationary, while the panel on the right as shown (identified as "D") is moved against the side edge of the panel module "C". In order to position the stud portions 372 and the aperture portions 364 of the keyhole slots 362 as required, the panel module "D" is first moved substantially horizontally against the panel module "C", as shown in the portion of the arrow identified as "$E_1$" in FIG. 23, but with the panel module "D" held higher than "C". Once the stud portions are positioned in the aperture portions of the keyhole slots, then the panel module "D" is pushed downwardly (i.e., in the direction indicated by arrow "$E_2$" in FIG. 23), in order to move the end walls 368 of the slot portions 366 toward the stud portion 372, as described above. Once the stud portions are substantially engaged with or at least proximal to the end walls 368 of the slot portions 366, the panel module "D" is secured thereby to the panel module "C".

In the same way, an additional panel module "F" can be attached to the open side of the panel module "D". The panel module "F" is first moved substantially horizontally against the panel module "D" as shown by arrow "$G_1$", in order to position the stud portions in the aperture portions of the keyhole slots. Once that has been accomplished, then the panel module "F" is pushed downwardly relative to panel module "D", in order to position the stud portions against or proximal to the end walls of the slot portions.

Finally, and as can be seen in FIG. 25, the panel module "H" may be attached to panel module "F" at the open side of panel module "F". Panel module "H" is first moved substantially horizontally in the direction indicated by arrow "$I_1$", and once the stud portions are positioned in the aperture portions of the keyhole slots, panel module "H" is moved downwardly (in the direction indicated by arrow "$I_2$") relative to panel module "F", to secure the panel modules "F" and "H" together.

In FIGS. 20A, 21A, 22A, 23-26A, 27, 28A, 28B, 30A, and 32A, panel elements are combined in operably vertical arrangements to form panel modules. By "operably vertical" is meant: once the panel modules are positioned upright, the panel elements are vertically positioned relative to each other. These panel modules are exemplary only. For example, the upper panel in each of the panel modules disclosed in such views is either substantially square or formed as a portion of a substantially square figure. In such views, the lower panel is substantially rectangular, having a predetermined width, and (as an example only) a height which is approximately three times the predetermined width. However, it will be understood that the upper and lower panel elements may have any desired shape and size.

Figures 21A, 21B, 21C, 21D, 21E:
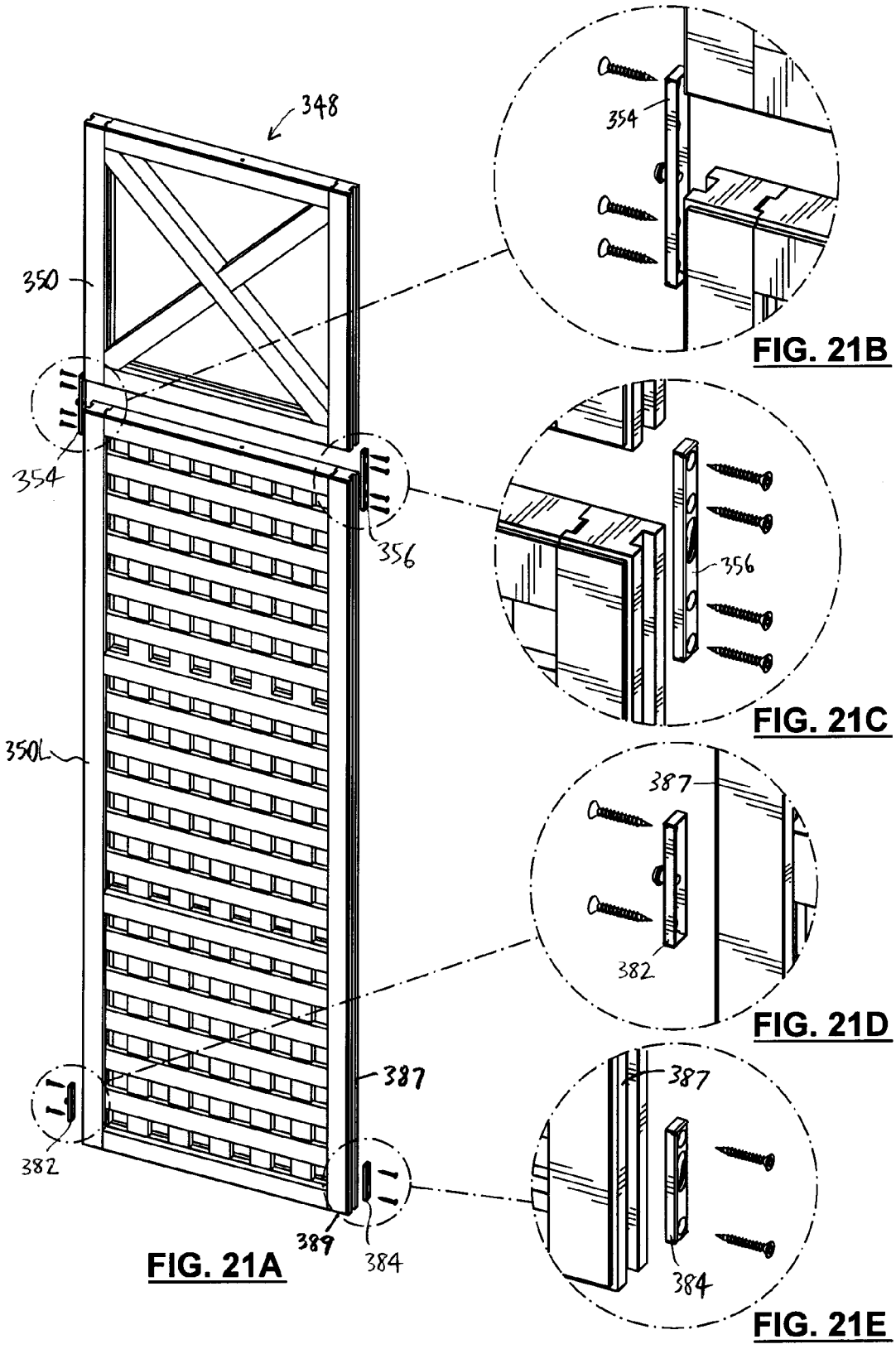
FIG. 21A is an exploded isometric view of an alternative embodiment of a panel module of the invention.
FIG. 21B is an exploded isometric view of a portion of the panel module of FIG. 21A, drawn at a larger scale.
FIG. 21C is an exploded isometric view of another portion of the panel module of FIG. 21A.
FIG. 21D is an exploded isometric view of another portion of the panel module of FIG. 21A.
FIG. 21E is an exploded isometric view of another portion of the panel module of FIG. 21A.
Figure 21F:
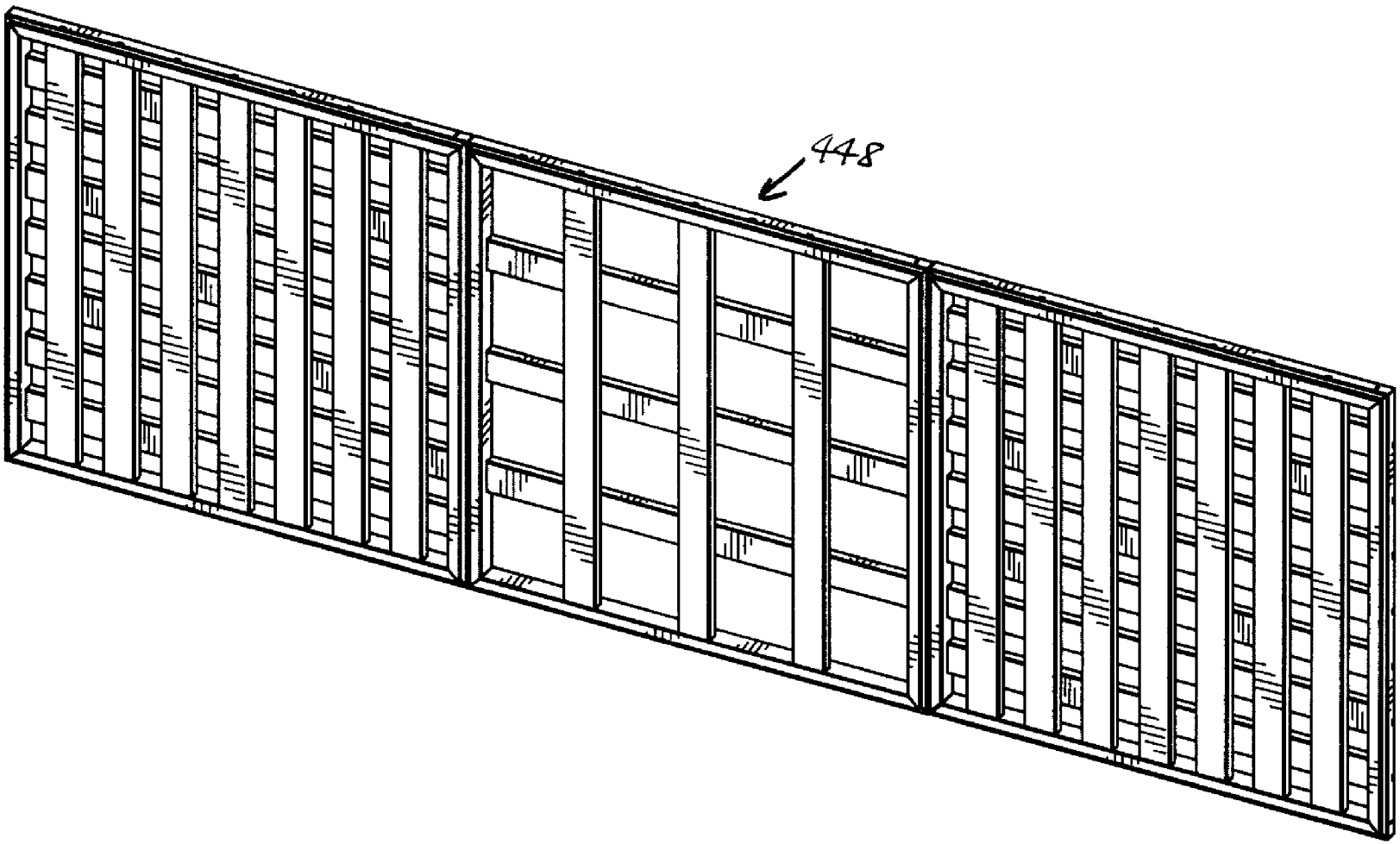
FIG. 21F is an isometric view of another embodiment of the panel module of the invention including three panel elements secured together in a horizontal arrangement, drawn at a smaller scale.
Figures 22A, 22B, 22C:
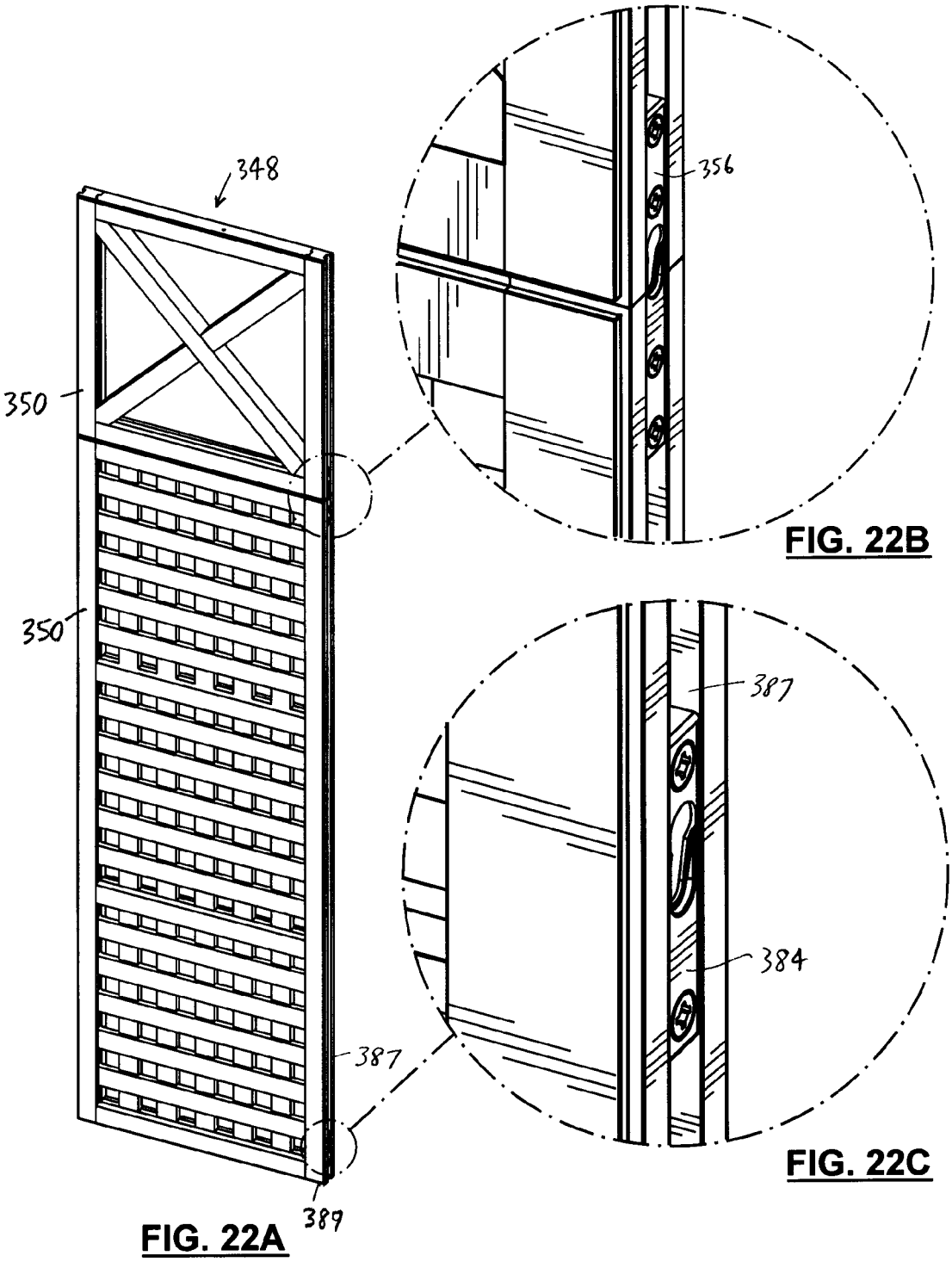
FIG. 22A is an isometric view of the panel module of FIG. 21A in an assembled condition, drawn at a smaller scale.
FIG. 22B is an isometric view of a portion of the panel module of FIG. 22A, drawn at a larger scale.
FIG. 22C an isometric view of a portion of the panel module of FIG. 22A, drawn at a larger scale.

An example of a panel module 448 having an operably horizontal arrangement is shown in FIG. 21F. In FIG. 21F, each panel element is substantially square. Each panel element is attached at at least one of its side edges to another panel element, to form the panel module. It is preferred that the panel elements of FIG. 21F are secured together using the first and second fastening elements, as described above.

Figure 20A:
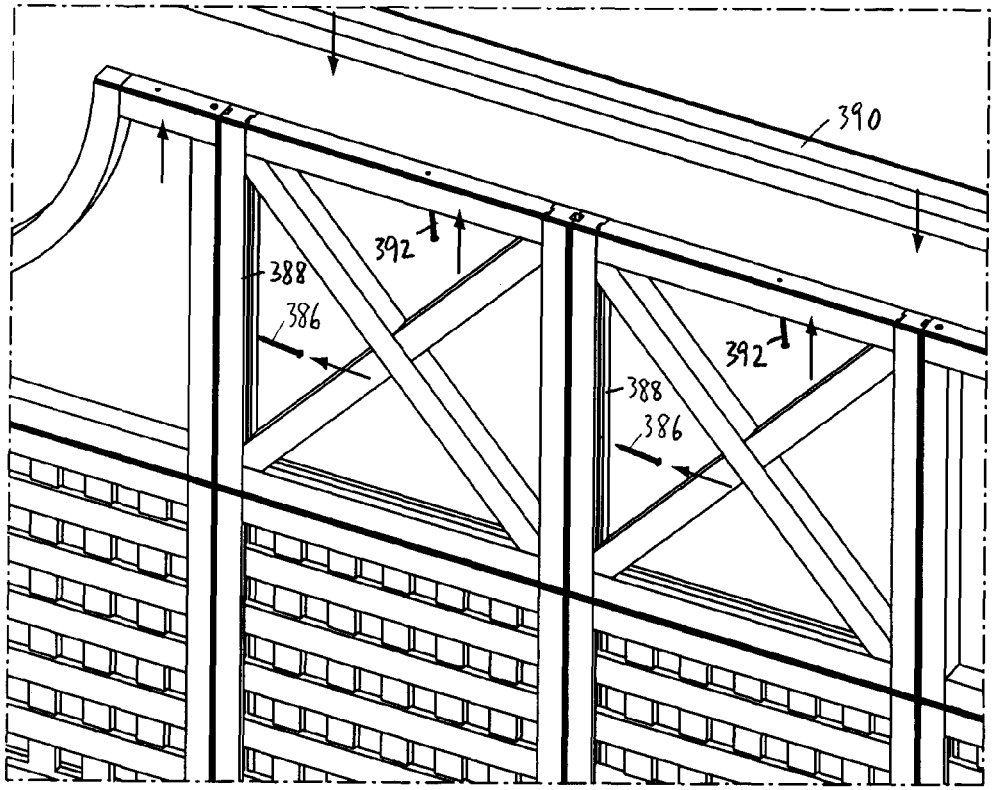
FIG. 20A is an isometric view of a portion of an embodiment of a partition of the invention in a partially unassembled condition, drawn at a smaller scale.
Figure 20B:
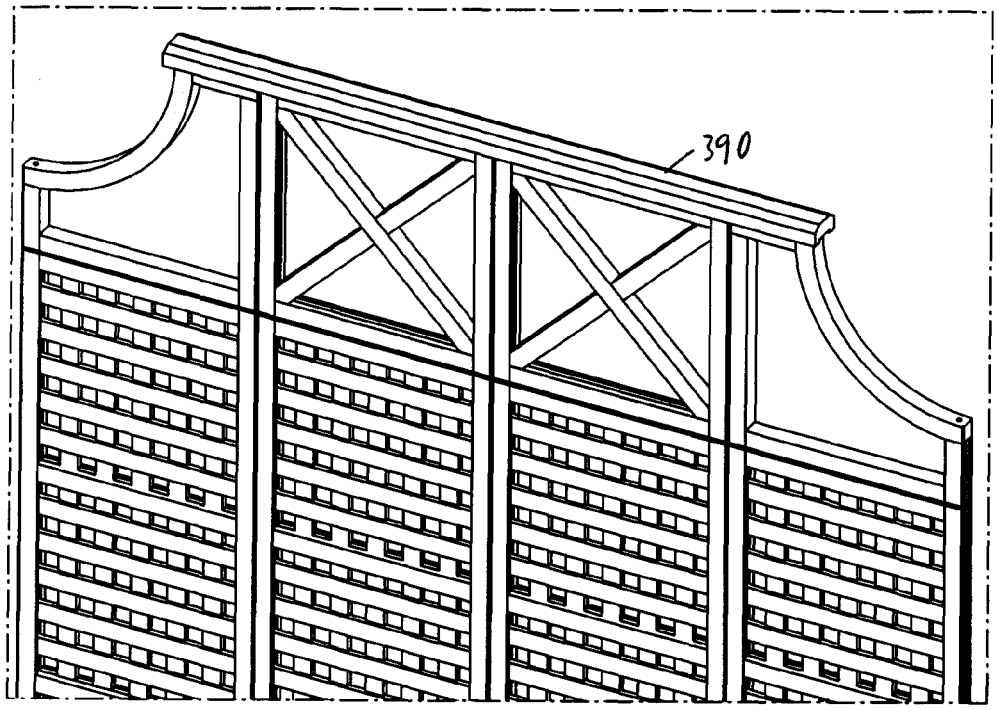
FIG. 20B is an isometric view of the partition of FIG. 20A in an assembled condition, drawn at a smaller scale.

Preferably, and as can be seen in FIG. 20A, the partition 344 additionally includes supplemental fasteners 386 which are intended to provide additional strength to the partition 344 by securing adjacent panel modules to each other. The fasteners 386 preferably are driven into side members 388 of relatively open panel elements (FIGS. 20A and 26A-26C) to engage with and be driven into the side members of adjacent panel modules.

Figure 27:
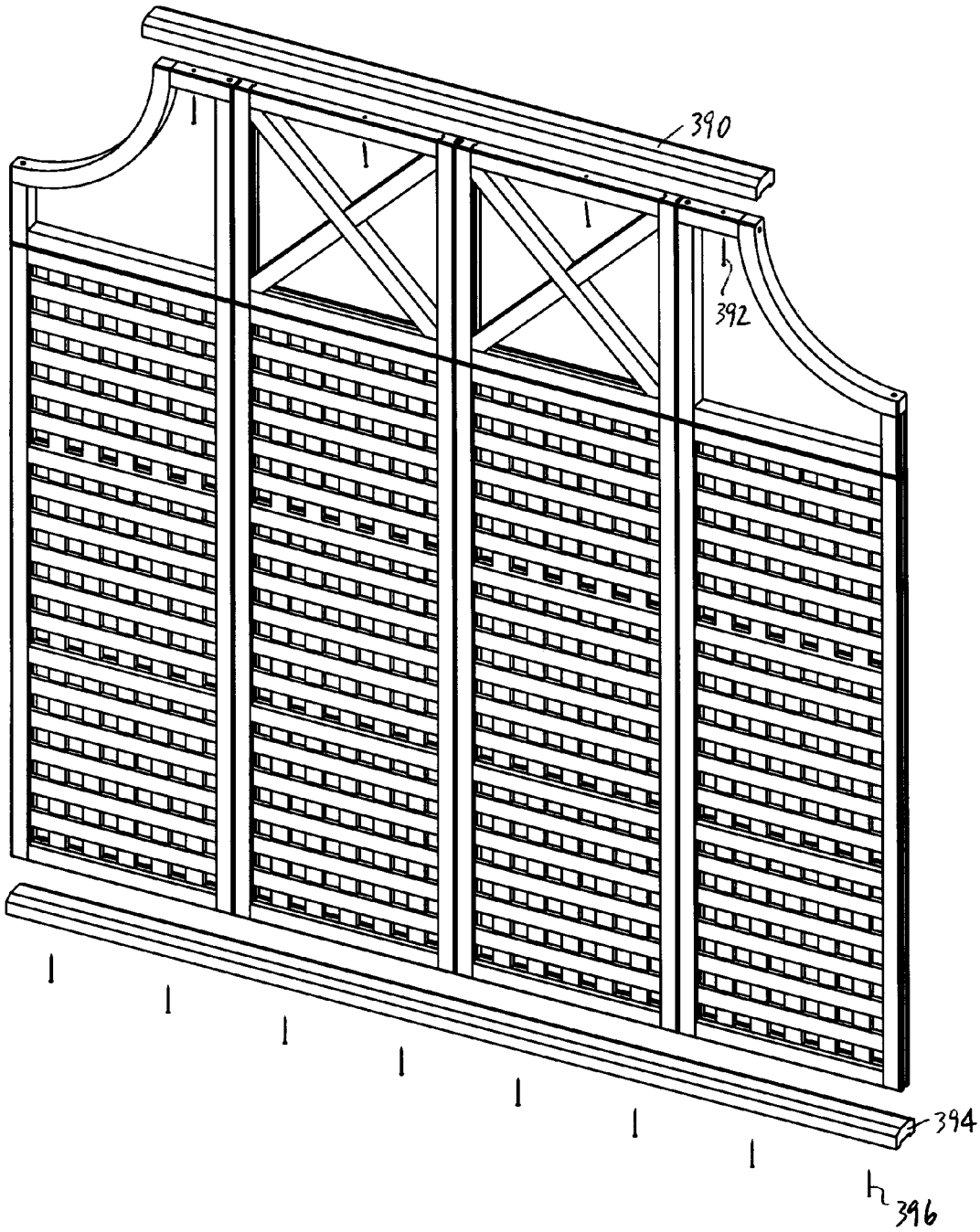
FIG. 27 is an exploded isometric view of the partition of FIG. 26A in a partially assembled condition with top and bottom edge portions, drawn at a smaller scale.

FIGS. 20A and 27 also show an upper trim portion 390 which may be attached along an upper side of the panel modules, once the panel modules for the partition are attached together. The trim portion 390 may be attached to the panel modules at their upper edges in any suitable manner. For example, and as shown in FIGS. 20A and 27, the upper trim portion may be attached to the panel modules by suitable fasteners 392.

Additionally, the partition preferably includes a bottom trim portion 394 attached to bottom edges of the panel modules by suitable fasteners 396 (FIG. 27). In addition to the esthetic benefits provided by the trim portions 390, 394, the trim portions 390, 394 also serve to strengthen the partition body 305 by connecting the panel modules to each other proximal to the edges thereof.

Figure 28D:
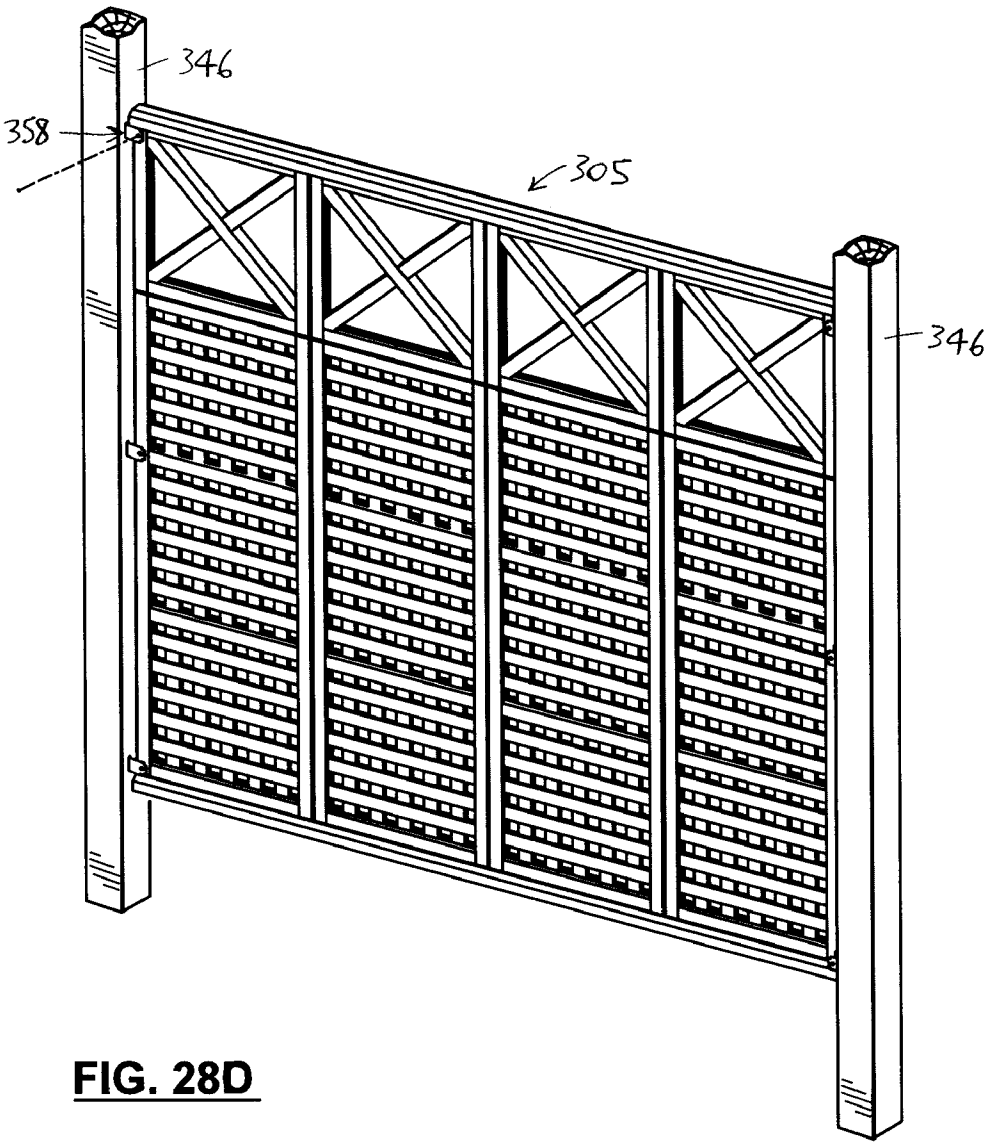
FIG. 28D is an isometric view of the partition system of FIG. 28C in an assembled condition.

Examples of partition bodies 305 in fully assembled condition are provided in FIGS. 28A and 28B. It will be appreciated by those skilled in the art that the partition body may be attached to external supports by any suitable means. Such attachment need not necessarily be at ends 307, 309 of the partition body. As can be seen in FIGS. 28C and 28D, the partition 344 preferably also includes one or more couplers 358 for coupling each panel module 348 to the support element(s) 346. In one embodiment, each coupler preferably includes a bracket, fasteners for fastening the bracket to the support post, and fasteners for fastening the bracket to the partition body 305.

In one embodiment, and as shown in FIG. 28C, the partition 344 preferably includes one or more couplers 358 for coupling one or more of the ends 307, 309 of the partition body 305 to the support element(s) 346. It is preferred that each support post 346 is installed with an end thereof in the ground. As is known in the art, after the end is positioned in the ground at a predetermined depth, and after backfilling and leveling, the installation of the support post is completed. The partition body 305 preferably is assembled, and then, as shown in FIG. 28C, the ends of the partition body 305 are attached to respective support posts. Accordingly, although various arrangements will occur to those skilled in the art, it is preferred that the brackets used are "L"-shaped brackets 393. Each such bracket is first attached to the support post 346. Once each such bracket is attached to the support post, the partition body is then moved laterally into position (i.e., to engage the brackets), and the fasteners are inserted to attach the brackets and the partition body 305 together.

The invention preferably also includes a partition system 311. The partition system 311 preferably includes one or more partition bodies 305, one or more support elements 346, and one or more couplers 358 for coupling the ends of one or more partition bodies to the support elements respectively.

As shown in FIGS. 18A-18F, the partition systems may be connected to each other by upper beams 397 to form a structure 398, having a preselected configuration. The upper beams are connected to the partition systems and to each other by any suitable connection means. The upper beams 397 may include transversely positioned beams, arranged to form a partial roof structure. Additional ornamental end portions 399 may also be attached to the upper beams 397 by any suitable means.

In use, the user selects the components of the partition system which are needed to provide a particular desired structure. The user first determines the length and height of the partition bodies which are required. Next, the user selects panel elements to be included in panel modules according to the user's needs and tastes, preferably while simultaneously considering the panel modules and arrangements of the panel modules. As described above, the panel elements from which the user is to select are provided in a variety of styles having different appearances, and may also be provided in a variety of shapes and sizes. Once the partitions have been determined, the other components are chosen. For example, the user chooses the support posts which are needed in order to construct the desired structure. The components of the partition system are all standardized, i.e., they are available only in certain standard formats, to minimize the production costs. For instance, the support posts preferably are available only in certain lengths, to lower production costs.

From the foregoing, it can be seen that the user requires only minimal tools and skill to assemble the partition system as designed by the user. In order to assembly the fence, first, the support posts are cut to the appropriate length and then installed. The partition body is assembled, as described above. The assembled partition preferably is secured to an external support by any suitable means. In one embodiment, using the couplers and appropriate fasteners, the user attaches the ends of the partition body to the support posts. If upper beams are required, they are installed subsequently.

It will be understood that the invention may also be provided in the form of a kit of parts which may be assembled to form the partition, the partition body, and the partition system.

For example, a kit including the components needed for one or more specified partitions may be assembled. The specified partitions may, for instance, have predetermined dimensions, and the panel elements included therein preferably are preselected. Such a kit may be less costly than a more generic group of components, due to volume. However, the user electing to purchase the kit is, in effect, limiting himself to only the partitions which may be made using the parts in the kit.

From the foregoing, it can be seen that the partition 344 has the advantage that a support structure is not required therein. The assembly of the partition is relatively easy, even for the relatively unskilled user. The standardization of components (e.g., the panel elements and the fastening elements, to form panel modules having standardized sizes) and the variety of arrangements and designs which may be used to facilitate designs which are aesthetically pleasing and individualized. Also, the standardization of the components simplifies assembly and minimizes costs.

Figure 35A:
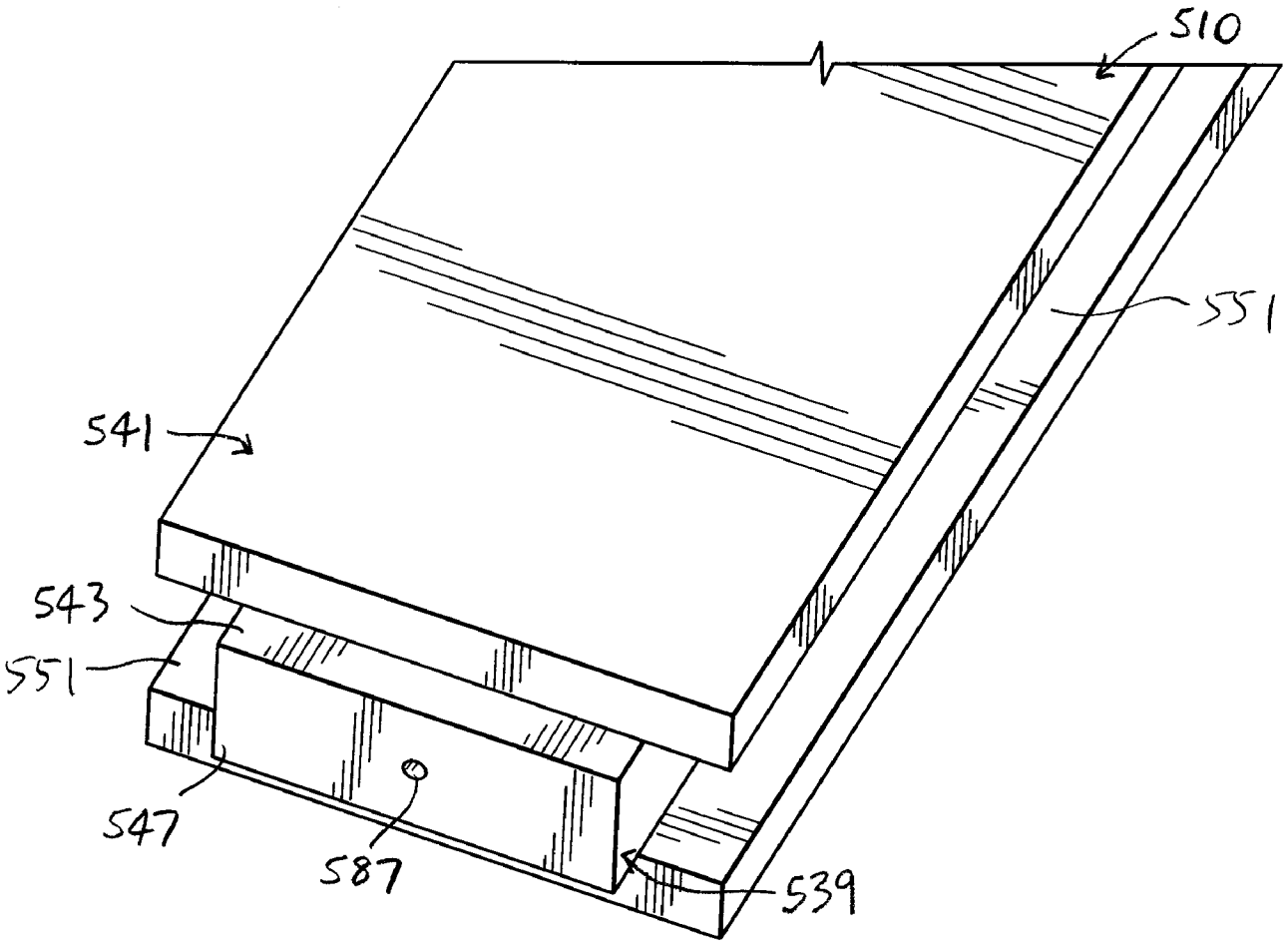
FIG. 35A is an isometric view of an upper end of the stile of FIG. 34 showing a predrilled hole therein for an anchor screw, drawn at a larger scale.
Figure 35B:
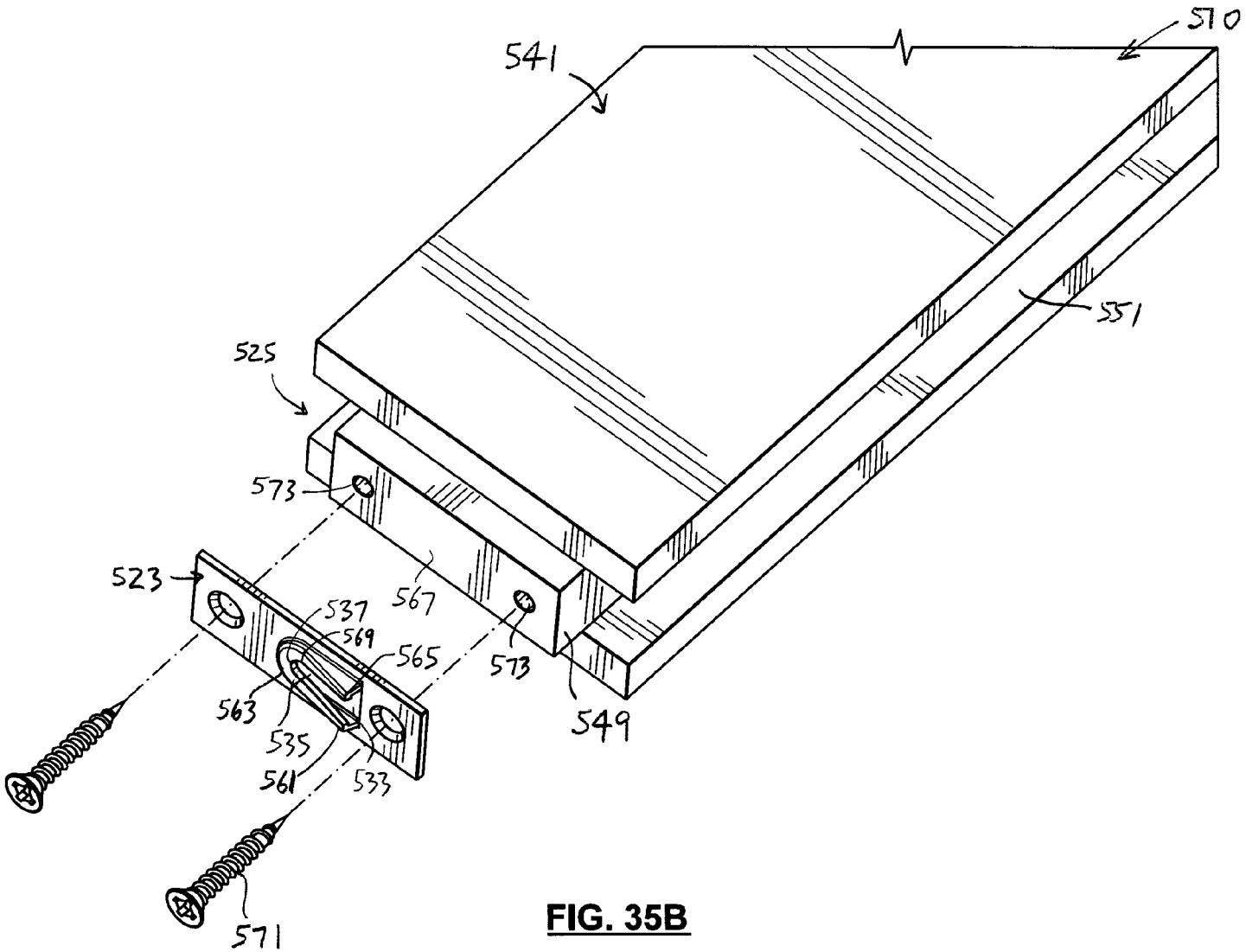
FIG. 35B is an exploded isometric view of a lower end of the stile of FIG. 34, showing an embodiment of a keyed tenon plate of the invention in position to be mounted on a body portion of the stile.
Figure 36:
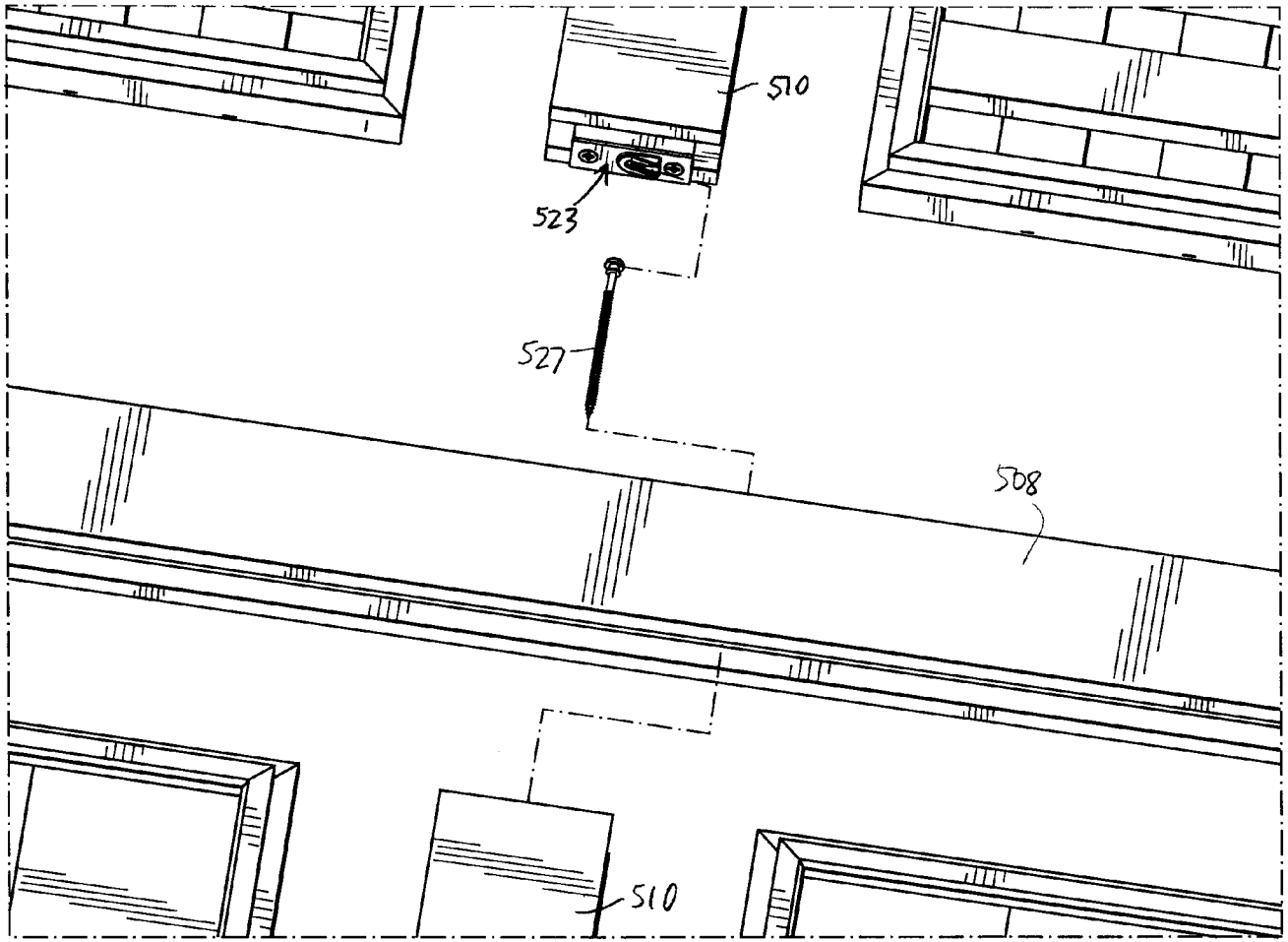
FIG. 36 is an exploded isometric view of a portion of the partition of FIG. 32 in an unassembled state, showing the positioning of an embodiment of an anchor screw of the invention in a rail, drawn at a smaller scale.
Figure 37:
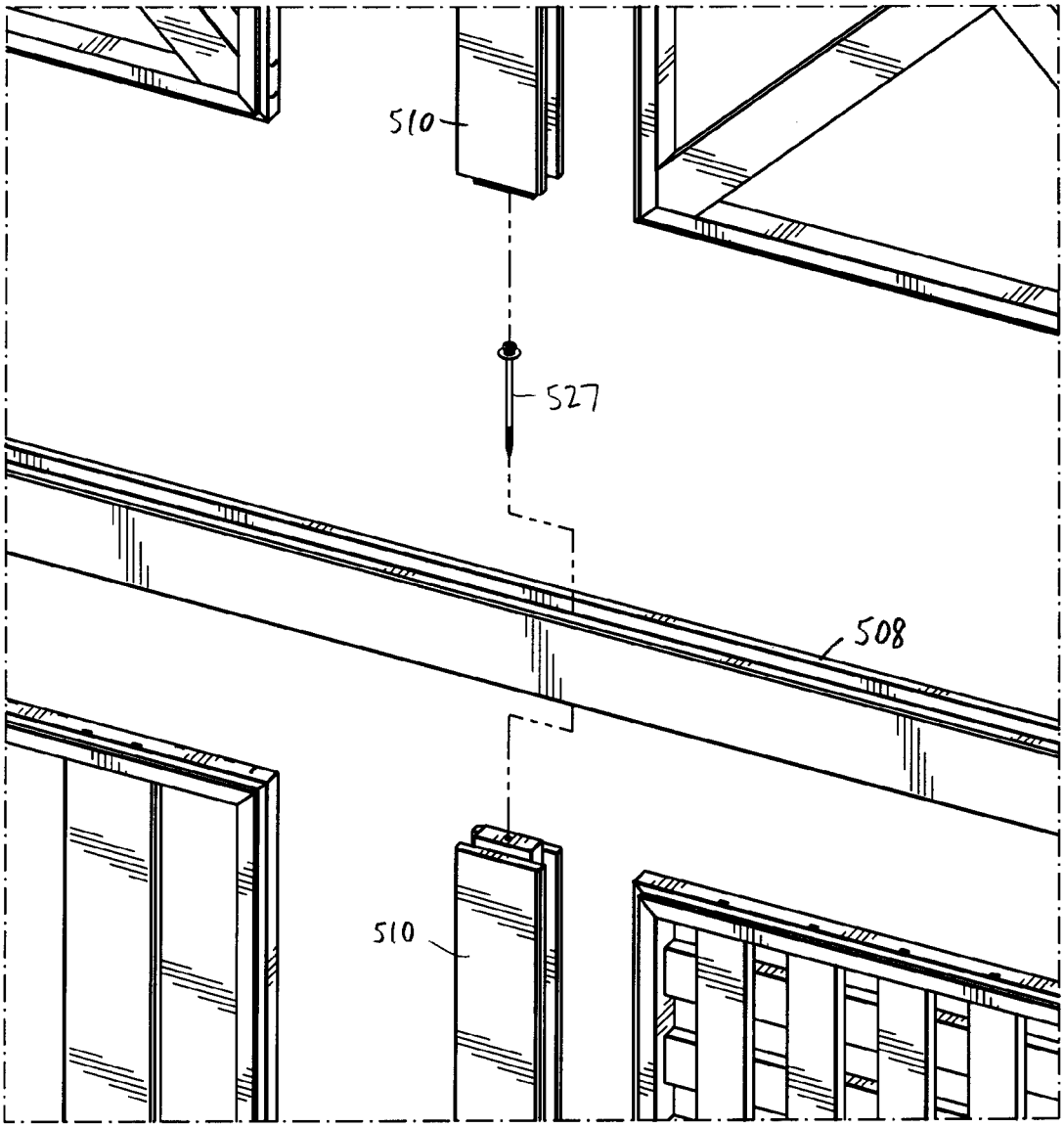
FIG. 37 is an exploded isometric view of a portion of the unassembled partition of FIG. 36, drawn at a smaller scale.
Figure 38:
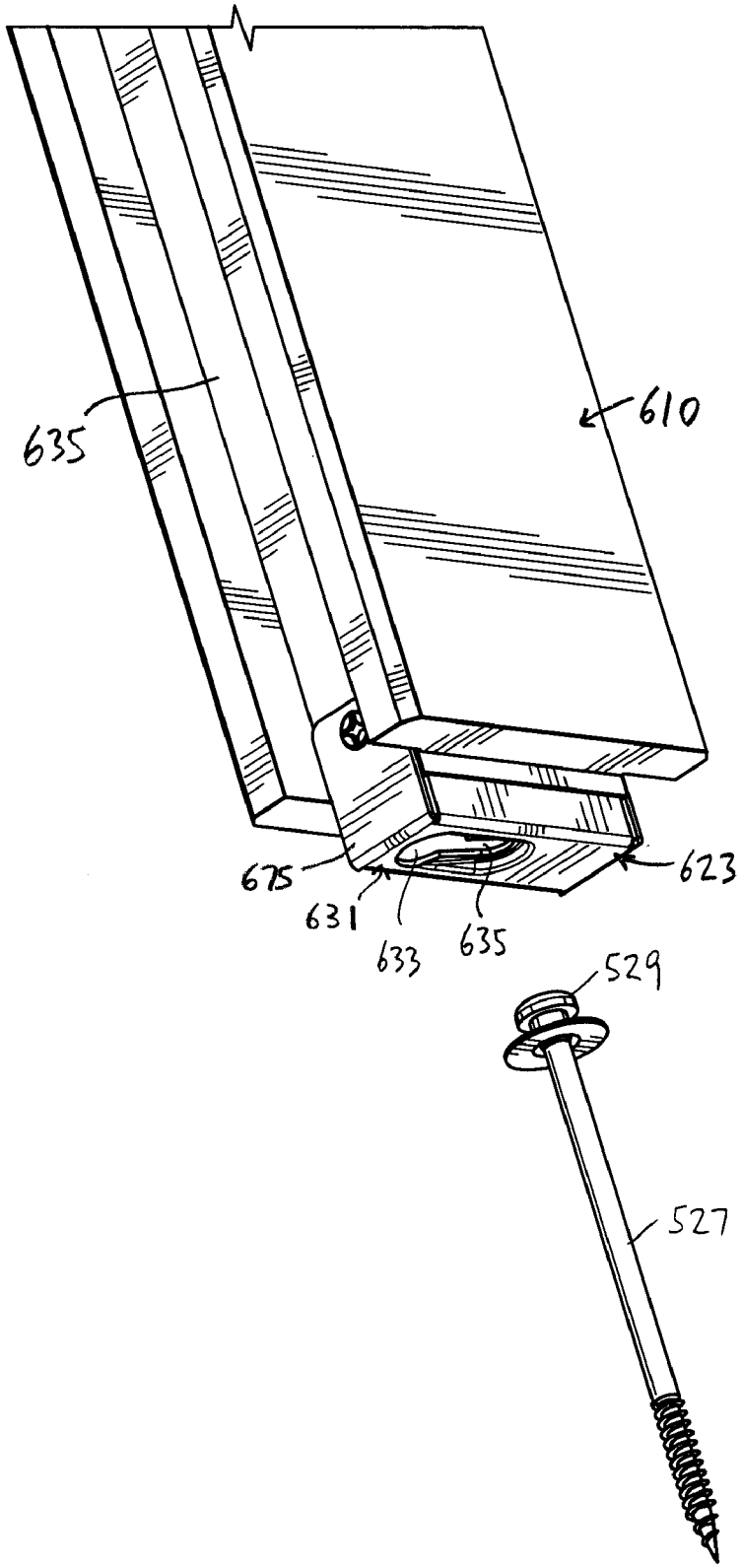
FIG. 38 is an isometric view of an alternate embodiment of the stile of the invention showing the anchor screw with a head portion thereof aligned for reception in an alternate embodiment of a keyed tenon plate of the invention at a lower end of the stile.

In certain circumstances, it may be desired or preferred that a partition include an internal support structure. An embodiment of a structural assembly 521 of the invention and components thereof are shown in FIGS. 32-41B. The structural assembly 521 is for a partition 544 (FIG. 32) in which one or more panel modules 548 is receivable, as will be described. Each panel module 548 has a preselected panel configuration. Preferably, the structural assembly 521 includes one or more rails 508 and one or more stiles 510 adapted to at least partially support the rail 508. It is also preferred that each stile 510 and each rail 508 are positioned to at least partially define one or more apertures 514 (FIG. 33B) having a preselected aperture configuration respectively for receiving one or more of the panel modules 548 therein. In one embodiment, each stile 510 preferably includes a keyed tenon plate 523 (FIG. 34) mounted on a lower end 525 of the stile 510, as will also be described. Preferably, the structural assembly 521 also includes one or more anchor screws 527 (FIGS. 36-38) positioned at least partially in the rail 508. As can be seen in FIG. 38, each anchor screw 527 preferably includes a head portion 529 which protrudes from the rail 508, once the screw 527 is positioned at least partially in the rail 508. The keyed tenon plate 523 preferably includes an engagement portion 531 with an opening 533 and a slot 535 therein in communication with each other (FIG. 35B). As can be seen in FIG. 35B, the slot 535 preferably extends between the opening 533 and an end wall 537 at least partially defining the slot 535. Preferably, the head portion 529 is receivable in the opening 533. The head portion is adapted for retention in the keyed tenon plate so that movement of the end wall toward the head portion locates the head portion in the keyed tenon plate distal from the opening to hold the rail and the stile together.

The screw 527 preferably includes a neck 589 (FIG. 38) narrower than the head portion 529. The neck is receivable in the slot 535, and the head 529 is held in the keyed tenon plate 523. The slot is defined by side walls 589 which engage the head portion, so that the neck of the screw 527 is retained in the slot 533. As can be seen in FIG. 35B, the side walls 589 are positioned at an angle relative to an end face 567 of the lower end tenon 549 of the stile 510, i.e., the side walls 589 proximal to the opening are spaced apart from the end face 567 by a larger distance than the end wall 537. Because of this, relative movement resulting in displacement of the head portion from a position in the opening to a position adjacent to the end wall subjects the screw 527 to tension, thereby serving to hold the screw 527 in place to secure the upper and lower stiles together and the rail therebetween. The relative movement preferably is accomplished by moving the end wall 537 of the slot 535 toward the head portion 529.

Figure 32:
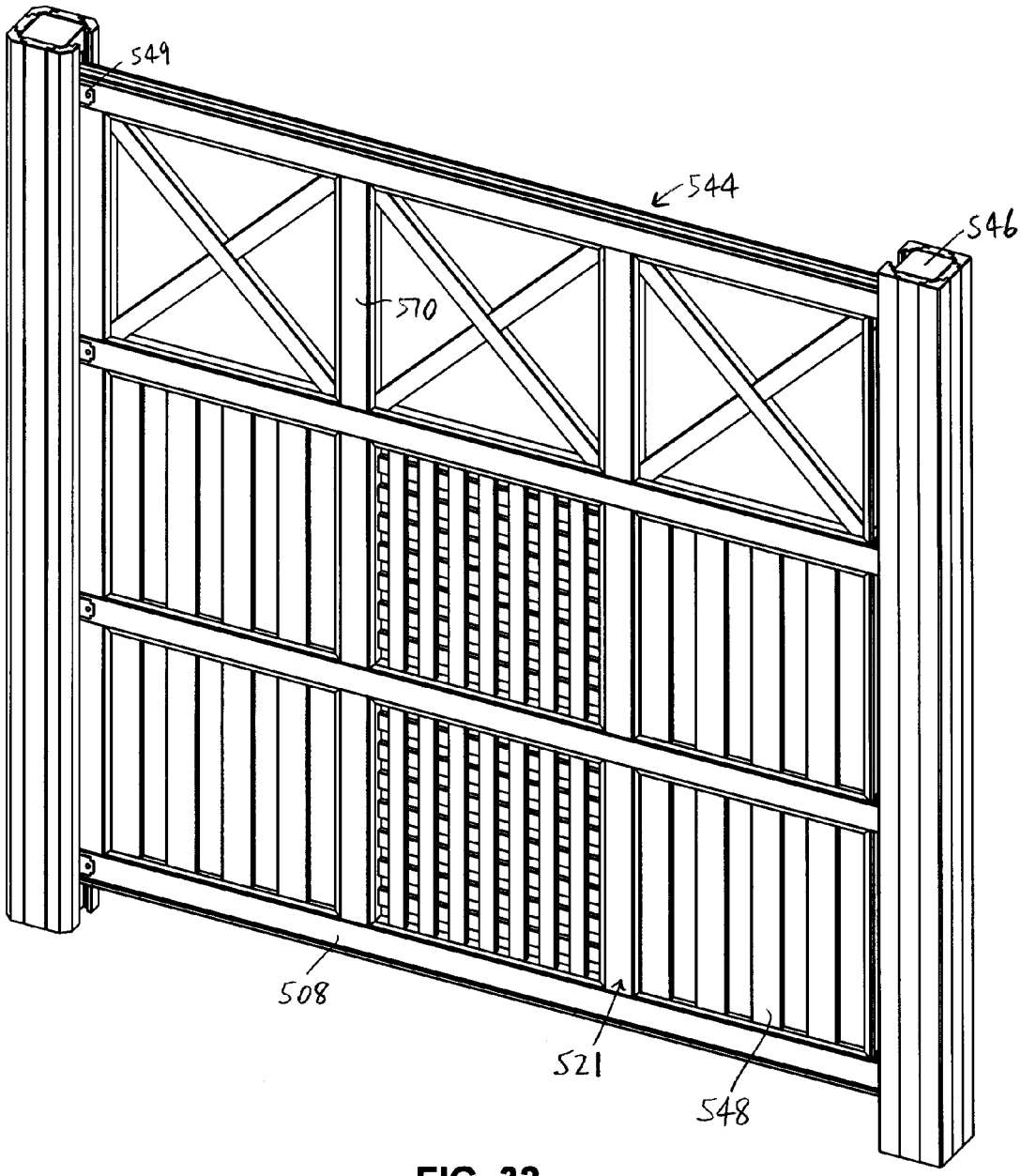
FIG. 32 is an isometric view of an embodiment of a structural assembly of the invention, in an assembled state with embodiments of panel modules of the invention positioned therein, drawn at a smaller scale.

As shown in FIG. 32, in one embodiment, the structural assembly 521 with the panel modules 548 positioned therein forms the partition 544, which is attached to posts 346. The panel modules 548 preferably are positioned in the apertures 514 defined in the structural assembly 521, as will be described. The posts preferably are installed using any suitable method, as is known. It will be understood by those skilled in the art that the partition 544 may form structures other than fences.

Figure 33A:
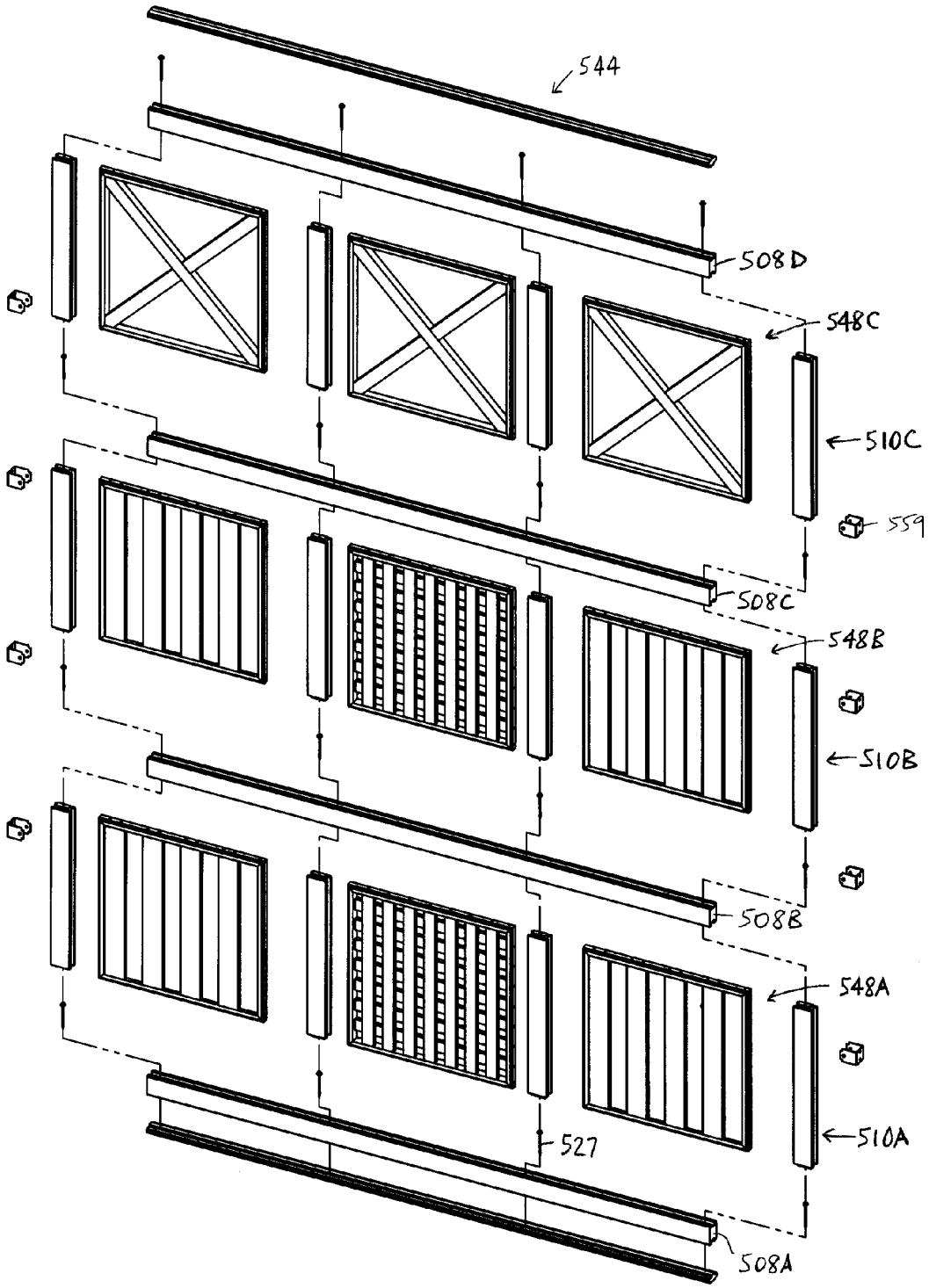
FIG. 33A is an exploded isometric view of the partition of FIG. 32, drawn at a smaller scale.
Figure 33B:
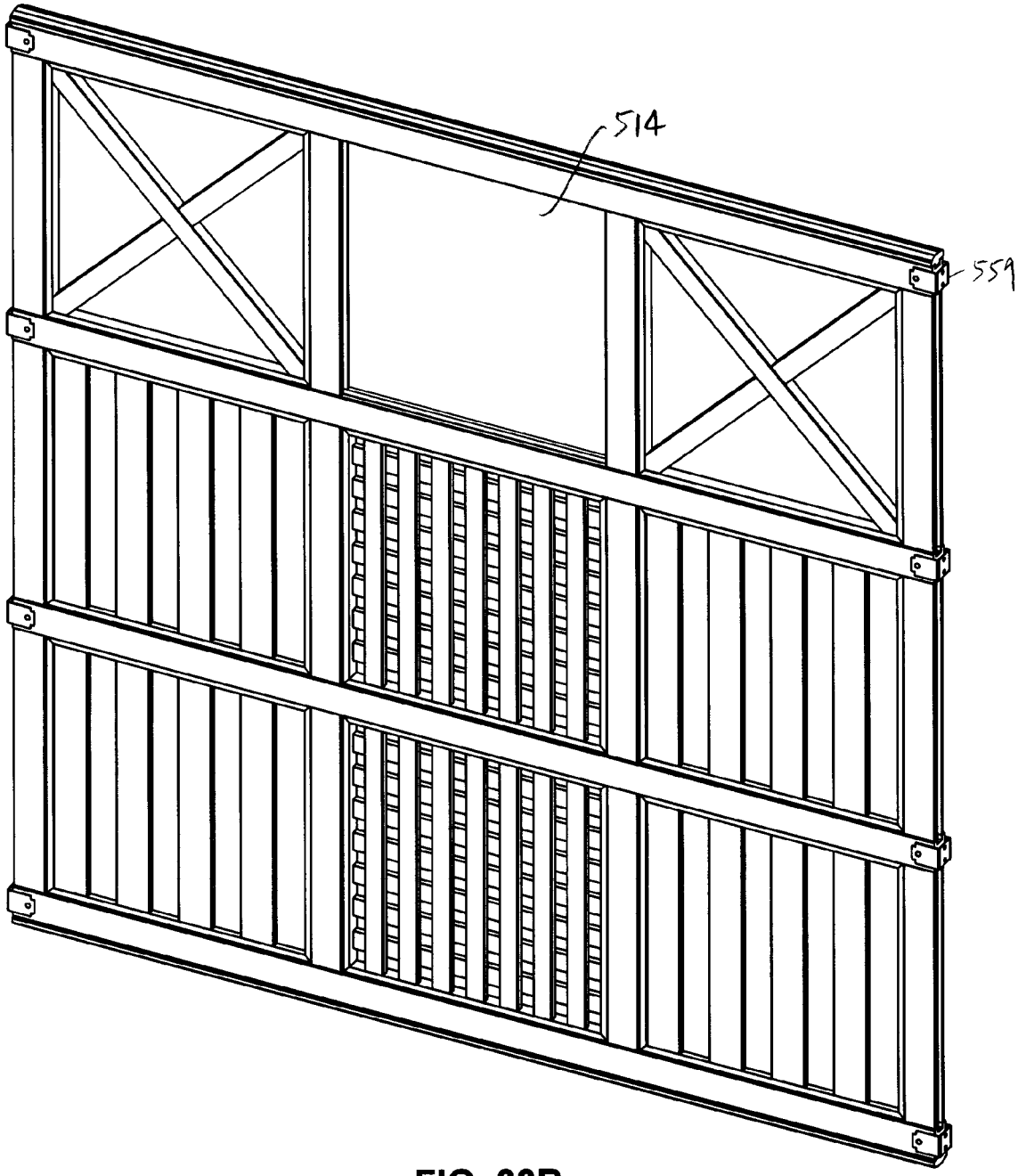
FIG. 33B is an isometric view of the partition of FIG. 33A in the assembled state.
Figure 34:
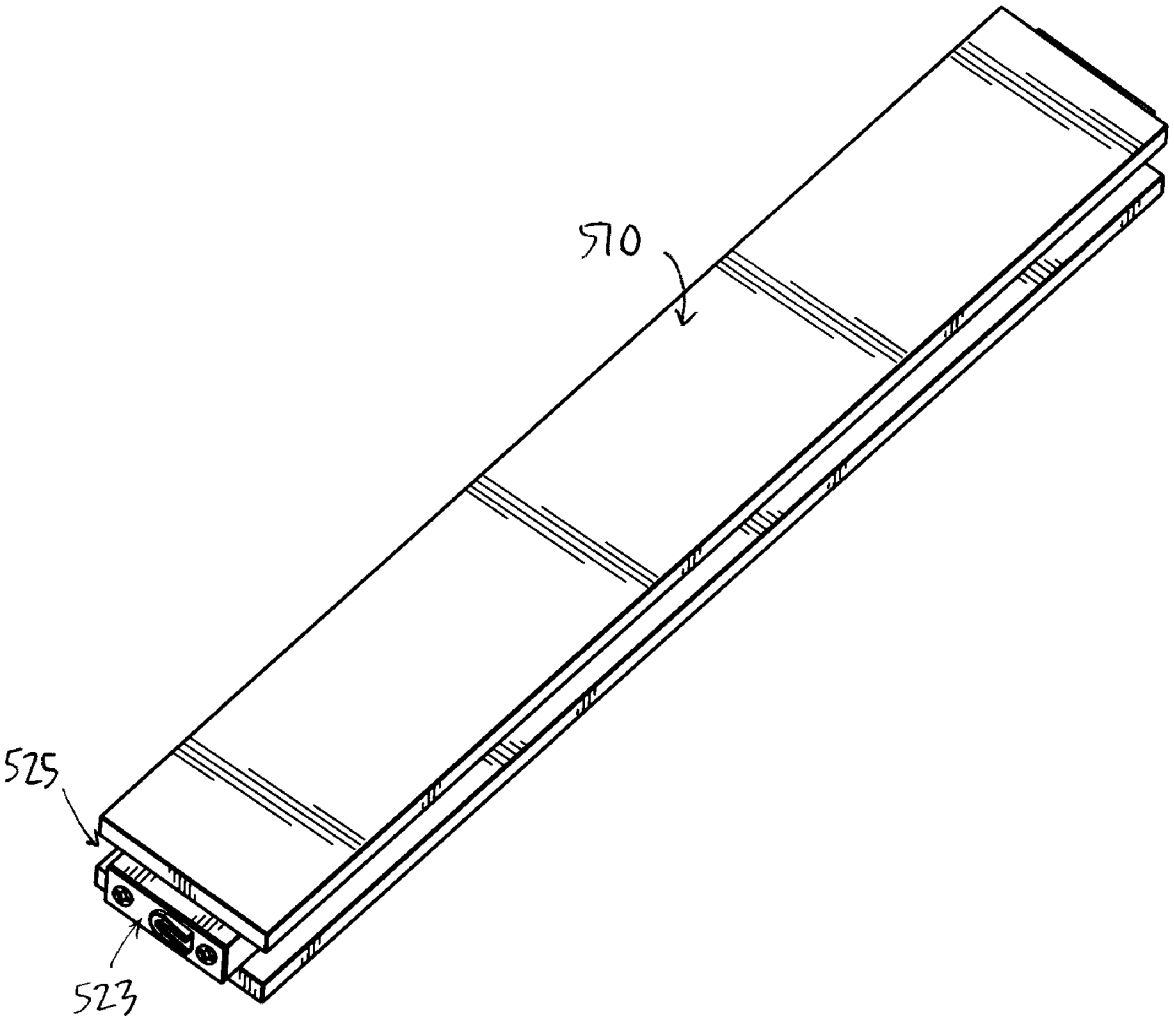
FIG. 34 is an isometric view of an embodiment of a stile of the invention, drawn at a larger scale.

FIG. 33A is an exploded isometric view of the partition 544 of FIGS. 32 and 33B, i.e., the partition 544 is shown in an unassembled state in FIG. 33A, and in an assembled state in FIGS. 32 and 33B. For example, as shown in FIG. 33A, a lowermost rail 508A is positioned to receive four anchor screws 527. Once the anchor screws 527 are in position in lowermost rail 508A, a first set 510A of stiles 510 is mounted on the screws 527 which are positioned in the lowermost rail 508A. The manner in which the lower ends 525 of the stiles 510 are mounted on the screws 527 are described in more detail below. The lowermost panel modules 548A are positioned between the stiles 510A.

A second rail 508B is positioned on top of the stiles 510A and the panel modules 548A. It can be seen from FIG. 33A that rail 508B is, with respect to rail 508A, the upper rail. Screws 527 are driven through the rail 508B and into upper ends 539 of the stiles 510A so that the head portions 529 of each screw 527 protrude above a surface of the rail 508B by a predetermined amount. The lowermost panel modules 548A are positioned in apertures defined by rails 508A, 508B and the stiles 510A.

Positioned above the rail 508B is a second set 510B of stiles, and additional panel modules 548B. Above stiles 510B and panel modules 548B is positioned another rail 508C. As can be seen in FIG. 33A, although the rail 508B is an upper rail with respect to rail 508A, rail 508B is also a lower rail with respect to rail 508C.

As can also be seen in FIG. 33A, by way of example, four screws 527 are driven through the rail 508B and into a body 541 of each stile 510, at the upper ends 539 of each of the stiles 510A respectively. It will be understood that the anchor screws preferably are received in predrilled clearance holes in the rails 508, so that the anchor screws preferably do not thread into the rails but rather thread into the stiles only. It is preferred that the body 541 includes an upper end tenon 543 (FIG. 35A) to fit into a lower slot 542 of rail 508B (FIG. 36), as will be described. After each anchor screw 527 has been inserted through the rail 508B and into the upper end 539 of a stile 510A, the head portion 529 of each screw 527 protrudes above the rail 508B, in an upper slot 543 of the rail 508B.

Figure 41B:
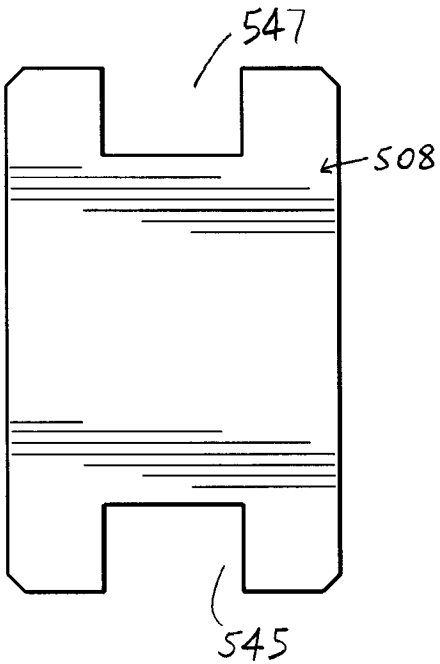
FIG. 41B is an end view of the rail of FIG. 41A.
Figure 41A:
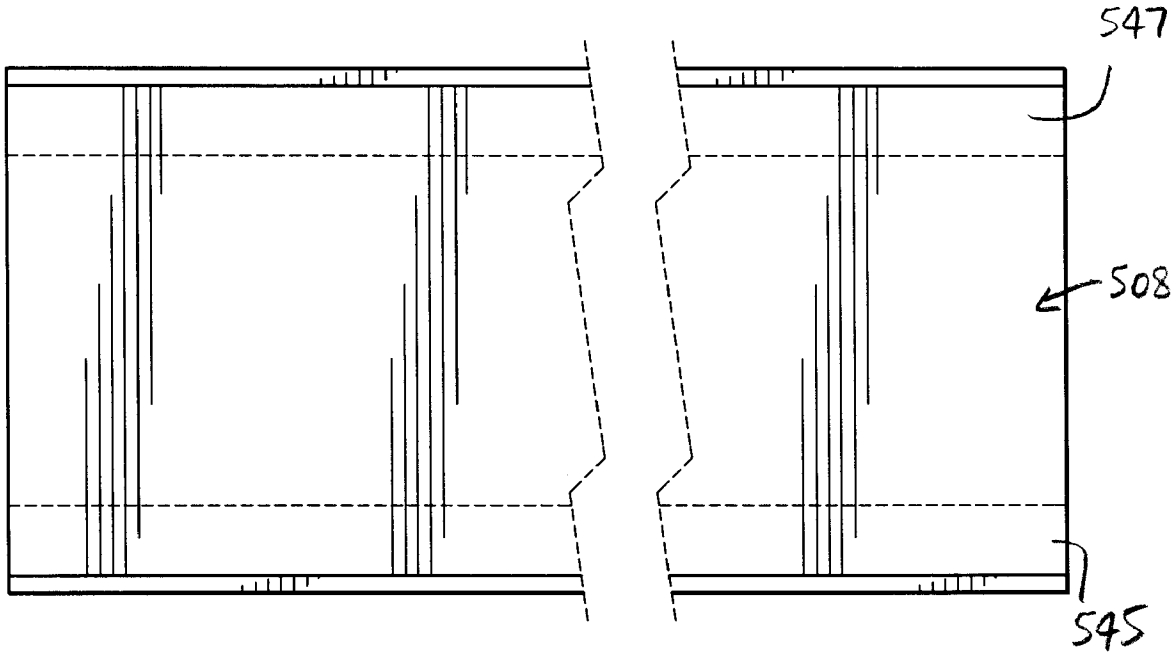
FIG. 41A is a side view of an embodiment of a rail of the invention, drawn at a smaller scale.

The rail 508 is shown in FIGS. 41A and 41B. As can be seen in FIG. 41B, the rail includes the lower slot 545 and the upper slot 547. The upper end tenon 543 of the stile preferably is receivable in the lower slot 545, and the body 541 also preferably includes a lower end tenon 549 which preferably is receivable in the upper slot 547 (FIG. 35B). Preferably, the body 541 of each stile 510 also includes slots 551 along each side thereof, in which side edges 553 of the panel modules 548 are receivable (FIG. 35A).

In the partition 544 shown in FIG. 33A, another set 510C of stiles is positioned above rail 508C, and another set of panel modules 548 is positioned between the stiles 510C. Another rail 508D is positioned on top of the stiles 510C and the panel modules 548C. Preferably, the partition 544 additionally includes a cap portion 505 which is positioned in the upper slot of the rail 508D.

With respect to the topmost rail 508D, it is preferred that screws 527 are driven downwardly through the topmost rail 508D and into the top end 539 of each of the highest stiles 510C. Preferably, once the anchor screws 527 are at least partially positioned in the rail 508D, the head portion 529 of each such screw protrudes above the rail 508D by a predetermined extent, to provide a plurality of heads onto which clips (not shown) mounted on an underside of the cap portion 555 can be pushed (or otherwise placed) and thereby fastened, to hold the cap portion 555 in position on the rail 508D. Preferably, the cap portion 555 fits into the upper slot 543 of the rail 508D.

If preferred, a bottom trim portion 557 is included in the partition 544 (FIGS. 33A, 33B). The bottom trim portion 557 preferably is formed to have an exterior similar to that of the top portion 555, to provide a pleasingly finished appearance. It is preferred that the bottom trim portion 555 is at least partially receivable in the lower slot 545 of the lowermost rail 508A. The bottom trim portion 557 preferably is attached to the rail 508A by any suitable means. In one embodiment, the screws 527 which are driven through the rail 508A are also driven into the bottom trim portion 557, to secure the bottom trim portion 557 to the rail 508A.

Where support posts 546 are used to support the partition, it is preferred that the outermost stiles in the partition 544 are attached to the posts by any suitable means. Preferably, mounting brackets 559 (FIGS. 32, 33A, 33B) are fastened to the outermost stiles by any suitable means (e.g., screws), and the mounting brackets are also attached to the posts by any suitable means. However, other arrangements are possible, e.g., the outermost stiles may be secured directly to the posts.

In one embodiment, the engagement portion 531 of the keyed tenon plate 523 includes a wedge part 561 and a plateau part 563 (FIG. 35B). Preferably, the opening 533 is at least partially located in the wedge part 561. The end wall 537 of the slot 535 preferably is at least partially located in the plateau part 563 so that when the head portion 529 is retained in the slot 535, movement of the end wall 537 toward the head portion 529 subjects the anchor screw 527 to tension, to secure the rail 508 and the stile 510 together.

As can be seen in FIG. 35B, the wedge part 561 preferably extends between a first end 565 and a second end 569 thereof. The second end 569 is at the plateau part 563. The first end 565 is spaced apart from the end face 567 of the lower end tenon 549 by a distance which is substantially greater than the distance by which the second end 569 is spaced apart from the end face 567. The plateau part 563 of the keyed tenon plate preferably is spaced apart from the end face 567 by approximately the same distance as the second end 569.

As shown in FIG. 35B, the keyed tenon plate 523 preferably is attached to the end face 567 of the lower end 525 of the stile 510 by suitable fasteners 571. As can be seen in FIG. 35B, it is preferred that pre-drilled holes 573 are provided in the lower end tenon 549 for proper location of the fasteners 571, to simplify assembly. Also, and as shown in FIG. 35A, a pre-drilled hole 587 preferably is also provided in the upper end tenon 547 for proper location of the anchor screw 527, to simplify assembly.

In use, a user (not shown) selects the panel modules 548 which the user wishes to include in the partition 544 from a variety of prefabricated panel modules. Those skilled in the art will appreciate that a large number of panel element designs are possible. In addition, and as noted above, the panel modules may be formed in a variety of configurations, i.e., sizes of panel modules may vary.

As described above, the rails and stiles are positioned relative to each other to at least partially define apertures with respective preselected aperture configurations in which the panel modules 548 are respectively receivable, in an arrangement also determined by the user. The panel apertures are selected so that the panel modules to be inserted therein respectively will be receivable therein. The rails preferably are provided in a standard preselected length, and may be cut by the user for a particular partition. As can be seen in FIGS. 33A and 33B, the rails preferably are provided in lengths so that they are suitable for positioning above or below a number of panel modules and stiles positioned therebetween. The stiles preferably are provided in lengths suitable for panel modules including one panel element or whole number multiples thereof, if desired.

It will be appreciated by those skilled in the art that the embodiment of the structural assembly shown in FIGS. 32, 33A, and 33B is exemplary only. For example, although the partition as illustrated has three generally horizontal rows of panels, with the rows positioned vertically, the partition could have any desired height. Also, although the rails shown are sized to accommodate three panels and four stiles, the rails could be made to accommodate other numbers of panels and stiles.

It will be understood that the elements of the structural assembly may be provided separately, in the amounts needed by the user to construct the structural assembly having the desired attributes. The desired attributes would, to an extent, be at least partially determined by the panel module(s) 548 chosen by the user. Preferably, the panel modules 548 are provided having one or more substantially uniform sizes, e.g., 16" by 16". Where the panel modules have more than one size, the sizes and configurations of the respective panel modules preferably are compatible with each other. As described above, each panel module preferably includes at least one panel element. Posts may be provided in standard lengths, sized to cooperate with stiles to support the partition. The posts may be cut by the user to fit a particular partition.

Accordingly, in one embodiment, the invention may be provided in the form of a kit of parts which may be assembled to form the structural assembly of a partition. The kit preferably includes the components needed to build at least one design of the structural assembly of the invention, having preselected dimensions. The kit preferably includes a number of rails and a number of stiles adapted to support the rails, upon assembly. Also, the kit includes a number of keyed tenon plates, each being adapted for attachment to the lower end of each stile. In addition, the kit preferably includes a predetermined number of anchor screws, i.e., the number required to build the selected design, with a few extra.

Figure 39A:
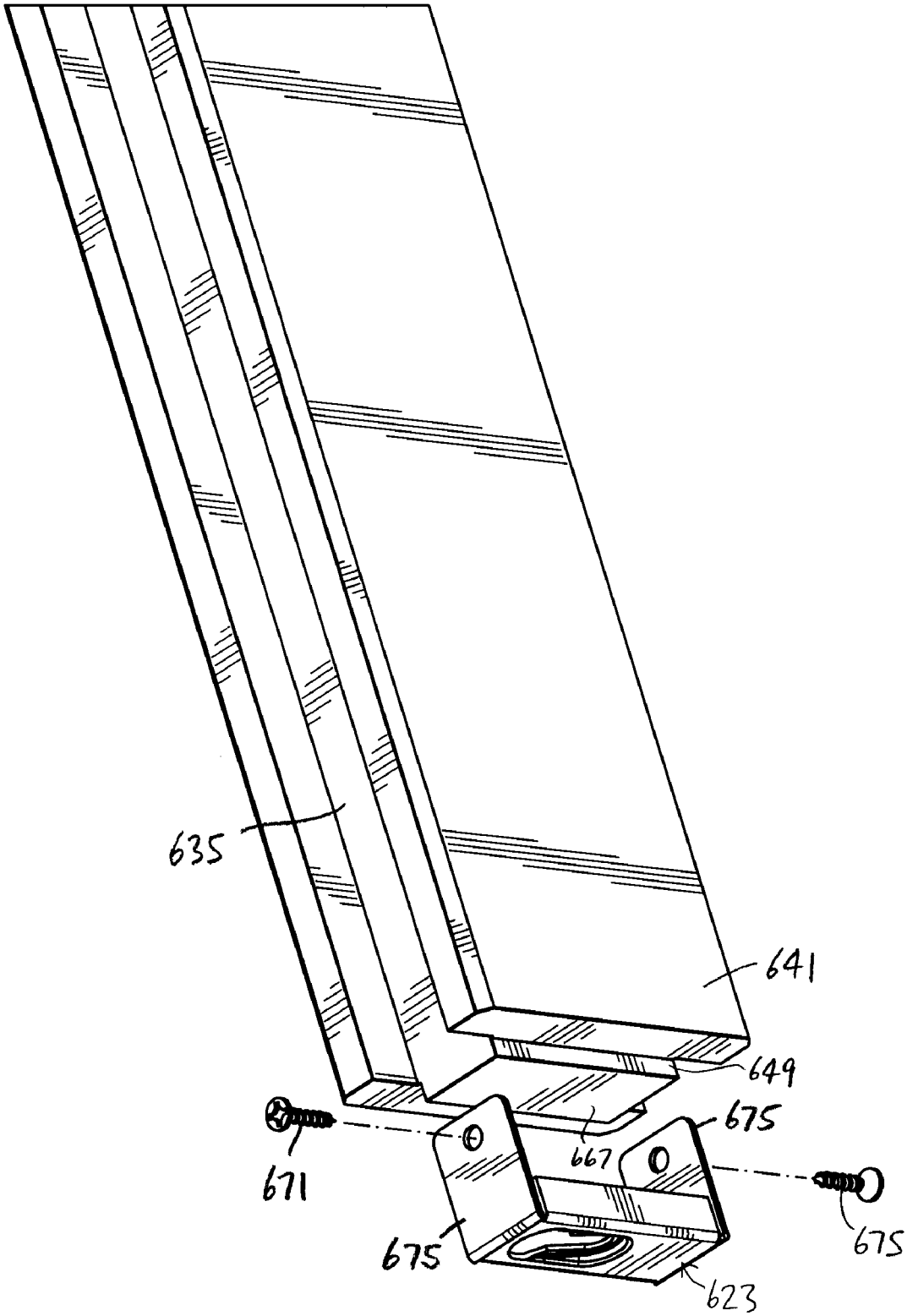
FIG. 39A is an exploded isometric view of the lower end of the stile of FIG. 38.
Figure 39B:
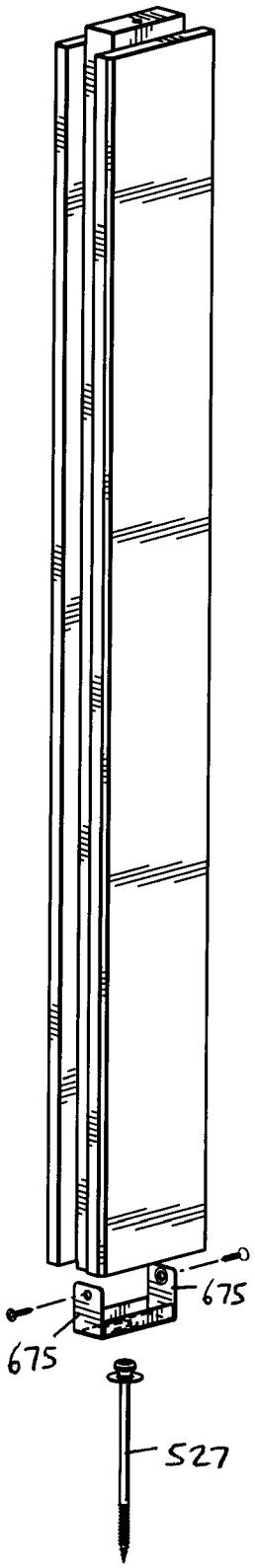
FIG. 39B is an exploded isometric view of the stile of FIG. 38 and the anchor screw, drawn at a smaller scale.
Figure 39C:
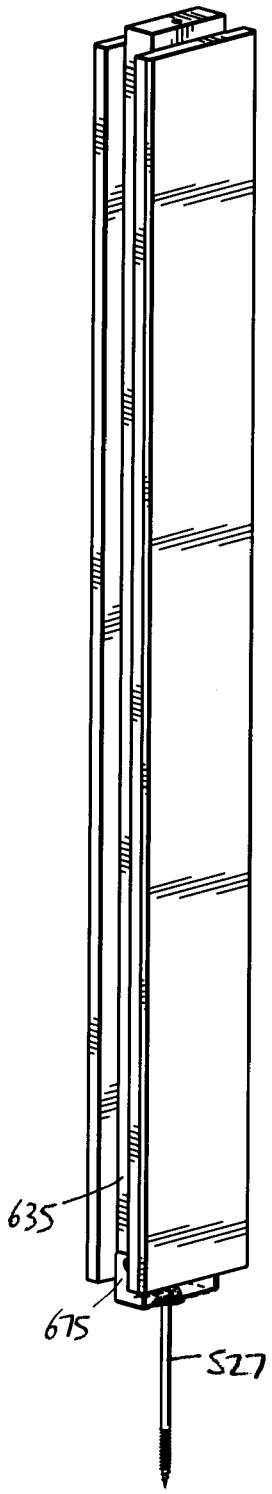
FIG. 39C is an isometric view of the stile of FIG. 39B, with the head portion of the anchor screw positioned in the keyed tenon plate.
Figure 39D:
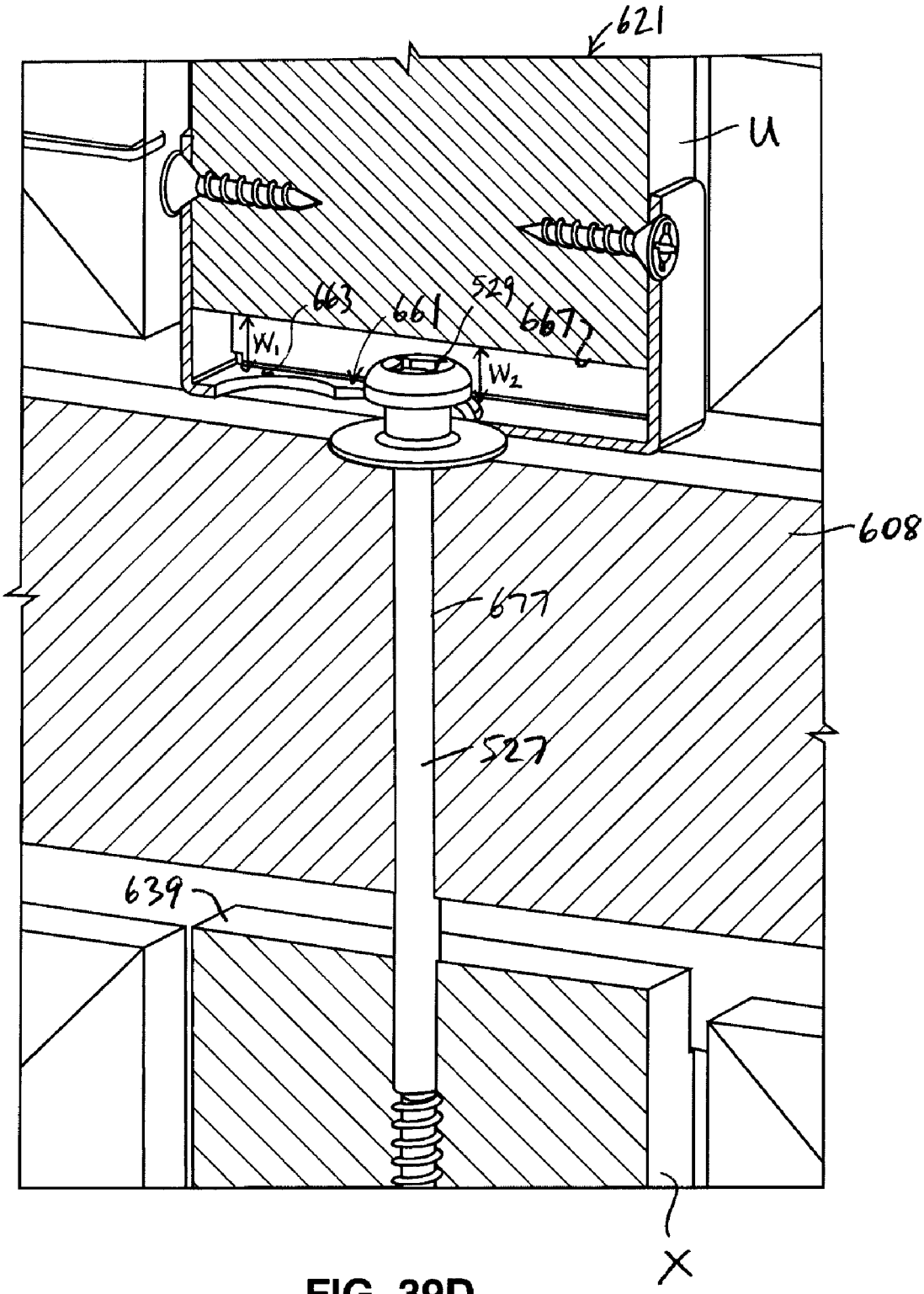
FIG. 39D is an isometric cross-section of the stile of FIG. 39C in an embodiment of a structural assembly of the invention in an assembled condition, drawn at a larger scale.

An alternate embodiment of a keyed tenon plate 623 is disclosed in FIGS. 38-39D. As can be seen in FIGS. 38 and 39A, the keyed tenon plate 623 includes legs 675 projecting from an engagement portion 631 of the keyed tenon plate 623. The keyed tenon plate 623 is shaped so that the engagement portion 631 thereof fits over an end face 667 of a lower end tenon 649, spaced apart from the end face 667. When the keyed tenon plate 623 is positioned on the lower end tenon 649 so that the engagement portion 631 is spaced apart from the end face 667 of the lower end tenon 649 (FIG. 39A), the legs 675 are positionable in the slots 635 of the stile 610, so that the fasteners 671 are preferably driven into the body 641 of the stile 610 substantially orthogonally to the longitudinal axis thereof. This arrangement permits the keyed tenon plate 623 to be attached to the stile 610 without requiring fasteners to be driven into the end face 667 of the lower end tenon 649, i.e., end-on into the grain of the wood which makes up the lower end tenon 649, for more securely fastening the keyed tenon plate 623 to the body 641.

As can be seen in FIGS. 39B and 39C, the legs 675 preferably fit into the slots 635 of the stile 610. The keyed tenon plate 623 is attached to the lower end tenon 649 by fasteners 671 which are driven into the body 641 in the slots 635.

In FIG. 39D, the keyed tenon plate 623 is shown in one embodiment of the structural assembly 621 of the invention in an assembled condition. As can be seen in FIG. 39D, the anchor screw 527 is driven through the rail 608 to engage an upper end 639 of the stile 610. Preferably, the anchor screw 527 is received in a predrilled hole 677 in the rail 608, i.e., the anchor screw 527 preferably is not threadably (or securely) engaged with the rail 608 (FIG. 39D).

The screw 527 preferably is threadably engaged with a lower stile (designated "X" in FIG. 39D for clarity). As can be seen in FIG. 39D, the wedge part 661, in which the opening 633 is at least partially located, is spaced apart from an end face 667 of a lower end 625 of the upper stile "U" by a distance "$W_1$", at a point adjacent to the opening which is distal from the plateau part 663. The plateau part 663 is spaced apart from the end face 667*a* distance "$W_2$". $W_2$ is substantially less than $W_1$. It can be seen, therefore, that once the head portion 529 of the anchor screw 527 is positioned through the opening 633, movement of an end wall 637 of the slot 635 toward the head portion 529 (i.e., resulting in movement of the plate 623 relative to the screw 527 so that the head portion 529 is engaged with the wedge part 661 progressively closer to the end face 667, and the head portion 529 ultimately is positioned adjacent to the plateau part 663) ultimately subjects the screw 527 to tension, thereby firmly securing the upper and lower stiles U, X to the rail 608 positioned therebetween.

Figure 40A:
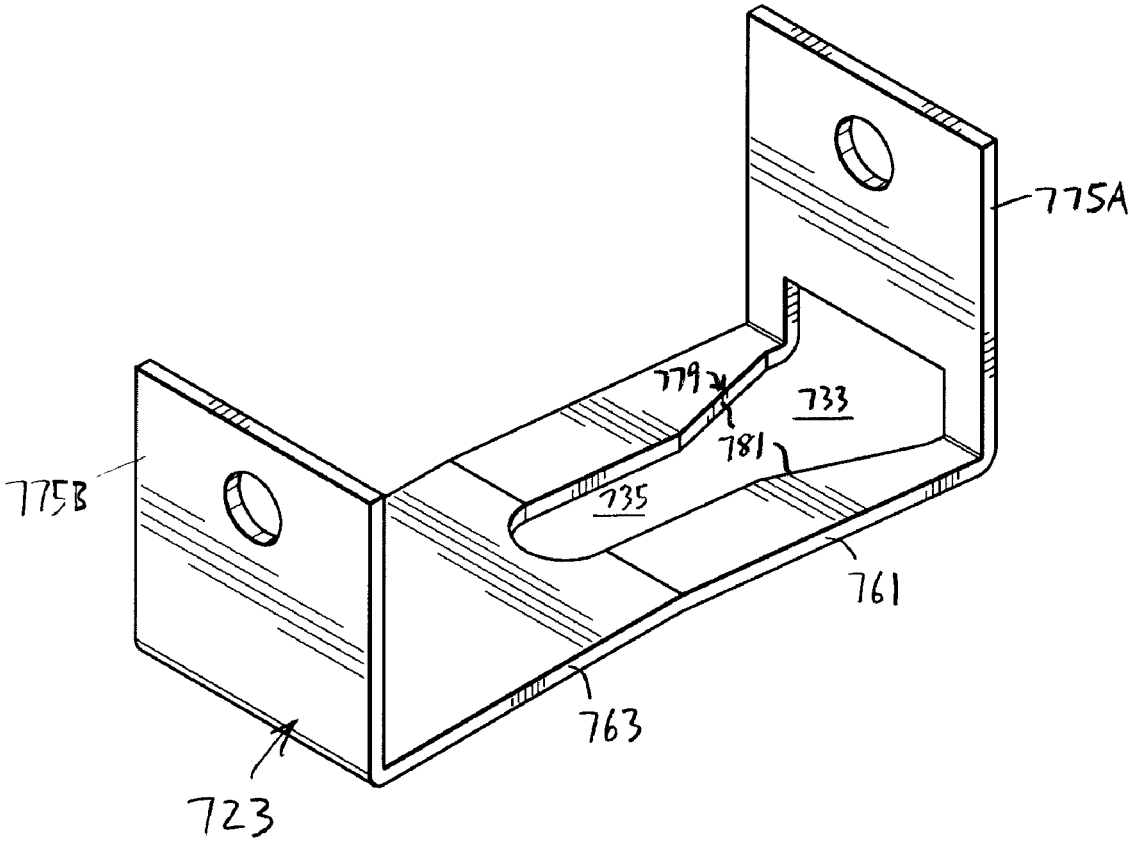
FIG. 40A is an isometric view of another alternate embodiment of a keyed tenon plate of the invention, drawn at a larger scale.
Figure 40B:
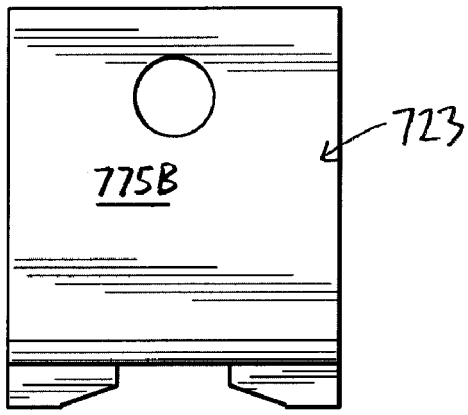
FIG. 40B is an end view of a first end of the keyed tenon plate of FIG. 40A.
Figure 40D:
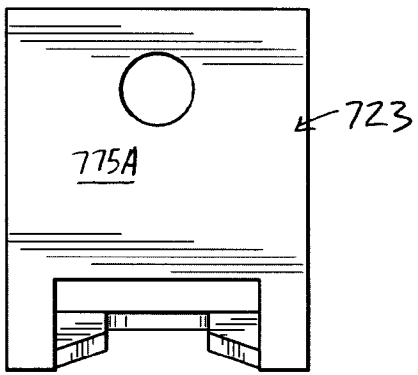
FIG. 40D is an end view of a second end of the keyed tenon plate of FIG. 40A.
Figure 40C:
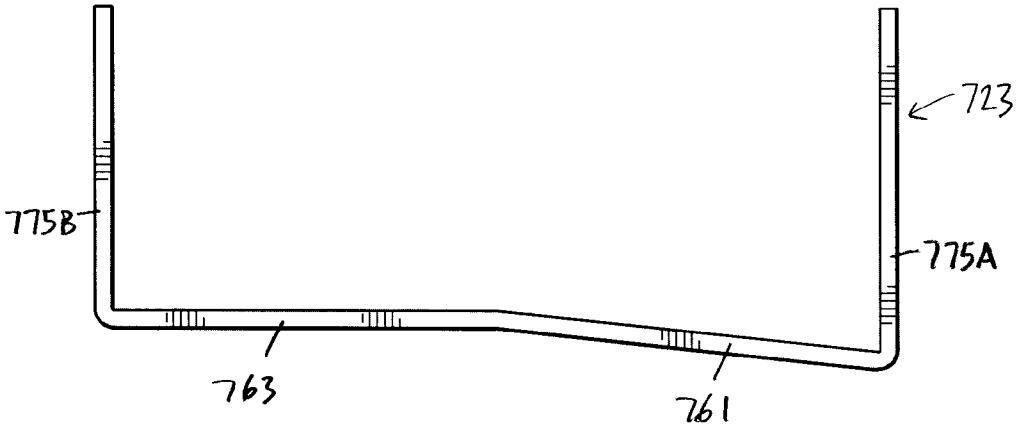
FIG. 40C is a side view of the keyed tenon plate of FIG. 40A.
Figure 40E:
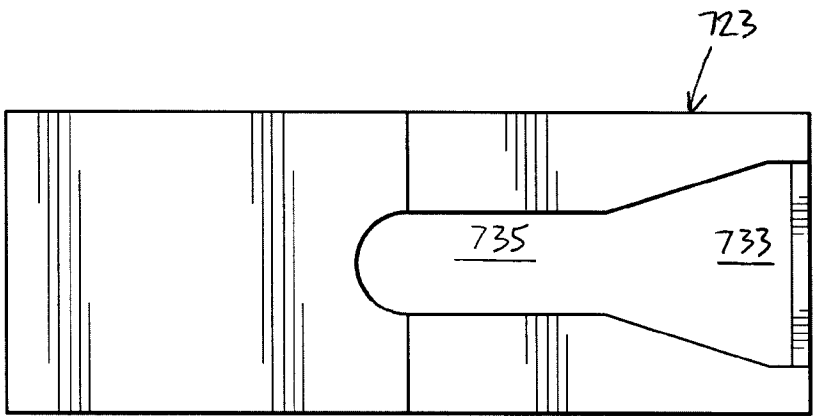
FIG. 40E is a plan view of a bottom side of the keyed tenon plate of FIG. 40A.

Another alternative embodiment of a keyed tenon plate 723 is shown in FIGS. 40A-40E. As can be seen in FIGS. 40A, 40C and 40E, the keyed tenon plate 723 includes a wedge part 761 and a plateau part 763. The plate 723 also includes an opening 733 in communication with a slot 735. In addition, the plate includes legs 775A, 775B. Leg 775A extends from the wedge part 761, and leg 775B extends from the plateau part 763. As can be seen in FIG. 40A, it is preferred that the opening 733 extends into the leg 775A, to a certain extent. This permits the head portion (not shown in FIGS. 40A-40E) of the anchor screw to be readily received in the opening 733. Preferably, an intermediate portion 779 defined by angled edges 781 is positioned between the opening 733 and the slot 735, for guiding the keyed tenon plate so that the anchor screw is positionable in the slot (i.e., assuming that the keyed tenon plate is moved relative to the anchor screw). For clarity of illustration, the keyed tenon plate is not shown mounted on the lower end tenon of a stile.

It will be appreciated by those skilled in the art that the invention can take many forms, and that such forms are within the scope of the invention as described above. The foregoing descriptions are exemplary, and their scope should not be limited to the preferred versions provided therein.

We claim:

1. A partition to be supported by at least one support element, the partition comprising:

at least two panel modules, each said panel module comprising:

at least two panel elements;

said at least two panel elements being positioned relative to each other in a predetermined abutting arrangement selected from the group consisting of a vertical arrangement, in which said at least two panel elements are positioned operably vertically relative to each other, and a horizontal arrangement, in which said at least two panel elements are positioned operably horizontally relative to each other;

said at least two panel elements defining a joint intersection therebetween;

at least one fastening element attached to said at least two panel elements on both sides of the joint intersection to maintain said at least two panel elements in said predetermined abutting arrangement;

said at least one fastening element being selected from the group consisting of a fastening element comprising a stud portion and a fastening element comprising a keyhole slot, said stud portion and said keyhole slot being adapted to cooperate to secure said at least two panel modules together;

a first one of said at least two panel modules comprising said at least one fastening element with the stud portion and a second one of said at least two panel modules comprising said at least one fastening element with the keyhole slot;

the stud portion comprising a head supported by a neck;

the keyhole slot comprising a slot portion and an opening in communication with the slot portion, the opening being wider than the slot portion;

the head being receivable in the opening;

the neck being receivable in the slot portion upon relative movement of the first and second panel modules after the head is received in the opening;

the slot portion being at least partially defined by side walls extending between the opening and a slot portion end wall; and the side walls being positioned such that, as the neck is positioned in the slot portion closer to the slot portion end wall, the neck is subjected to increasing tension.

2. A partition according to claim 1 additionally comprising at least one coupler for coupling at least a selected one of said at least two panel modules to said at least one support element.

3. A partition according to claim 1 in which the neck and the head are positionable in a secure position, in which the neck and the head are proximal to the slot portion end wall to secure said at least two panel modules together.

4. A partition according to claim 1 in which:

the second panel module comprises a panel element end wall of the panel elements on which the fastening element comprising the slot portion is mounted;

the opening of the keyhole slot is at least partially defined by an edge which is connected to the side walls; and the side walls are positioned to locate the edge further away from the panel element end wall on which the fastening element comprising the slot portion is mounted than the slot portion end wall such that the neck is subjected to tension when the neck and the head are positioned proximal to the slot portion end wall, to secure said at least two panel modules together.

5. A partition according to claim 1 in which:

after the head is received in the opening and after relative movement of the fastening elements on said at least two panel modules to position the neck in the slot portion, the head and the neck are positionable in a secured position, in which the head is proximal to the end wall of the slot portion and the neck is in the slot portion to secure said at least two panel modules together.

6. A partition according to claim 5 in which each of said at least two panel modules additionally comprises at least two edge fastening elements adapted for cooperation with each other to secure said at least two panel modules together.

7. A partition according to claim 6 in which each said edge fastening element is attached to a side of each said panel module respectively.

8. A partition according to claim 7 in which each said edge fastening element is attached to each said panel module respectively proximal to a bottom edge thereof.

9. A partition system comprising:

at least one partition body comprising:

a plurality of panel modules, each said panel module comprising:

at least two panel elements;

said at least two panel elements being positioned relative to each other in a predetermined abutting arrangement to define a joint intersection therebetween;

at least one fastening element attached to said at least two panel elements on both sides of the joint intersection to maintain said at least two panel elements in said predetermined abutting arrangement;

said at least one fastening element being selected from the group consisting of a fastening element comprising a stud portion and a fastening element comprising a keyhole slot adapted to cooperate to secure the panel modules positioned adjacent to each other together to form said at least one partition body extending between ends thereof;

at least one support element for supporting said at least one partition body;

at least one coupler for coupling at least one of said ends of said at least one partition body to said at least one support element;

selected ones of the panel modules being provided in pairs, each said pair comprising a first and a second selected panel module respectively, the first panel module comprising the fastening element having the stud portion and the second panel module comprising the fastening element having the keyhole slot, the first and second selected panel modules being positioned adjacent to each other;

the stud portion comprising a head supported by a neck;

the keyhole slot comprising a slot portion and an opening in communication with the slot portion, the opening being substantially wider than the slot portion;

the head being receivable in the opening;

the neck being receivable in the slot portion upon relative movement of the first and second selected panel modules after the head is received in the opening;

the slot being at least partially defined by side walls positioned to subject the stud portion to tension as the head is repositioned from the opening to the secured position; and after the head is received in the opening and after relative movement of the fastening elements on said first and second panel modules to position the neck in the slot, the head and the neck are positionable in a secured position, in which the head is proximal to the end wall of the slot portion and the neck is in the slot, to secure said adjacent panel modules to each other.

* * * * *